US006945838B2

(12) United States Patent
Konishi et al.

(10) Patent No.: US 6,945,838 B2
(45) Date of Patent: Sep. 20, 2005

(54) KNOCKING PROCESSING METHOD IN FLAT-TYPE DISPLAY DEVICE, AND KNOCKING PROCESSING METHOD IN FLAT-PANEL DISPLAY DEVICE-USE SUBSTRATE

(75) Inventors: Morikazu Konishi, Kanagawa (JP); Koichi Iida, Kanagawa (JP)

(73) Assignee: Sony Corporation (JP)

( * ) Notice: Subject to any disclaimer, the term of this patent is extended or adjusted under 35 U.S.C. 154(b) by 360 days.

(21) Appl. No.: 10/275,404

(22) PCT Filed: Jan. 24, 2002

(86) PCT No.: PCT/JP02/00494

§ 371 (c)(1),
(2), (4) Date: Nov. 5, 2002

(87) PCT Pub. No.: WO02/071434

PCT Pub. Date: Sep. 12, 2002

(65) Prior Publication Data

US 2004/0130510 A1 Jul. 8, 2004

(30) Foreign Application Priority Data

Mar. 7, 2001 (JP) ..... 2001-063365

(51) Int. Cl.[7] ..... H01J 9/00
(52) U.S. Cl. ..... 445/5; 445/6; 445/59
(58) Field of Search ..... 445/5, 6, 59, 24

(56) References Cited

U.S. PATENT DOCUMENTS 5,209,687 A * 5/1993 Konishi ..... 445/6
5,578,900 A * 11/1996 Peng et al. ..... 313/495
6,380,700 B1 * 4/2002 Okada ..... 313/414

FOREIGN PATENT DOCUMENTS

| | | |
|---|---|---|
| JP | 60-74236 | 4/1985 |
| JP | 7-105850 | 4/1985 |
| JP | 04-249827 | 9/1992 |
| JP | 2000-251737 | 9/2000 |
| JP | 2000-285796 | 10/2000 |
| JP | 2000-294140 | 10/2000 |
| JP | 2000-311590 | 11/2000 |

OTHER PUBLICATIONS

International Search Report.

Australian Search Report and Written Opinion dated Mar. 10, 2004.

* cited by examiner

*Primary Examiner*—Mariceli Santiago
(74) *Attorney, Agent, or Firm*—Rader, Fishman & Grauer, PLLC; Ronald P. Kananen

(57) ABSTRACT

A knocking treatment method in a flat-type display device in which a first substrate provided with a first electrode and a second substrate provided with a second electrode are disposed with a vacuum space interposed between the first and second substrates and the first substrate and the second substrate are bonded to each other in their circumferential portions, the method comprising applying to the first electrode a pulse voltage $V_1$ higher than a voltage to be applied to the second electrode to remove a projection present in the first electrode by field evaporation.

14 Claims, 53 Drawing Sheets

[STEP-100]

[STEP-110]

[STEP-120]

[STEP-120] CONTINUED

[STEP-200]

[STEP-210]

[STEP-220]

[STEP-230]

[STEP-240]

[STEP-240]

[STEP-300]

[STEP-310]

[STEP-330]

[STEP-400]

[STEP-410]

[STEP-410] CONTINUED

[STEP-520]

[STEP-530]

[STEP-530] CONTINUED

[STEP-540]

[STEP-600]

[STEP-620]

[STEP-630]

[STEP-800]

[STEP-810]

[STEP-820]

[STEP-840]

[STEP-850]

[STEP-900]

[STEP-910]

[STEP-920]

[STEP-1000]

[STEP-1010]

[STEP-1020]

[STEP-1120]

[STEP-1130]

[STEP-1140]

[STEP-1150]

[STEP-1200]

[STEP-1210]

[STEP-1220]

[STEP-1300]

[STEP-1310]

[STEP-1320]

[STEP-1330]

[STEP-1330] CONTINUED

[STEP-1340]

SELECTION RATIO TO RESIST : SMALL

SELECTION RATIO TO RESIST : INTERMEDIATE

SELECTION RATIO TO RESIST : LARGE

[STEP-1400]

[STEP-1410]

[STEP-1420]

[STEP-1430]

[STEP-1440]

[STEP-1450]

[STEP-1500]

[STEP-1510]

[STEP-1520]

[STEP-1600]

[STEP-1600] CONTINUED

[STEP-1610]

[STEP-1620]

[STEP-1620] CONTINUED

[STEP-1630]

[STEP-1700]

[STEP-1710]

[STEP-1720]

[STEP-1730]

[STEP-1800]

KNOCKING PROCESSING METHOD IN FLAT-TYPE DISPLAY DEVICE, AND KNOCKING PROCESSING METHOD IN FLAT-PANEL DISPLAY DEVICE-USE SUBSTRATE

TECHNICAL FIELD

The present invention relates to a knocking treatment method in a flat-type display device and a knocking treatment method in a substrate for a flat-type display device.

BACKGROUND ART

Flat-type (flat panel) display devices are studied in various ways as an image display device for replacing a currently main-stream cathode ray tube (CRT). As such flat-type display devices, for example, there are a liquid crystal display (LCD), an electroluminescence display (ELD) and a plasma display (PDP). Further, there is also proposed a cold cathode field emission display capable of emitting electrons from a solid to a vacuum space without relying on thermal excitation, a so-called field emission display (FED). The cold cathode field emission display is attracting attention from the viewpoint of a bright screen and low power consumption.

FIG. 7 shows a typical constitution example of the cold cathode field emission display (to be sometimes referred to as "display" hereinafter), and FIG. 8 shows a schematic exploded perspective view of part of a cathode panel 10 and an anode panel 20. In the display, the cathode panel 10 and the anode panel 20 are arranged so as to face each other, and bonded to each other in circumferential regions through a frame (not shown) to constitute a vacuum space of a closed space between these two panels 10 and 20. The cathode panel 10 has a plurality of cold cathode field emission devices (to be sometimes abbreviated as "field emission device" hereinafter). As an example of the field emission device, FIG. 7 shows a so-called Spindt-type field emission device having an electron emitting portion 16 constituted of a conical electron emission electrode 16A. The Spindt-type field emission device comprises a stripe-shaped cathode electrode 12 formed on a first support member 11, an insulating layer 13, a stripe-shaped gate electrode 14 formed on the insulating layer 13, and a conical electron emission electrode 16A formed in an opening portion 15 made through the gate electrode 14 and the insulating layer 13. Generally, many electron emission electrodes 16A are provided so as to correspond to one phosphor layer 22 to be described later. A relatively negative voltage (scanning signal) is applied to the electron emission electrodes 16A from a cathode-electrode driving circuit 25 through the cathode electrode 12, and a relatively positive voltage (video signal) is applied to the gate electrode 14 from a gate-electrode driving circuit 26. Electrons are emitted from the tip of the electron emission electrode 16A on the basis of a quantum tunnel effect depending upon an electric field caused by the voltage applications. The field emission device is not limited to the above Spindt-type field emission device and, in some cases, is selected from field emission devices of various types such as so-called edge-type, flat-type or some other type field emission devices.

The anode panel 20 comprises a plurality of phosphor layers 22 (phosphor layers 22R, 22G, 22B) formed in a matrix or stripe shape on a second support member 21 made of glass and the like, a black matrix 23 filled between the phosphor layers 22, and an anode electrode 24 formed entirely on the phosphor layers 22 and the black matrix 23. A positive voltage higher than a voltage to be applied to the gate electrode 14 is applied to the anode electrode 24 from an anode-electrode driving circuit 27, and the anode electrode 24 works to guide electrons emitted into the vacuum space from the electron emission electrodes 16A to the phosphor layers 22. Further, the anode electrode 24 protects the phosphor particles constituting the phosphor layers 22 from sputtering with particles such as ions. Further, it also works to reflect light, which is emitted from the phosphor layers 22 by electron excitation, towards the second support member 21 to improve the brightness of a display screen. viewed from outside of the second support member 21. The anode electrode 21 is formed, for example, of an aluminum thin film.

Generally, the cathode electrode 12 and the gate electrode 14 are formed in the form of a stripe each in directions in which projection images of these electrodes 12 and 14 cross each other at right angles, and a plurality of field emission devices are provided in an overlap region of the projection images of the electrodes 12 and 14 (the overlap region corresponds to a region of one pixel in a monochromatic display or one subpixel of three subpixels constituting one pixel in a color display). Further, such overlap regions are arranged in the form of a two-dimensional matrix in an effective field (field that works as an actual display screen) of the cathode panel 10. One pixel is constituted of one group of field emission devices arranged in the overlap region of the cathode electrode 12 and the gate electrode 14 on the cathode panel side and the phosphor layer 22 that faces the group of these field emission devices and is on the anode panel side. In the effective field, such pixels are arranged in the order of hundreds of thousands to several millions.

The cathode panel 10 having a number of such field emission devices formed thereon and the anode panel 20 are combined, whereby a display shown in FIGS. 7 and 8 can be obtained. Specifically, an approximately 1 mm high frame (not shown) made of ceramic or glass is prepared. The frame, the cathode panel 10 and the anode panel 20 are attached and bonded with a frit glass, and the frit glass is dried, followed by calcining at approximately 450° C. for 10 to 30 minutes. Then, the inside of the display is vacuumed to a vacuum degree of approximately $10^{-4}$ Pa, followed by sealing by a proper method. Alternatively, the frame, the cathode panel 10 and the anode panel 20 can be attached and bonded in a high-vacuum atmosphere. Alternatively, when the structure of the display permits, the cathode electrode 10 and the anode panel 20 can be attached and bonded without any frame.

The cathode panel 10 and the anode panel 20 have a gap of approximately 0.1 to 1 mm between them. A high voltage (for example, 5 kV) is applied to the anode electrode 24 of the anode panel 20. In such a display, a discharge sometimes occurs between the gate electrode 14 provided in the cathode panel 10 and the anode electrode 24 provided in the anode panel 20, and in some cases, the quality of the displayed image is greatly impaired and the lifetime of the display is decreased. The mechanism of discharge occurrence in the vacuum space is assumed to be as follows. First, emission of electrons or ions from the electron emission electrode 16A under an intense electric field triggers a discharge, energy is supplied to the anode electrode 24 from the anode-electrode driving circuit 27 to locally increase the temperature of the anode electrode 24, an occlusion gas inside the anode electrode 24 is emitted or a material itself constituting the anode electrode 24 evaporates, and the small-scale discharge grows to a large-scale discharge (for example, spark discharge).

For suppressing a discharge between the anode electrode 24 and the gate electrode 14, it is effective to suppress the emission of electrons or ions that are to trigger the discharge, while it is required to control particles very strictly. Further, importantly, the anode electrode, the gate electrode, the cathode electrode, etc., have no projection that constitutes a start point of a discharge. However, it involves large technical difficulties to carry out the above particle control in the production process of the display or to control the production process of the display so as to make those various electrodes free of the projections.

In a cathode ray tube, when a sharp projection is present in grid electrodes, etc., constituting an electron lens, an abnormal discharge occurs in the operation of the cathode ray tube. For preventing the above abnormal discharge, a knocking treatment is carried out in the production process of the cathode ray tube. In the knocking treatment, a discharge is caused to occur in a portion that is liable to cause a discharge, such as sharp projection portions, etc., of the grid electrodes, etc., to fuse and remove the projection portions, etc. To the best of the present inventor's knowledge, there is no case where a treatment such as the above knocking treatment in the production of a cathode ray tube is applied to the production of a cold cathode field emission display.

For making tips of cathodes a uniform curvature after completion of a cold cathode field emission display, Japanese Patent No. 3094459 discloses the technique of applying a predetermined voltage to the cathodes to cause field evaporation from the tips. However, the above Japanese Patent does not refer to any knocking treatment technique.

It is therefore an object of the present invention to provide a method of effectively removing projections that are to constitute discharge start points from various electrodes constituting a flat-type display device, after completion of the flat-type display device or during the production of the flat-type display device (before assembly of the flat-type display device).

DISCLOSURE OF THE INVENTION

The knocking treatment method in a flat-type display device according to a first aspect of the present invention (sometimes referred to as "knocking treatment method according to a first aspect of the present invention" hereinafter) for achieving the above object relates to a knocking treatment method in a flat-type display device after assembling, and the knocking treatment method in a flat-type display device in which a first substrate provided with a first electrode and a second substrate provided with a second electrode are disposed with a vacuum space interposed between the first and second substrates and the first substrate and the second substrate are bonded to each other in their circumferential portions, comprises stepwise applying a voltage $V_1$ to the first electrode higher than a voltage applied to the second electrode to remove a projection present in the first electrode by field evaporation.

The field evaporation refers to a phenomenon that occurs when atoms in a surface of a projection form positive ions to evaporate when an intense positive voltage is applied to the projection. The field evaporation takes place since atoms in the surface are ionized due to a strong electric field to fly into a vacuum space.

The embodiment of stepwise applying voltage $V_1$ includes an embodiment of applying voltage $V_1$ while increasing the voltage $V_1$ in a staircase pattern and an embodiment of applying voltage $V_1$ while increasing the voltage $V_1$ such that the voltage $V_1$ monotonously increases.

In the knocking treatment method according to the first aspect of the present invention, there can be employed a constitution in which the knocking treatment method according to the first aspect of the present invention is carried out and completed, then, the first substrate and the second substrate are exchanged, and the knocking treatment method according to the first aspect of the present invention is again carried out and completed. Alternatively, there may be employed a constitution in which, after the first voltage-application step of applying the voltage $V_1$ to the first electrode higher than the voltage applied to the second electrode, the second voltage-application step of applying a voltage $V_2$ to the second electrode higher than the voltage applied to the first electrode is carried out to field-evaporate the projections present in the second electrode, and then, a voltage higher than the voltage $V_1$ is set as a new voltage $V_1$, a voltage higher than the voltage $V_2$ is set as a new voltage $V_2$ and the first voltage-application step and the second voltage-application step are repeated. In the latter case, the value of the voltage $V_1$ and the value of the voltage $V_2$ may be different. Preferably, however, the value of the voltage $V_1$ and the value of the voltage $V_2$ are equal to each other for simplification of the knocking treatment method. During the first voltage-application step and the second voltage-application step, the voltage $V_1$ and the voltage $V_2$ may be constant or may be increased stepwise.

The phrase of "applying the voltage $V_1$ to the first electrode higher than the voltage applied to the second electrode" means applying a voltage to the first electrode so as to cause the first electrode to have a potential difference $V_1$ from the voltage on the second electrode, or means applying a voltage to the second electrode so as to cause the second electrode to have a potential difference $-V_1$ from the voltage on the first electrode. The phrase of "applying the voltage $V_2$ to the second electrode higher than the voltage applied to the first electrode" means applying a voltage to the second electrode so as to cause the second electrode to have a potential difference $V_2$ from the voltage on the first electrode, or applying a voltage to the first electrode so as to cause the first electrode to have a potential difference $-V_2$ from the voltage on the second electrode.

In the knocking treatment method according to the first aspect of the present invention, the values of the initial voltage $V_1$ and voltage $V_2$, the voltage increase amount, and the voltage-application time period and the voltage increase rate per unit time in each step can be determined on the basis of preliminary experiments. When the voltage $V_1$ higher than the voltage applied to the second electrode is applied to the first electrode, preferably, the value of the voltage to be applied to the first electrode is set at $V_1$ (>0 volt), and the value of the voltage to be applied to the second electrode is set at 0 volt, while these values shall not be limited thereto. When the voltage $V_2$ higher than the voltage applied to the first electrode is applied to the second electrode, preferably, the value of the voltage to be applied to the first electrode is set at 0 volt, and the value of the voltage to be applied to the second electrode is set at $V_2$ ($=V_1>0$ volt), while these values shall not be limited thereto.

In a knocking treatment method in a flat-type display device according to a second aspect of the present invention for achieving the above object (to be sometimes referred to as "knocking treatment method according to a second aspect of the present invention" hereinafter), a voltage higher than a voltage applied to a second electrode is pulsewise applied to a first electrode unlike the knocking treatment method according to the first aspect of the present invention.

That is, the knocking treatment method according to the second aspect of the present invention relates to a knocking treatment method in a flat-type display device after assembling, and the knocking treatment method in a flat-type display device in which a first substrate provided with a first electrode and a second substrate provided with a second electrode are disposed with a vacuum space interposed between the first and second substrates and the first substrate and the second substrate are bonded to each other in their circumferential portions, comprises pulsewise applying a voltage $V_1$ to the first electrode higher than a voltage applied to the second electrode to remove a projection present in the first electrode by field evaporation.

In the knocking treatment method according to the second aspect of the present invention, there can be employed a constitution in which, after the pulse-voltage-applying step of pulsewise applying the voltage $V_1$ to the first electrode higher than the voltage applied to the second electrode, the first electrode and the second electrode are set at 0 volt, and after elapse of a predetermined time period, the voltage $V_1$ higher than the voltage applied to the second electrode is again pulsewise applied to the first electrode. In this case, every pulse or every two or more pulses, the voltage $V_1$ can be increased. Alternatively, after the pulse-voltage-applying step of pulsewise applying the voltage $V_1$ to the first electrode higher than the voltage applied to the second electrode, it is preferred to carry out a current-detection step of applying a voltage $V_2$ to the second electrode higher than the voltage applied to the first electrode and detecting a current flowing between the first electrode and the second electrode. That is because the knocking treatment method can be carried out while evaluating whether or not the projections present in the first electrode have been field-evaporated. That is, a high electric field is exerted on the projections present in the first electrode by applying the voltage $V_2$ to the second electrode higher than the voltage applied to the first electrode, electrons can be emitted from the projections on the basis of a quantum tunnel effect, and such electrons can be detected as a current flowing between the first electrode and the second electrode. After the projections are field-evaporated, the above current is no longer detected. After the current-detection step, the pulse-voltage-applying step is again carried out.

In this case, when the current flowing between the first electrode and the second electrode reaches a predetermined value or lower, preferably, a voltage higher than the voltage $V_1$ is set as a new voltage $V_1$, a voltage higher than the voltage $V_2$ is set as a new voltage $V_2$, and the pulse-voltage-applying step and the current-detection step are repeated. In this case, the number of the pulse of the voltage $V_1$ in one pulse-voltage-applying step can be one pulse or a plurality of pulses. By the above procedure, the projections present in the first electrode can be reliably field-evaporated, and electrons emitted from the projections on the basis of a quantum tunnel effect can be reliably detected as a current flowing between the first electrode and the second electrode. Further, when the voltage $V_2$ comes to be equal to an actual operation voltage $V_{OP}$ of the flat-type display device, preferably, there may be employed a constitution in which a voltage higher than the voltage $V_1$ is set as a new voltage $V_1$, the voltage $V_2$ is set at a value equal to the actual operation voltage $V_{OP}$, and the pulse-voltage-applying step and the current-detection step are repeated until the current flowing between the first electrode and the second electrode comes to be a predetermined value or smaller. By the above procedure, the projections present in the first electrode can be more reliably field-evaporated, and the knocking treatment can be automatically terminated. The predetermined value of the current flowing between the first electrode and the second electrode can be determined on the basis of preliminary experiments, and for example, 0 ampere can be employed. Further, in the pulse-voltage-applying step, preferably, the value of the voltage to be applied to the first electrode is set at $V_1$ (>0 volt) and the value to the voltage to be applied to the second electrode is set at 0 volt, and in the current-detection step, preferably, the value of the voltage to be applied to the second electrode is set at 0 volt, and the voltage to be applied to the first electrode is set at $-V_2$ volt (<0), while the above values shall not be limited thereto.

In the knocking treatment method according to the second aspect of the present invention, there may be employed a constitution in which the knocking treatment method according to the second aspect of the present invention is first carried out and completed, then, the first substrate and the second substrate are exchanged, and the knocking treatment method according to the second aspect of the present invention is carried out again and completed. Alternatively, there may be employed a constitution in which the first substrate and the second substrate are exchanged alternately, and the knocking treatment method according to the second aspect of the present invention is carried out. That is, there may be employed a constitution in which the voltage $V_1$ higher than the voltage applied to the second electrode is pulsewise applied to the first electrode by one pulse or a plurality of pulses, then, the first substrate and the second substrate are exchanged, and these procedures are repeated.

In the knocking treatment method according to the second aspect of the present invention, the values of the voltage $V_1$ (pulse height) and the voltage $V_2$, the pulse width and the number of the pulse(s), the pulse interval, and the voltage increase amount can be determined on the basis of preliminary experiments. The relationship between the voltage $V_1$ and the voltage $V_2$ is expressed, for example, by $0.01V_1 \leqq V_2 \leqq 0.5V_1$.

In the knocking treatment method according to the first or second aspect of the present invention (to be sometimes generally referred to as "knocking treatment method of the present invention" hereinafter), the flat-type display device can be a cold cathode field emission display, and the cold cathode field emission display can have a constitution (1), (2), (3) or (4).

(1) A constitution in which the cathode electrode and the gate electrode provided in the cathode panel of the cold cathode field emission display correspond to the first electrode provided in the first substrate, and the anode electrode provided in the anode panel of the cold cathode field emission display corresponds to the second electrode provided in the second substrate.

(2) A constitution in which the cathode electrode, the gate electrode and the focus electrode provided in the cathode panel of the cold cathode field emission display correspond to the first electrode provided in the first substrate, and the anode electrode provided in the anode panel of the cold cathode field emission display corresponds to the second electrode provided in the second substrate.

(3) A constitution in which the anode electrode provided in the anode panel of the cold cathode field emission display corresponds to the first electrode provided in the first substrate, and the cathode electrode and the gate electrode provided in the cathode panel of the cold cathode field emission display correspond to the second electrode provided in the second substrate.

(4) A constitution in which the anode electrode provided in the anode panel of the cold cathode field emission display corresponds to the first electrode provided in the first substrate, and the cathode electrode, the gate electrode and the focus electrode provided in the cathode panel of the cold cathode field emission display correspond to the second electrode provided in the second substrate.

In the constitution (1), the projections mainly in the gate electrode are removed by field evaporation. In the constitution (2), the projections mainly in the focus electrode are removed by field evaporation. In the constitutions (3) and (4), the projections mainly in the anode electrode are removed by field evaporation.

In some constitutions of the cold cathode field emission display, the focus electrode is interposed between the first substrate and the second substrate. Such constitutions are included in the above constitution (2) or (4).

In the knocking treatment method of the present invention, when the flat-type display device is a cold cathode field emission display, it is required to short-circuit the cathode electrode and the gate electrode or short-circuit the cathode electrode, the gate electrode and the focus electrode to cause these electrodes to have the same potential for preventing the cold cathode field emission display from exhibiting its function, that is, for preventing the emission of electrons from the cold cathode field emission device. Further, the actual operation voltage $V_{OP}$ explained before is a value corresponding to the voltage to be applied to the anode electrode during the display operation of the cold cathode field emission display.

In the following explanation, for convenience, carrying out the knocking treatment method according to the first or second aspect of the present invention in a constitution in which the cathode panel is the first substrate and the anode panel is the second substrate (that is, the constitution (1) or (2)) will be referred to as "knocking treatment-A", and carrying out the knocking treatment method according to the first or second aspect of the present invention in a constitution in which the anode panel is the first substrate and the cathode panel is the second substrate (that is, the constitution (3) or (4)) will be referred to as "knocking treatment-B".

In the knocking treatment method of the present invention, when the flat-type display device is a cold cathode field emission display, as described already, for example, the knocking treatment-B may be carried out after completion of the knocking treatment-A, the knocking treatment-A may be carried out after completion of the knocking treatment-B, or the knocking treatment-A and the knocking treatment-B may be alternately carried out. Concerning which of the knocking treatment-A and the knocking treatment-B is first carried out, a preliminary experiment is carried out, the substrate that is assumed to have more projections is taken as the first substrate, and the knocking treatment method according to the first or second aspect of the present invention may be carried out. Specifically, the step of applying a voltage $V_{TEST}$ to the second electrode higher than the voltage applied to the first electrode to detect a current flowing between the first electrode and the second electrode is consecutively carried out in the constitution (1) or (2) and the constitution (3) or (4). When the value of the flowing current is higher in the constitution (1) or (2) than in the constitution (3) or (4), the knocking treatment-A can be carried out first. When the value of the flowing current is higher in the constitution (3) or (4) than in the constitution (1) or (2), the knocking treatment-B can be carried out first.

The knocking treatment method in a substrate for a flat-type display device according to a first aspect of the present invention (sometimes referred to as "substrate knocking treatment method according to a first aspect of the present invention") for achieving the above object relates to a knocking treatment method in a flat-type display device on a manufacturing process (flat-type display device before assembling), and the method comprises disposing the substrate for a flat-type display device having an electrode and a substrate for knocking having an electrode for knocking with a vacuum space interposed between the substrates, and then, stepwise applying a voltage $V_1$ to the electrode higher than a voltage applied to the electrode for knocking to remove a projection present in the electrode by field evaporation.

The embodiment of stepwise applying the voltage $V_1$ includes an embodiment of applying the voltage $V_1$ while increasing the voltage $V_1$ in a staircase pattern and an embodiment of applying the voltage $V_1$ while increasing the voltage $V_1$ such that the voltage $V_1$ monotonously increases.

In the explanation hereinafter, the electrode provided in the substrate for a flat-type display device will be sometimes referred to as "substrate-electrode" for convenience.

In the substrate knocking treatment method according to the first aspect of the present invention, the value of the initial voltage $V_1$, the voltage increase amount, and the voltage-application time period and the voltage increase rate per unit time in each step can be determined on the basis of preliminary experiments. When the voltage $V_1$ higher than the voltage applied to the electrode for knocking is applied to the substrate-electrode, preferably, the value of the voltage to be applied to the substrate-electrode is set at $V_1$ (>0 volt), and the value of the voltage to be applied to the electrode for knocking is set at 0 volt, while these values shall not be limited thereto.

The knocking treatment method in a substrate for a flat-type display device according to a second aspect of the present invention (sometimes referred to as "substrate knocking treatment method according to a second aspect of the present invention") for achieving the above object relates to a knocking treatment method in a flat-type display device on a manufacturing process (flat-type display device before assembling), and the method comprises disposing the substrate for a flat-type display device having an electrode and a substrate for knocking having an electrode for knocking with a vacuum space interposed between the substrates, and then, pulsewise applying a voltage $V_1$ to the electrode higher than a voltage applied to the electrode for knocking to remove a projection present in the electrode by field evaporation.

In the substrate knocking treatment method according to the second aspect of the present invention, there may be employed a constitution in which after application of the pulse voltage $V_1$ to the substrate-electrode higher than the voltage applied to the electrode for knocking, the substrate-electrode and the electrode for knocking are set at 0 volt, and after elapse of a predetermined time period, the voltage $V_1$ higher than the voltage applied to the electrode for knocking is again pulsewise applied to the substrate-electrode. In this case, the voltage $V_1$ can be increased every pulse or every two or more pulses. Alternatively, after the pulse-voltage-applying step of pulsewise applying the voltage $V_1$ to the substrate-electrode higher than the voltage applied to the electrode for knocking, it is preferred to carry out the current-detection step of applying the voltage $V_2$ to the electrode for knocking higher than the voltage applied to the substrate-electrode, and detecting a current flowing between the substrate-electrode and the electrode for knocking. That is because the knocking treatment method can be carried out while evaluating whether or not the projections present in the substrate-electrode have been field-evaporated. That is, a high electric field is exerted on the projections present in the substrate-electrode by applying the voltage $V_2$ to the electrode for knocking higher than the voltage applied to the substrate-electrode, electrons can be emitted from the projections on the basis of a quantum tunnel effect, and such electrons can be detected as a current flowing between the substrate-electrode and the electrode for knocking. When the projections have been field-evaporated, such a current is no longer detected.

The phrase of "applying the voltage $V_1$ to the substrate-electrode higher than the voltage applied to the electrode for knocking" means applying a voltage to the substrate-electrode so as to cause the substrate-electrode to have a potential difference $V_1$ from the voltage on the electrode for knocking, or means applying a voltage to the electrode for knocking so as to cause the electrode for knocking to have a potential difference $-V_1$ from the voltage on the substrate-electrode. The phrase of "applying the voltage $V_2$ to the electrode for knocking higher than the voltage applied to the substrate-electrode" means applying a voltage to the electrode for knocking so as to cause the electrode for knocking to have a potential difference $V_2$ from the voltage on the substrate-electrode, or applying a voltage to the substrate-electrode so as to cause the substrate-electrode to have a potential difference $-V_2$ from the voltage on the electrode for knocking.

In this case, when the current flowing between the substrate-electrode and the electrode for knocking comes to be a predetermined value or smaller, preferably, a voltage higher than the voltage $V_1$ is set as a new voltage $V_1$, a voltage higher than the voltage $V_2$ is set as a new voltage $V_2$, and the pulse-voltage-applying step and the current-detection step are repeated. In this case, the number of pulse(s) of the voltage $V_1$ in a pulse-voltage-applying step may be one pulse or a plurality of pulses. By the above procedures, the projections present in the substrate-electrode can be reliably field-evaporated, and electrons emitted from the projections on the basis of a quantum tunnel effect can be reliably detected as a current flowing between the substrate-electrode and the electrode for knocking. Further, when the voltage $V_2$ comes to be equal to the actual operation voltage $V_{OP}$ of the flat-type display device, preferably, there may be employed a constitution in which a voltage higher than the voltage $V_1$ is set at a new voltage $V_1$, the voltage $V_2$ is set at a value equal to the actual operation voltage $V_{OP}$, and the pulse-voltage-applying step and the current-detection step are repeated until the current flowing between the substrate-electrode and the electrode for knocking comes to be a predetermined value or smaller. By the above procedure, the projections present in the substrate-electrode can be more reliably field-evaporated, and the knocking treatment can be automatically terminated. The predetermined value of the current flowing between the substrate-electrode and the electrode for knocking can be determined on the basis of preliminary experiments, and for example, 0 ampere can be employed. In the pulse-voltage-applying step, preferably, the value of the voltage to be applied to the substrate-electrode is set at $V_1$ volt (>0 volt), and the value of the voltage to be applied to the electrode for knocking is set at 0 volt, and in the current-detection step, preferably, the value of the voltage to be applied to the electrode for knocking is set at 0 volt, and the value of the voltage to be applied to the substrate-electrode is set at $-V_2$ volt (<0), while these voltage values shall not be limited to these.

In the substrate knocking treatment method according to the second aspect of the present invention, the values of the voltage $V_1$ (pulse height) and the voltage $V_2$, the pulse width and the number of pulse(s), the pulse interval and the voltage increase amount can be determined on the basis of preliminary experiments. The relationship between the voltage $V_1$ and the voltage $V_2$ is expressed, for example, by $0.01V_1 \leqq V_2 \leqq 0.5V_1$.

In the substrate knocking treatment method according to the first or second aspect of the present invention (to be sometimes generally referred to as "substrate knocking treatment method of the present invention" hereinafter), for disposing the substrate for a flat-type display device and the substrate for knocking with a vacuum space interposed between them, specifically, the substrate for a flat-type display device and the substrate for knocking can be arranged in a vacuum chamber.

In the substrate knocking treatment method of the present invention, the substrate for a flat-type display device and the substrate for knocking may have the same or similar size, or the substrate for knocking may have a smaller size than the substrate for a flat-type display device. In the latter case, the substrate for knocking is scanned above the substrate for a flat-type display device, whereby the substrate knocking treatment method of the present invention can be carried out.

In the substrate knocking treatment method of the present invention, the flat-type display device can be a cold cathode field emission display, and the cold cathode field emission display can have a constitution (5), (6) or (7).

(5) A constitution in which the cathode electrode and the gate electrode provided in the cathode panel of the cold cathode field emission display correspond to the electrode provided in the substrate for a flat-type display device.

(6) A constitution in which the cathode electrode, the gate electrode and the focus electrode provided in the cathode panel of the cold cathode field emission display correspond to the electrode provided in the substrate for a flat-type display device.

(7) A constitution in which the anode electrode provided in the anode panel of the cold cathode field emission display corresponds to the electrode provided in the substrate for a flat-type display device.

In the constitution (5), the projections mainly in the gate electrode are removed by field evaporation. In the constitution (6), the projections mainly in the focus electrode are removed by field evaporation. In the constitution (7), the projections in the anode electrode are removed by field evaporation.

In the substrate knocking treatment method of the present invention, when the flat-type display device is a cold cathode field emission display, it is required to short-circuit the cathode electrode and the gate electrode or short-circuit the cathode electrode, the gate electrode and the focus electrode to cause these electrodes to have the same potential for preventing the cold cathode field emission display from exhibiting its function, that is, for preventing the emission of electrons from the cold cathode field emission device. Further, the actual operation voltage $V_{OP}$ explained before is a value corresponding to the voltage to be applied to the anode electrode during the display operation of the cold cathode field emission display.

In the present invention, the projections present in the electrodes can be reliably removed by field evaporation.

BRIEF DESCRIPTION OF DRAWINGS

The present invention will be explained hereinafter on the basis of Examples with reference to drawings.

FIG. 9B, are schematic partial end views of the first support member, etc., for explaining the method for producing the field-emission device having a first structure constituted of a Spindt-type field emission device.

FIG. 12B, are schematic partial end views of the first support member, etc., for explaining the method for producing the field emission device having a first structure constituted of a crown-type field emission device.

FIG. 17B, are schematic partial end views of the first support member, etc., for explaining the method for producing another variant of the field emission device having a first structure constituted of a plane-type field emission device.

FIGS. 22A and 22B, are a schematic partial end view and a partial perspective view of the first support member, etc., for explaining the method for producing still another variant of the field emission device having a second structure constituted of a flat-type field emission device.

FIGS. 23A and 23B, are a schematic partial end view and a partial perspective view of the first support member, etc., for explaining the method for producing still another variant of the field emission device having a second structure constituted of a flat-type field emission device.

FIGS. 24A and 24B, are schematic partial end views of the first support member, etc., for explaining the method for producing still another variant of the field emission device having a second structure constituted of a flat-type field emission device.

FIG. 28B, are schematic partial end views of the first support member, etc., for explaining the method for producing still another variant of the field emission device having a second structure constituted of a flat-type field emission device.

FIGS. 33A and 333, following FIG. 32B, are schematic partial end views of the first support member, etc., for explaining [Spindt-type field emission device: Variant-1 of production method] for producing the Spindt-type field emission device shown in FIG. 35.

FIG. 38B, are schematic partial end views of the first support member, etc., for explaining [Spindt-type field emission device: Variant-2 of production method].

FIG. 39B, are schematic partial end views of the first support member, etc., for explaining [Spindt-type field emission device: Variant-2 of production method].

FIG. 42B, is a schematic partial end view of the first support member, etc., for explaining [Spindt-type field emission device: Variant-3 of production method].

FIG. 45B, are schematic partial end views of the first support member, etc., for explaining [Spindt-type field emission device: Variant-4 of production method].

FIG. 46B, are schematic partial end views of the first support member, etc., for explaining [Spindt-type field emission device: Variant-4 of production method].

FIG. 48B, are schematic partial end views of the first support member, etc., for explaining [Spindt-type field emission device: Variant-5 of production method].

BEST MODE FOR CARRYING OUT THE INVENTION

EXAMPLE 1

Example 1 is concerned with the knocking treatment method in the flat-type display device according to the first aspect of the present invention. That is, the knocking treatment method in Example 1 is concerned with the knocking treatment method after completion of the flat-type display device, and it is a knocking treatment method in a flat-type display device in which a first substrate having a first electrode and a second substrate having a second electrode are disposed with a vacuum space interposed between them, and the first substrate and the second substrate are bonded in their circumferential portions. And, a voltage $V_1$ higher than a voltage applied to the second electrode is stepwise applied to the first electrode to remove a projection present in the first electrode by field evaporation. In Example 1, the voltage $V_1$ is applied while increasing it stepwise.

The flat-type display device in Example 1 is a cold cathode field emission display (to be simply referred to as "display" hereinafter), and it is structured so as to have a number of Spindt-type cold cathode field emission devices (to be sometimes abbreviated as "field emission device" hereinafter) shown in FIGS. 7 and 8, so that a detailed explanation thereof is omitted. The method for producing the Spindt-type field emission device or field emission devices of other types will be described later.

In Example 1, the anode panel is the first substrate, the cathode panel is the second substrate (that is, the above constitution (3) is employed), and the knocking treatment-B is completed. Then, the cathode panel is the first substrate, the anode panel is the second substrate (that is, the above constitution (1) is employed), and the knocking treatment-A is carried out. For preventing the display from exhibiting its functions, that is, for preventing the emission of electrons from the field emission devices, the cathode electrode and the gate electrode are short-circuited so as to have potentials at the same level.

Figure 1A:
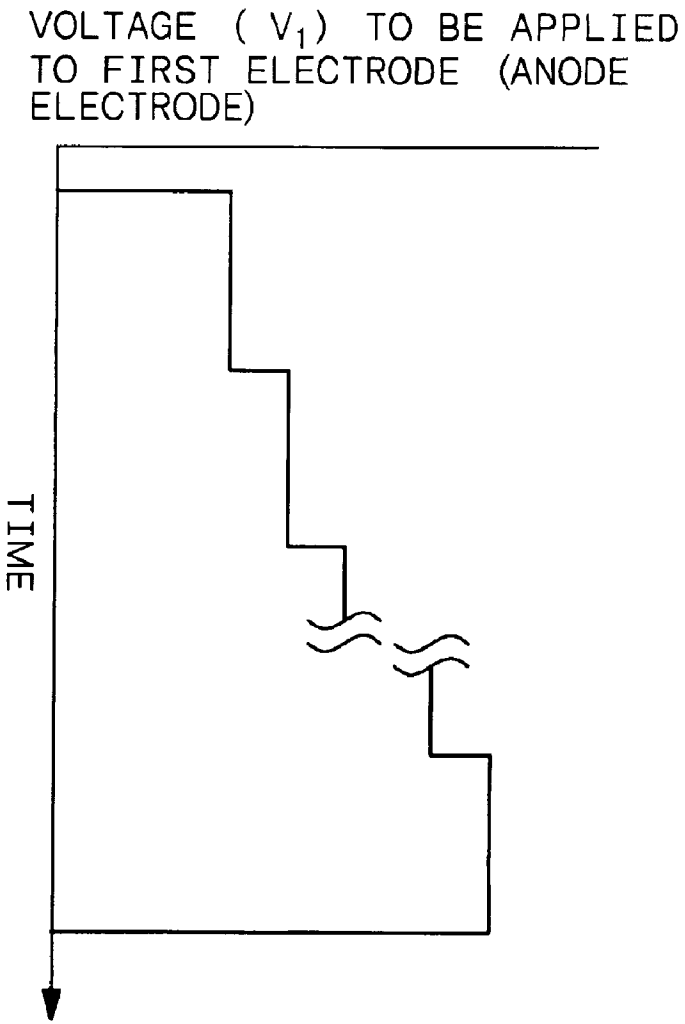
FIGS. 1A and 1B are schematic drawings for showing a change in a voltage $V_1$ in Example 1.
Figure 1B:
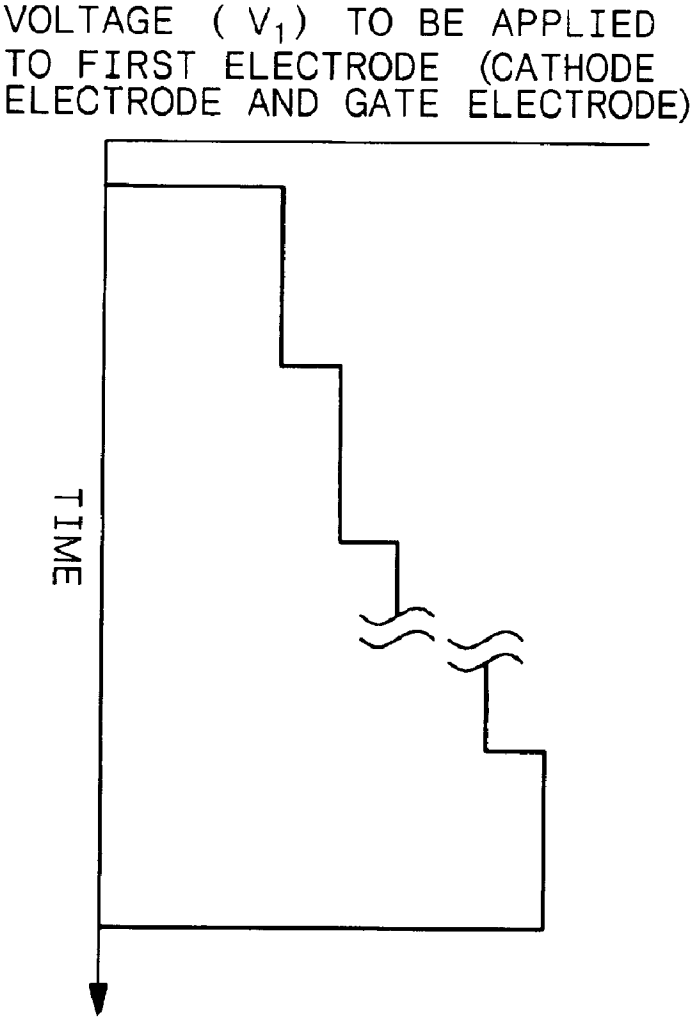

FIGS. 1A and 1B show a change in the voltage $V_1$ when the voltage $V_1$ higher than the voltage applied to the second electrode is applied to the first electrode while increasing the voltage $V_1$ stepwise for field-evaporating the projections present in the first electrode. FIG. 1A shows a change in the voltage $V_1$ (voltage applied to the anode electrode) in the knocking treatment-B, and FIG. 1B shows a change in the voltage $V_1$ (voltage applied to the cathode electrode and the gate electrode which are short-circuited) in the knocking treatment-A.

In the knocking treatment-A and the knocking treatment-B in Example 1, the value of the voltage to be applied to the first electrode was set at $V_1$ volt (>0 volt), and the value of the voltage to be applied to the second electrode was set at 0 volt. The value of the voltage $V_1$ at an initial step was set at 1 kV, the voltage increase amount was set at 0.01 kV, the voltage-application time period at each step was set at 1 second, and the value of the voltage $V_1$ applied at a final step was set at 30 kV.

As described above, the knocking treatment-A and the knocking treatment-B were carried out for the display, an actual operation voltage $V_{OP}$ was applied to the cathode electrode and the gate electrode that were short-circuited, the anode electrode was set at 0 volt, and a measurement was made for a current flowing between them, to show that no current flowed. Further, the actual operation voltage $V_{OP}$ was applied to the anode electrode, the cathode electrode and the gate electrode that were short-circuited were set at 0 volt, and a measurement was made for a current flowing between them, to show that no current flowed. That is, it was found that the projections present in the first electrode were removed by field evaporation. The actual operation voltage $V_{OP}$ refers to a voltage applied to the anode electrode in the display operation of the display, and will be used in this sense hereinafter. Further, the knocking treatment-B was carried out after completion of the knocking treatment-A, to give a similar result. Further, in the above constitutions (2) and (4), the knocking treatment-B was carried out after completion of the knocking treatment-A, to give a similar result.

EXAMPLE 2

Example 2 is a variant of Example 1. In Example 2, after the first voltage-applying step of applying the voltage $V_1$ to the first electrode (the anode electrode in Example 2) higher than the voltage applied to the second electrode (the cathode electrode and the gate electrode which are short-circuited in Example 2), there is carried out the second voltage-applying step of applying the voltage $V_2$ to the second electrode higher than the voltage applied to the first electrode to field-evaporate a projection present in the second electrode. Then, a voltage higher than the voltage $V_1$ is set as a new voltage $V_1$, a voltage higher than the voltage $V_2$ is set as a new voltage $V_2$, and the first voltage-applying step and the second voltage-applying step are repeated.

Figure 2:
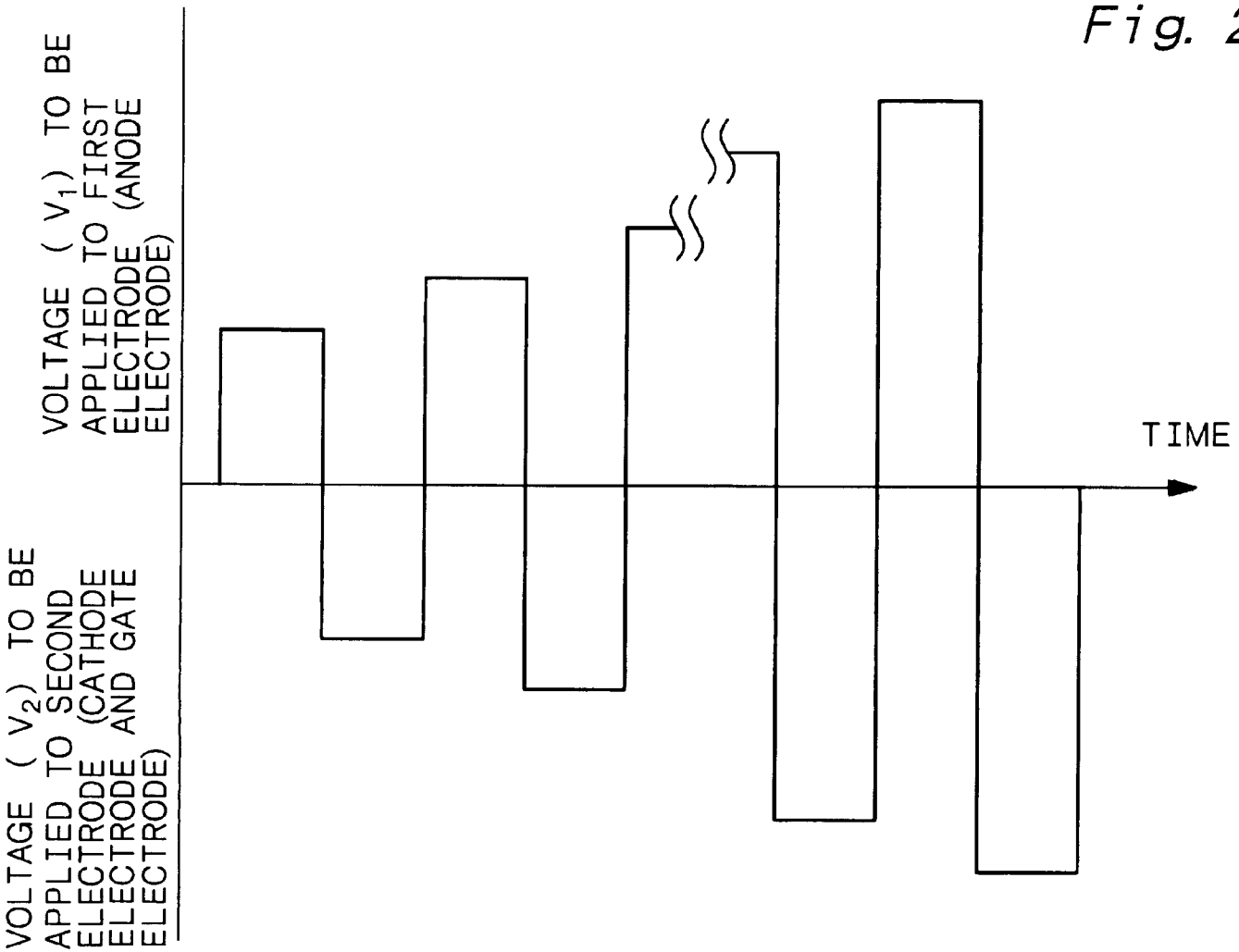
FIG. 2 is a schematic drawing for showing changes in voltages $V_1$ and $V_2$ in Example 2.

In the above first voltage-applying step, the value of the voltage to be applied to the first electrode was set at $V_1$ volt (>0 volt), the value of the voltage to be applied to the second electrode was set at 0 volt, the value of the voltage $V_1$ at an initial step was set at 1 kV, the voltage increase amount was set at 0.01 kV, the voltage-application time period at each step was set at 1 second, and the value of the voltage $V_1$ at a final step was set at 30 kV. In the above second voltage-applying step, the value of voltage to be applied to the second electrode was set at $V_2$ (>0 volt), the value of the voltage to be applied to the first electrode was set at 0 volt, the value of the voltage $V_2$ at an initial step was set at 0.1 kV, the voltage increase amount was set at 0.01 kV, the voltage-application time period at each step was set at 1 second, and the value of the voltage $V_2$ to be applied at a final step was set at 10 kV. FIG. 2 schematically shows changes in the voltages $V_1$ and $V_2$.

After the knocking treatment was carried out for the display as described, the actual operation voltage $V_{OP}$ was applied to the cathode electrode and the gate electrode which were short-circuited, the anode electrode was set at 0 volt, and a measurement was made for a current flowing between them, to show that no current flowed. Further, the actual operation voltage $V_{OP}$ was applied to the anode electrode, the cathode electrode and the gate electrode which were short-circuited were set at 0 volt, and a measurement was made for a current flowing between them, to show that no current flowed. That is, it was found that the projections present in the first electrode and the second electrode (particularly, the gate electrode) were removed by field evaporation. In the above constitutions (2) and (4), the above knocking treatment was similarly carried out, to give similar results.

EXAMPLE 3

Example 3 is concerned with the substrate knocking treatment method in the substrate for a flat-type display device according to the first aspect of the present invention. That is, the substrate knocking treatment method in Example 3 is concerned with the knocking treatment method during the production (assembly) of a flat-type display device. A substrate for a flat-type display device provided with a substrate-electrode and a substrate for knocking provided with an electrode for knocking are disposed with a vacuum space interposed between them, and a voltage $V_1$ higher than a voltage applied to the electrode for knocking is stepwise applied to the substrate-electrode to remove a projection present in the substrate-electrode by field evaporation.

The flat-type display device in Example 3 is a cold cathode field emission display (display), and the anode electrode provided in the anode panel corresponds to the substrate-electrode provided in the substrate:. That is, the flat-type display has the above constitution (7). The display has a structure having a plurality of Spindt-type field emission devices shown in FIGS. 7 and 8.

Figure 3:
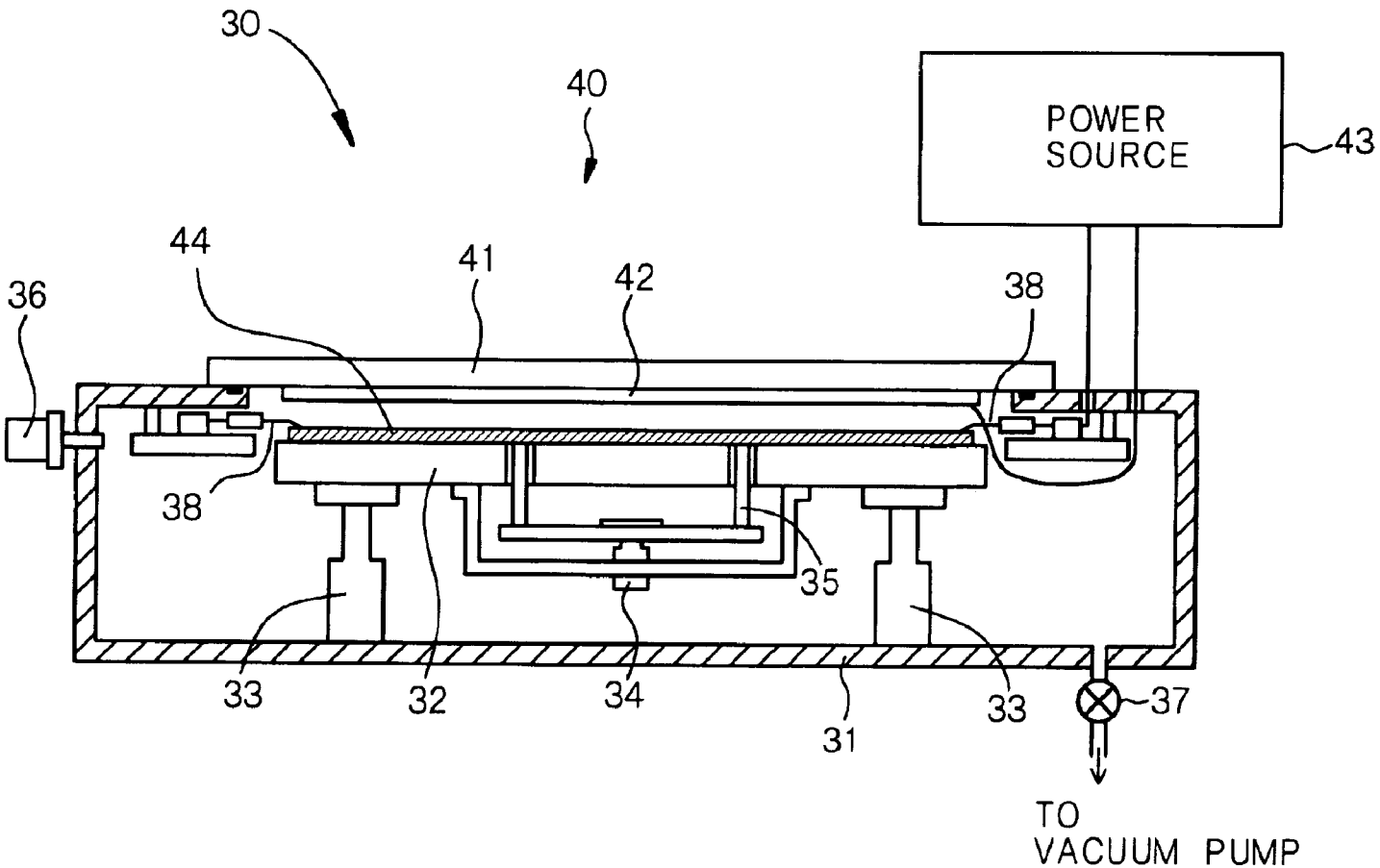
FIG. 3 is a schematic drawing of a knocking treatment apparatus suitable for carrying out the substrate knocking treatment method in Example 3.

FIG. 3 shows a schematic drawing of a knocking treatment apparatus 30 suitable for carrying out the substrate knocking treatment method in Example 3. The knocking treatment apparatus 30 has a housing 31 having an open upper portion. Provided in the housing 31 is a testing table 32, and a testing table elevating cylinder 33 is provided below the testing table 32. The testing table elevating cylinder 33 is placed on a movable bed (not shown), and the movable bed with the testing table 32 placed thereon is movable in the direction perpendicular to the paper surface of FIG. 3. Further provided below the testing table 32 is a pin elevating cylinder 34, and a pin 35 is moved upwardly and downwardly through a hole made through the testing table 32 by the operation of the pin elevating cylinder 34. The housing 31 is connected to a vacuum pump (not shown) through a valve 37, and an atmosphere in the housing 31 can be vacuumed to a high degree. Further provided in the housing 31 is a voltage-applying pin 38 capable of structurally coming into contact with an end portion of the anode electrode. When the substrate knocking treatment method is carried out for the cathode panel, such voltage-applying pins 38 capable of structurally coming into contact with end portions of the cathode electrodes and the gate electrodes are provided such that the number thereof is the same as the number of these electrodes.

Disposed in the open upper portion of the housing 31 is a substrate for knocking 40 having an electrode for knocking 42 formed on a glass substrate 41. Further, a power source 43 is connected to the voltage-applying pin 38 and the electrode for knocking 42.

When a substrate 44 is subjected to the substrate knocking treatment, the substrate 44 placed on the testing table 32 is brought into the housing 31 through a door (not shown) of the housing 31, and then the inside of the housing 31 is vacuumed with a vacuum pump to generate a high vacuum atmosphere. The housing 31 is measured for an internal pressure with a pressure gauge 36.

When the housing 31 internally has a desired atmosphere, the testing table elevating cylinder 33 is operated to elevate the testing table 32 until the substrate 44 and the substrate for knocking 40 have a distance, for example, of 1 mm. The voltage-applying pin 38 is brought into contact with an end portion of the anode electrode. Then, the voltage $V_1$ is applied from the power source 43 to the anode electrode through the voltage-applying pin 38, and 0 volt is applied to the electrode for knocking. After the substrate knocking treatment, the atmosphere in the housing 31 is changed to atmospheric atmosphere, the testing table elevating cylinder 33 is operated to lower the testing table 32, and the testing table 32 with the substrate 44 placed thereon is taken out of the housing 31.

Figure 4:
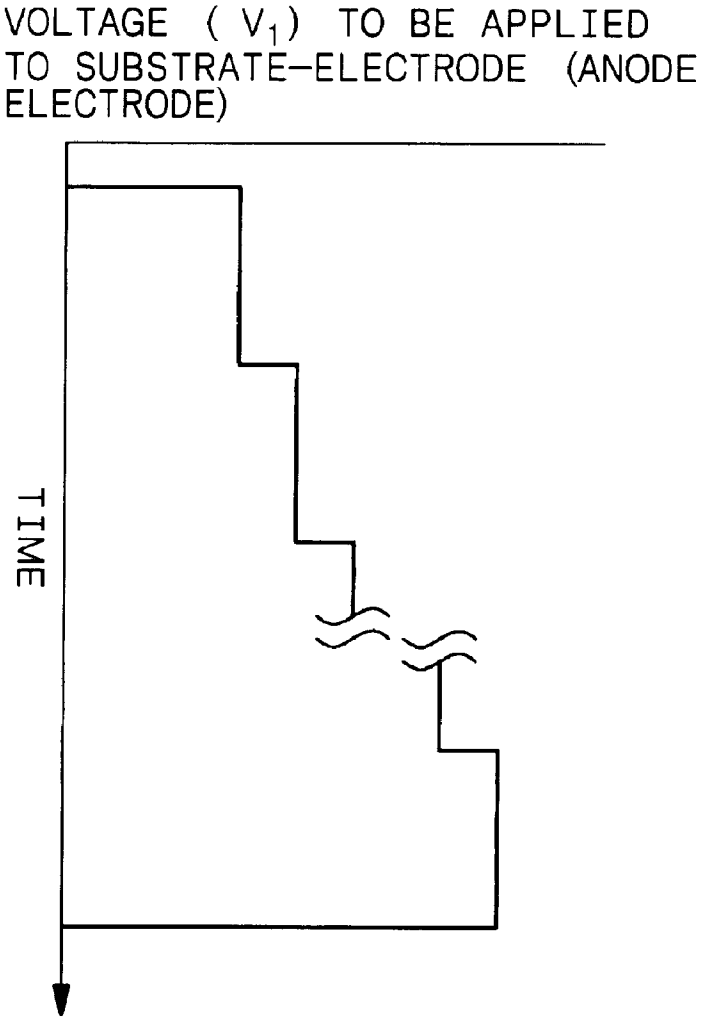
FIG. 4 is a schematic drawing for showing a change in a voltage $V_1$ in Example 3.

FIG. 4 schematically shows a change in the voltage $V_1$ when the voltage $V_1$ higher than the voltage applied to the electrode for knocking is applied to the substrate-electrode while increasing it stepwise to field-evaporate the projections present in the substrate-electrode (anode electrode). In the substrate knocking treatment method in Example 3, the value of the voltage to be applied to the substrate-electrode (anode electrode) was set at $V_1$ volt (>0 volt), the value of the voltage to be applied to the electrode for knocking was set at 0 volt, the value of the voltage $V_1$ at an initial step was set at 1 kV, the voltage increase amount was set at 0.01 kV, the voltage-application time period at each step was set at 1 second, and the value of the voltage $V_1$ at a final step was set at 30 kV.

The substrate knocking treatment method was carried out for the anode panel as described above. Then, the actual operation voltage $V_{OP}$ was applied to the electrode for knocking, the anode electrode was set at 0 volt, and a measurement was made for a current flowing between them, to show that no current flowed. That is, it was found that the projections present in the substrate-electrode (anode electrode) were removed by field evaporation. When the above substrate knocking treatment method was carried out for the above constitutions (5) and (6), similar results were obtained.

In the knocking treatment apparatus shown in FIG. 3, the electrode for knocking 42 has nearly the same size as that of the anode panel or the cathode panel. However, the size of the substrate for knocking may be smaller than the size of the anode panel or the cathode panel. In this case, it is sufficient to employ a structure in which the substrate for knocking can scan above the anode panel or the cathode panel. That is, it is sufficient to employ a structure in which the substrate for knocking can move, for example, along a guide.

EXAMPLE 4

Example 4 is concerned with the knocking treatment method in the flat-type display device according to the second aspect of the present invention. That is, the knocking treatment method in Example 4 is concerned with the knocking treatment method after completion of the flat-type display device, and it is a knocking treatment method in a flat-type display device in which a first substrate provided with a first electrode and a second substrate provided with a second electrode are disposed with a vacuum space interposed between them, and the first substrate and the second substrate are bonded in their circumferential portions. And, a voltage $V_1$ higher than a voltage applied to the second electrode is pulsewise applied to the first electrode to remove a projection present in the first electrode by field evaporation.

In the knocking treatment method in Example 4, after the pulse-voltage-applying step of applying the pulse voltage $V_1$ to the first electrode higher than the voltage applied to the second electrode, the first electrode and the second electrode are set at 0 volt, and after elapse of a predetermined time period, the voltage $V_1$ higher than the voltage applied to the second electrode is again pulsewise applied to the first electrode. The voltage $V_1$ is increased every two or more pulses (specifically, every five pulses). In the knocking treatment method according to the first aspect of the present invention explained in Examples 1 and 2, a discharge may sometimes take place between the first electrode and the second electrode during the knocking treatment. In such a case, it is preferred to employ the knocking treatment method according to the second aspect of the present invention since a discharge does not easily take place due to pulsewise application of the voltage $V_1$.

Figure 7:
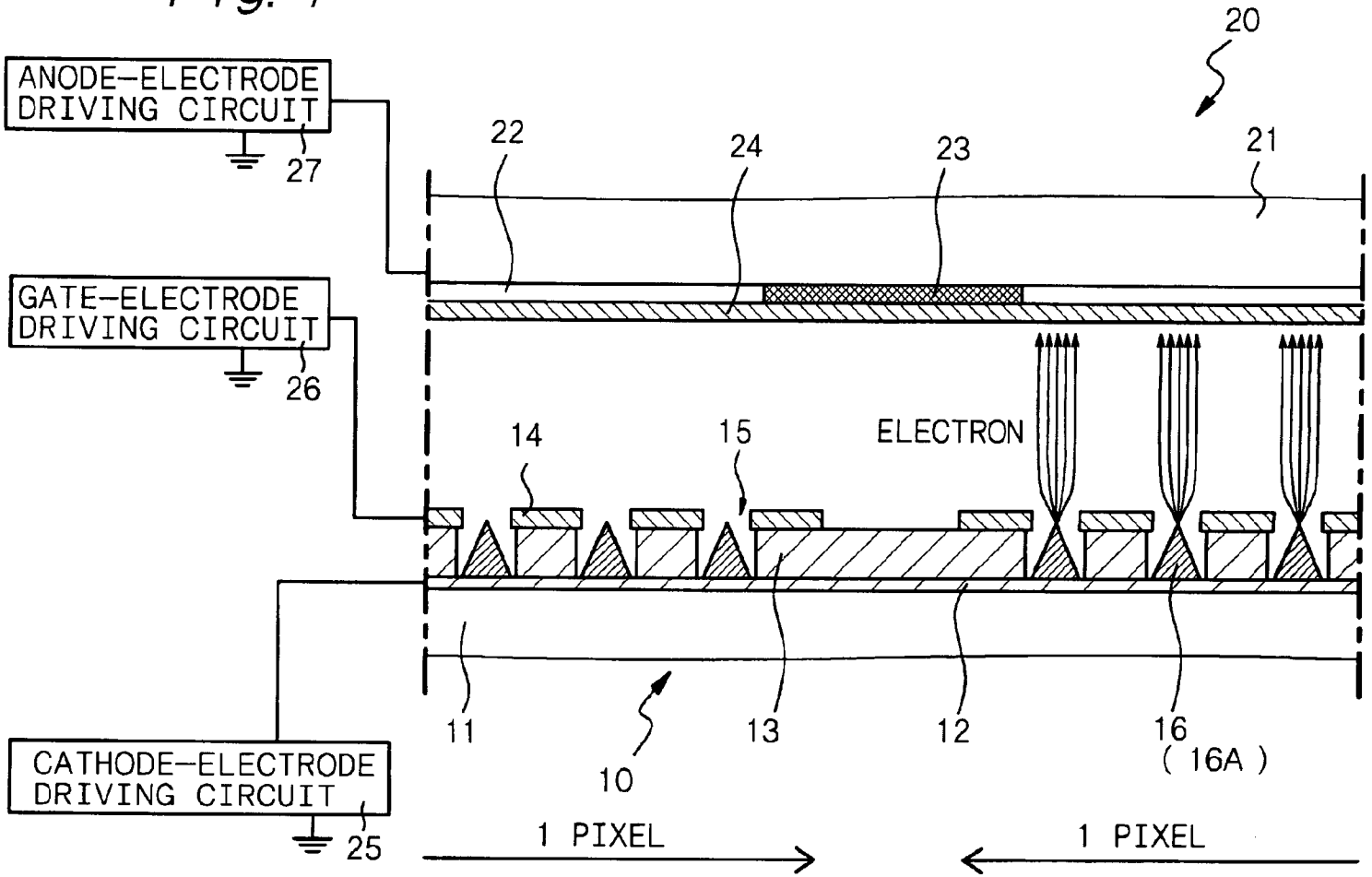
FIG. 7 is a schematic drawing for showing a typical constitution example of a conventional cold cathode field emission display.
Figure 8:
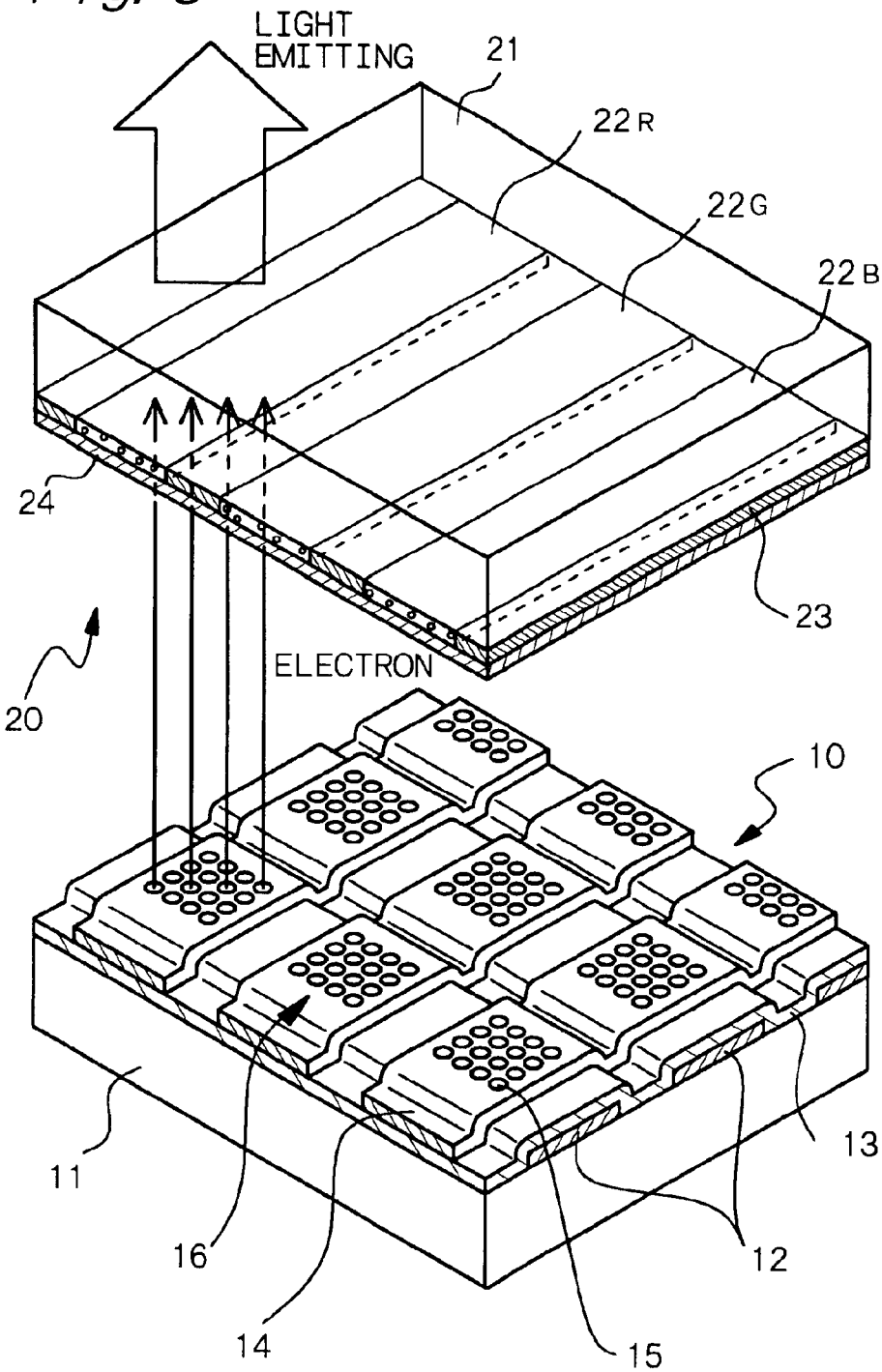
FIG. 8 is a schematic exploded perspective view of parts of a cathode panel and an anode panel.
Figure 9A:
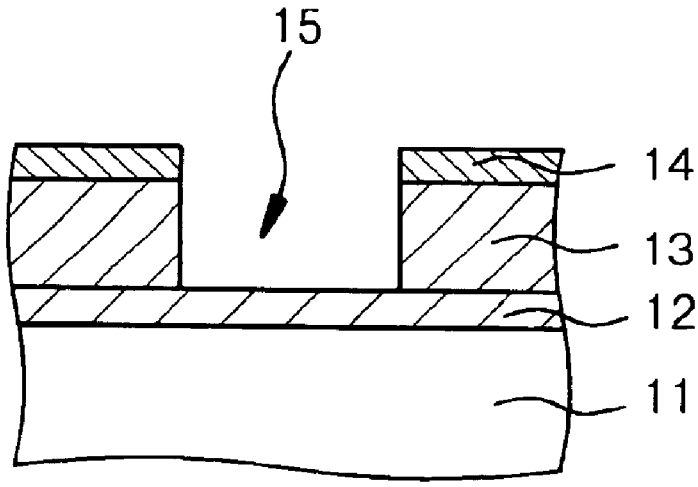
FIGS. 9A and 9B are schematic partial end views of a first support member, etc., for explaining the method for producing a field emission device having a first structure constituted of a Spindt-type field emission device.
Figure 9B:
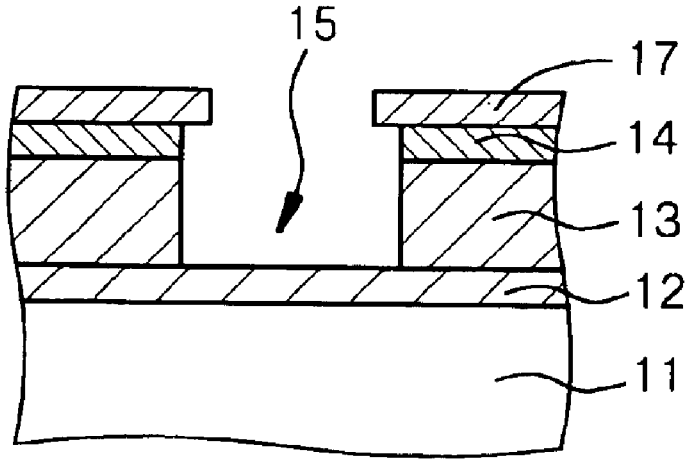

The flat-type display device in Example 4 is a cold cathode field emission display (display) and it is structured so as to have a number of Spindt-type field emission devices shown in FIGS. 7 and 8, so that a detailed explanation thereof is omitted.

In Example 4, the anode panel is the first substrate, the cathode panel is the second substrate (that is, the above constitution (3) is employed), and the knocking treatment-B is carried out and completed. Then, the cathode panel is the first substrate, the anode panel is the second substrate (that is, the above constitution (1) is employed), and the knocking treatment-A is carried out. For preventing the display from exhibiting its function, that is, preventing the emission of electrons from the field emission devices, the cathode electrode and the gate electrode are short-circuited so as to have potentials at the same level.

Figure 5A:
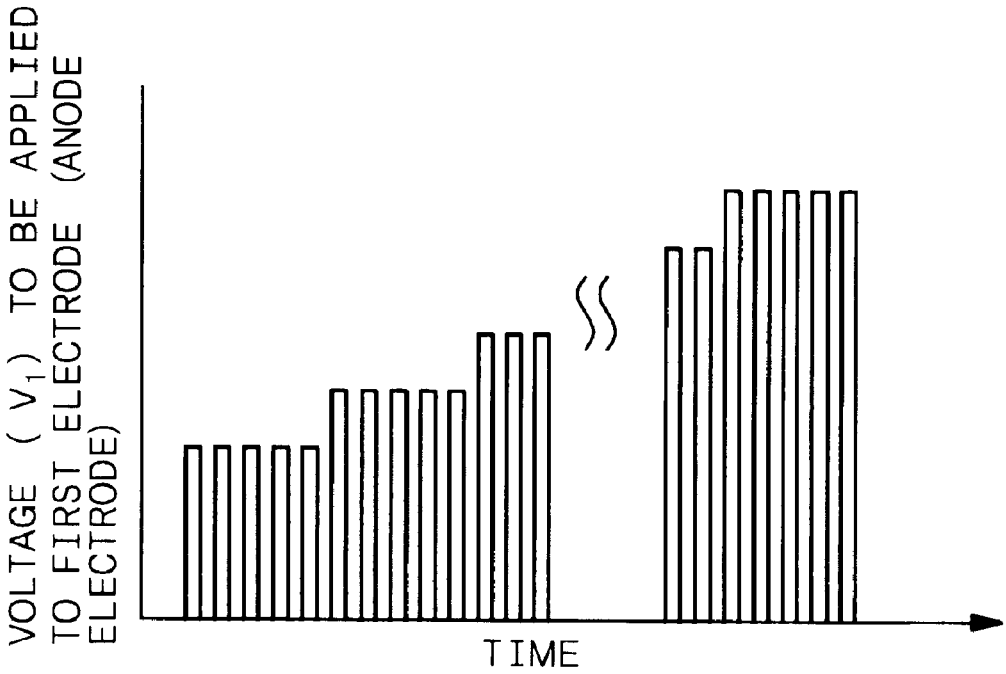
FIGS. 5A and 5B are schematic drawings for showing a change in a voltage $V_1$ in Example 4.
Figure 5B:
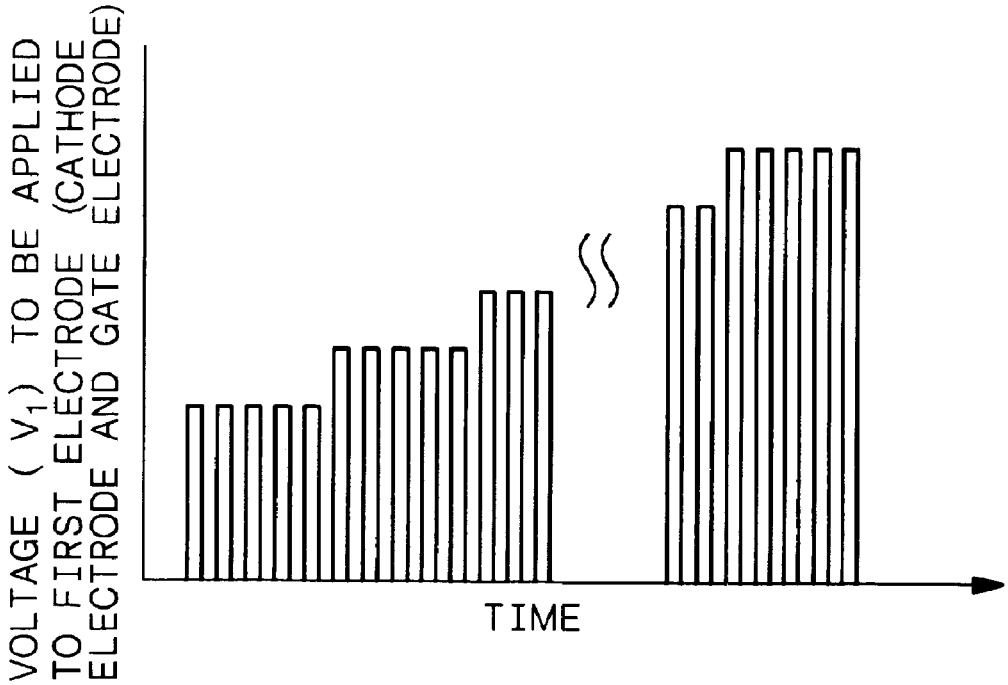

FIGS. 5A and 5B show a change in the voltage $V_1$ when the voltage $V_1$ higher than the voltage applied to the second electrode is pulsewise applied to the first electrode to field-evaporate the projections present in the first electrode. FIG. 5A shows a change in the voltage $V_1$ (voltage applied to the anode electrode) in the knocking treatment-B, and FIG. 5B shows a change in the voltage $V_1$ (voltage applied to the cathode electrode and the gate electrode which are short-circuited) in the knocking treatment-A.

In the knocking treatment-A and the knocking treatment-B in Example 4, the value of the voltage to be applied to the first electrode was set at $V_1$ volt (>0 volt), the value of the voltage to be applied to the second electrode was set at 0 volt, the value (pulse height) of the voltage $V_1$ at an initial step was set at 1 kV, the voltage increase amount was set at 0.01 kV, the pulse width was set at 1 microsecond, and the pulse interval was set at 1 microsecond.

The knocking treatment-A and the knocking treatment-B were carried out for the display as described above, then, the actual operation voltage $V_{OP}$ as applied to the cathode electrode and the gate electrode which were short-circuited, the anode electrode was set at 0 volt, and a measurement was made for a current flowing between them to show that no current flowed. Further, the actual operation voltage $V_{OP}$ was applied to the anode electrode, the cathode electrode and the gate electrode which were short-circuited were set at 0 volt, and a measurement was made for a current flowing between them, to show that no current flowed. That is, it was found that the projections present in the first electrode were removed by field evaporation. After completion of the knocking treatment-A, the knocking treatment-B was carried out, and in this case, a similar result was also obtained. Further, when the knocking treatment-A was carried out and then the knocking treatment-B was carried out for the above constitutions (2) and (4), similar results were obtained.

EXAMPLE 5

Example 5 is a variant of Example 4. In Example 5, after the pulse-voltage-applying step of applying the pulse voltage $V_1$ to the first electrode higher than the voltage applied to the second electrode, there is carried out the current-detection step of applying the voltage $V_2$ to the second electrode higher than the voltage applied to the first electrode and detecting a current flowing between the first electrode and the second electrode. When the voltage $V_2$ higher than the voltage applied to the first electrode is applied to the second electrode, a high electric field is exerted on the projections present in the first electrode, electrons are emitted from the projections on the basis of a quantum tunnel effect, and such electrons are detected as a current flowing between the first electrode and the second electrode. After the projections are field-evaporated, such a current is no longer detected. After the current-detection step is carried out, the pulse-voltage-applying applying step is carried out again.

In Example 5, further, when the current flowing between the first electrode and the second electrode comes to be a predetermined value or less (0 ampere in Example 5), a voltage higher than the voltage $V_1$ is set as a new voltage $V_1$, a voltage higher than the voltage $V_2$ is set as a new voltage $V_2$, and the pulse-voltage-applying step and the current-detection step are repeated. In Example 5, the number of pulses of the voltage $V_1$ in one pulse-voltage-applying step was determined to be 5. Further, when the voltage $V_2$ comes to be equal to the actual operation voltage $V_{OP}$ of the flat-type display device, a voltage higher than the voltage $V_1$ is set as a new voltage $V_1$, the voltage $V_2$ is set at a value equal to the actual operation voltage $V_{OP}$, and the pulse-voltage-applying step and the current-detection step are repeated until the current flowing between the first electrode and the second electrode comes to be a predetermined value or less (0 ampere in Example 5). After the voltage $V_2$ comes to have a value equal to the actual operation voltage $V_{OP}$, and when the current flowing between the first electrode and the second electrode comes to have a predetermined value or less (0 ampere in Example 5), the knocking treatment is automatically terminated.

In Example 5, the anode panel is the first substrate, the cathode panel is the second substrate (that is, the above constitution (3) is employed), and the knocking treatment-B is carried out and completed. Then, the cathode panel is the first substrate, the anode panel is the second substrate (that is, the above constitution (1) is employed), and the knocking treatment-A is carried out. For preventing the display from exhibiting its function, that is, for preventing the emission of electrons from the field emission devices, the cathode electrode and the gate electrode are short-circuited so as to have potentials at the same level.

In the knocking treatment-A and the knocking treatment-B in Example 5, the value of the voltage to be applied to the first electrode is set at $V_1$ volt (>0 volt) and the value of the voltage to be applied to the second electrode is set at 0 volt in the pulse-voltage-applying step. And, the value of the voltage to be applied to the second electrode is set at 0 volt and the value of the voltage to be applied to the first electrode is set at $-V_2$ volt (<0) in the current-detection step. The value (pulse height) of the voltage $V_1$ at an initial step was set at 1 kV, the value of the voltage $-V_2$ at an initial step was set at −0.1 kV, the voltage increase amount of the voltage $V_1$ was set at 0.01 kV, the pulse width was set at 1 microsecond, the pulse interval was set at 1 microsecond, and the absolute value of voltage change amount of the voltage $V_2$ was set at 0.01 kV.

Figure 6:
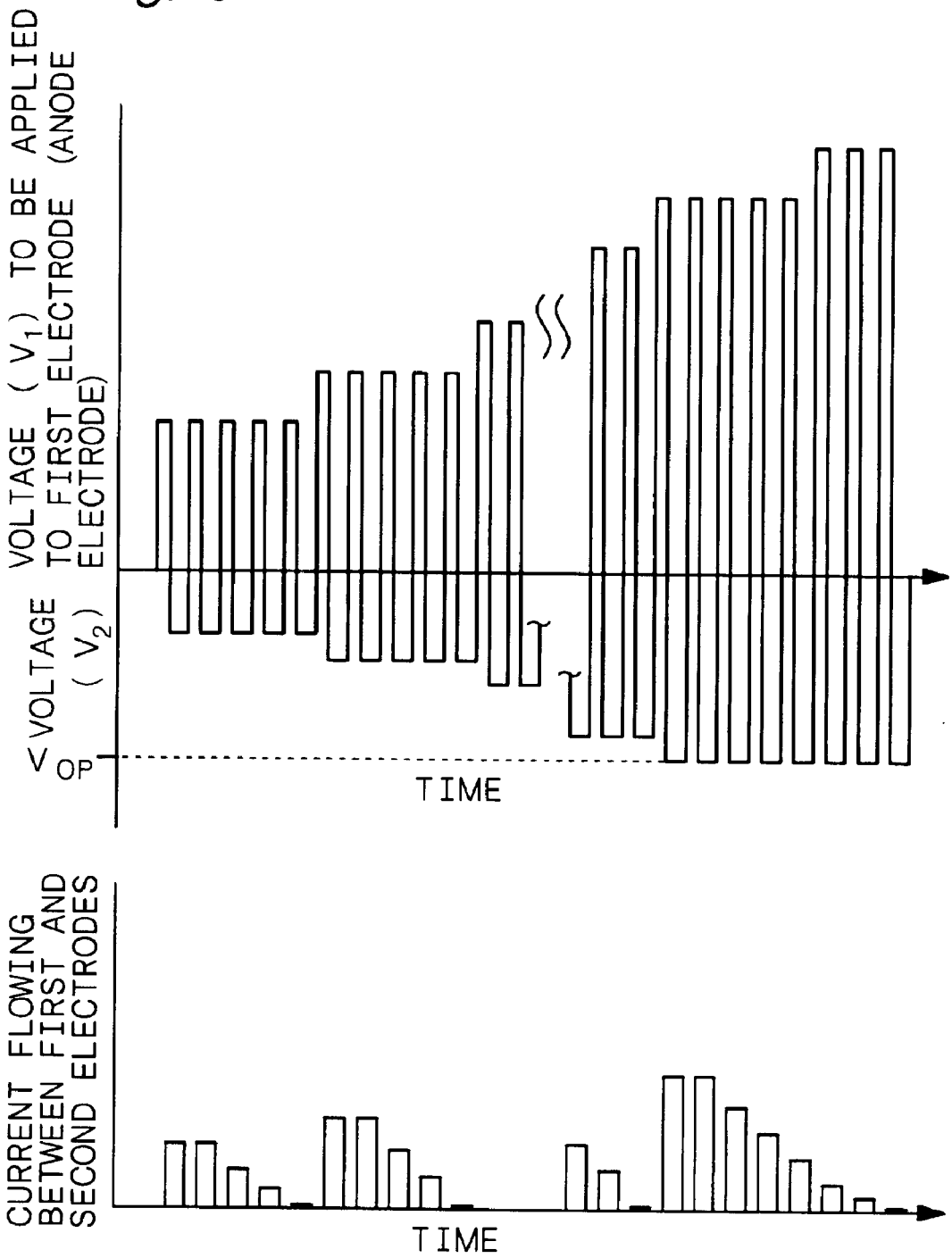
FIG. 6 is a schematic drawing for showing changes in voltages $V_1$ and $V_2$ in Example 5.

FIG. 6 schematically shows changes in the voltages $V_1$ and $V_2$. FIG. 6 shows the changes in the voltage $V_1$ and the voltage $V_2$ (voltage applied to the anode electrode) in the knocking treatment-B, which is also applicable to changes in the voltages $V_1$ and the voltage $V_2$ (voltage applied to the cathode electrode and the gate electrode which are short-circuited) in the knocking treatment-A.

After the knocking treatment-A and the knocking treatment-B were carried out as described above, the actual operation voltage $V_{OP}$ was applied to the cathode electrode and the gate electrode which were short-circuited, the anode electrode was set at 0 volt, and a measurement was made for a current flowing between them, to show that no current flowed. Further, the actual operation voltage $V_{OP}$ was applied to the anode electrode, the cathode electrode and the gate electrode which were short-circuited were set at 0 volt, and a measurement was made for a current flowing between them, to show that no current flowed. That is, it was found that the projections present in the first electrode were removed by field evaporation. Further, after completion of the knocking treatment-A, the knocking treatment-B was carried out. In this case, a similar result was also obtained.

The first substrate and the second substrate were exchanged alternately, and the knocking treatment method in Example 5 was carried out. That is, the voltage $V_1$ higher than the voltage applied to the second electrode was pulsewise applied to the first electrode such that a plurality of pulses were applied, then, the first substrate and the second substrate were exchanged, and the above procedure was repeated. By the above repeated procedures, a similar result was obtained. Further, when the knocking treatment-A was carried out for the above constitutions (2) and (4), similar results were obtained.

EXAMPLE 6

Example 6 is concerned with the substrate knocking treatment method in a substrate for a flat-type display device according to the second aspect of the present invention. That is, the substrate knocking treatment method in Example 6 is concerned with the knocking treatment method during the production of the flat-type display device (before assembly of the flat-type display device). In the method, a substrate for a flat-type display device, provided with a substrate-electrode, and a substrate for knocking, provided with an electrode for knocking, are disposed with a vacuum space interposed between them, a voltage $V_1$ higher than a voltage applied to the electrode for knocking is pulsewise applied to the substrate-electrode, and a projection present in the substrate-electrode is removed by field evaporation. In the substrate knocking treatment method according to the first aspect of the present invention explained in Example 3, a discharge may sometimes take place between the substrate-electrode and the electrode for knocking during the knocking treatment. In such a case, it is preferred to employ the substrate knocking treatment method according to the second aspect of the present invention since a discharge does not easily take place due to pulsewise application of the voltage $V_1$.

The flat-type display device in Example 6 is a cold cathode field emission display (display), and the anode electrode provided in the anode panel corresponds to the substrate-electrode provided in the substrate. The display is structured so as to have a plurality of Spindt-type field emission devices shown in FIGS. 7 and 8.

The knocking treatment apparatus suitable for carrying out the substrate knocking treatment method in Example 6 can be the same as the knocking treatment apparatus 30 shown in FIG. 3, so that a detailed explanation thereof is omitted.

The voltage $V_1$ higher than the voltage applied to the electrode for knocking is applied to the substrate-electrode such that five pulses are applied and then the voltage $V_1$ is increased, and these procedures are repeated to field-evaporate the projections present in the substrate-electrode (anode electrode). The change in the voltage $V_1$ in this case can be the same as that shown schematically in FIG. 5A. In the substrate knocking treatment method in Example 6, the value of the voltage to be applied to the substrate-electrode was set at $V_1$ volt (>0 volt), the value of the voltage to be applied to the electrode for knocking was set at 0 volt, the value of the voltage $V_1$ (pulse height) at an initial step was set at 1 kV, the voltage increase amount was set at 0.01 kV, the pulse width was set at 1 microsecond, and the pulse interval was set at 1 microsecond.

After the substrate knocking treatment method was carried out for the anode panel as described above, the actual operation voltage $V_{OP}$ was applied to the electrode for knocking, the anode electrode was set at 0 volt, and a measurement was made for a current flowing between them, to show that no current flowed. That is, it was found that the projections present in the substrate-electrode (anode electrode) were removed by field evaporation. When the substrate knocking treatment method was carried out for the above constitutions (5) and (6), similar results were obtained.

In the knocking treatment apparatus shown in FIG. 3, the electrode for knocking 42 has almost the same size as that of the anode panel or the cathode panel, while the substrate for knocking may have a smaller size than the anode panel or the cathode panel. In this case, it is sufficient to employ a structure in which the substrate for knocking can scan above the anode panel or the cathode panel. That is, it is sufficient to employ a structure in which the substrate for knocking can move, for example, along a guide.

EXAMPLE 7

Example 7 is a variant of Example 6. In Example 7, after the pulse-voltage-applying step of applying the pulse voltage $V_1$ to the substrate-electrode higher than the voltage applied to the electrode for knocking, there is carried out the current-detection step of applying the voltage $V_2$ to the electrode for knocking higher than the voltage applied to the substrate-electrode and detecting a current flowing between the substrate-electrode and the electrode for knocking. When the voltage $V_2$ higher than the voltage applied to the substrate-electrode is applied to the electrode for knocking, a high electric field is exerted on the projections present in the substrate-electrode, electrons are emitted from the projections on the basis of a quantum tunnel effect, and such electrons are detected as a current flowing between the substrate-electrode and the electrode for knocking. After the projections are field-evaporated, such a current is no longer detected. After the current-detection step, the pulse-voltage-applying step is again carried out.

In Example 7, further, when the current flowing between the substrate-electrode and the electrode for knocking comes to have a predetermined value or less (0 ampere in Example 7), a voltage higher than the voltage $V_1$ is set as a new voltage $V_1$, a voltage higher than the voltage $V_2$ is set as a new voltage $V_2$, and the pulse-voltage-applying step and the current-detection step are repeated. In Example 7, the number of pulses of the voltage $V_1$ in one pulse-voltage-applying step was determined to be 5. When the voltage $V_2$ comes to be equal to the actual operation voltage $V_{OP}$ of the flat-type display device, a voltage higher than the voltage $V_1$ is set as a new voltage $V_1$, the voltage $V_2$ is set at a value equal to the actual operation voltage $V_{OP}$, and the pulse-voltage-applying step and the current-detection step are repeated until the current flowing between the substrate-electrode and the electrode for knocking comes to have a predetermined value or less (0 ampere in Example 7). After the voltage $V_2$ comes to be a value equal to the actual operation voltage $V_{OP}$, and when the current flowing between the substrate-electrode and the electrode for knocking comes to be a predetermined value or less (0 ampere in Example 7), the knocking treatment is automatically terminated.

In Example 7, the anode panel was the substrate (that is, the above constitution (7) was employed), and the substrate knocking treatment method was carried out.

In the substrate knocking treatment method in Example 7, the value of the voltage to be applied to the substrate-electrode was set at $V_1$ volt (>0 volt) and the voltage to be applied to the electrode for knocking was set at 0 volt in the pulse-voltage-applying step. And, the voltage to be applied to the electrode for knocking was set at 0 volt, and the voltage to be applied to the substrate-electrode was set at $-V_2$ volt (<0) in the current-detection step. And, the value of the voltage $V_1$ (pulse height) at an initial step was set at 1 kV, the value of the voltage $-V_2$ at an initial step was set at −0.1 kV, the voltage increase amount of the voltage $V_1$ was set at 0.01 kV, the pulse width was set at 1 microsecond, the pulse interval was set at 1 microsecond, and the absolute value of voltage change amount of the voltage $V_2$ was set at 0.01 kV. The changes in the voltages $V_1$ and $V_2$ can be the same as those schematically shown in FIG. 6.

After the substrate knocking treatment method was carried out as described above, the actual operation voltage $V_{OP}$ was applied to the electrode for knocking that was short-circuited, the anode electrode was set at 0 volt, and a measurement was made for a current flowing between them, to show that no current flowed. That is, it was found that the projections present in the substrate-electrode (anode electrode) were removed by field evaporation. Further, when the substrate knocking treatment method was carried out for the above constitutions (5) and (6), similar results were obtained.

EXAMPLE 8

Various field emission devices will be explained hereinafter.

When the flat-type display device is a cold cathode field emission display, the cathode panel has a plurality of field emission devices, and each field emission device comprises;

(a) a first support member, (b) a cathode electrode formed on the first support member, (c) an insulating layer formed on the first support member and the cathode electrode, (d) a gate electrode formed on the insulating layer, (e) an opening portion made through the gate electrode and the insulating layer, and (f) an electron emission electrode formed on that portion of the cathode electrode which is positioned in a bottom portion of the opening portion, wherein the electron emission electrode exposed in the bottom portion of the opening portion corresponds to the electron emitting portion.

The above structure will be referred to as a field emission device having a first structure. The type of the above field emission device includes a Spindt-type field emission device (field emission device having a conical electron-emitting electrode formed on a portion of the cathode electrode which portion is positioned in the bottom portion of the opening portion), a crown-type field emission device (field emission device having a crown-shaped electron-emitting electrode formed on a portion of the cathode electrode which portion is positioned in the bottom portion of the opening portion), and a plane-type field emission device (field emission device having a nearly flat electron-emitting electrode formed on a portion of the cathode electrode which portion is positioned in the bottom portion of the opening portion).

Alternatively, the cathode panel has a plurality of field emission devices, and each field emission device comprises;

(a) a first support member, (b) a cathode electrode formed on the first support member, (c) an insulating layer formed on the first support member and the cathode electrode, (d) a gate electrode formed on the insulating layer, and (e) an opening portion that is made through the gate electrode and the insulating layer and has a bottom portion where the cathode electrode is exposed, wherein that portion of the cathode electrode which is exposed in the bottom portion of the opening portion corresponds to the electron emitting portion.

The above structure will be referred to as a field emission device having a second structure for convenience. The type of the above field emission device includes a flat-type field emission device which emits electrons from the flat surface of the cathode electrode and a crater-type field emission device which emits electrons from a convex portion of the surface of the cathode electrode having convexo-concave form.

Further, the cathode panel has a plurality of field emission devices, and each field emission device comprises;

(a) a first support member, (b) a cathode electrode which has an edge portion and is formed above the first support member, (c) an insulating layer formed at least on the cathode electrode, (d) a gate electrode formed on the insulating layer, and (e) an opening portion made through at least the gate electrode and the insulating layer, wherein that edge portion of the cathode electrode which is exposed in a bottom portion or a side wall of the opening portion corresponds to the electron emitting portion.

The above structure will be referred to as a field emission device having a third structure or an edge-type field emission device for convenience.

Further, the cathode panel has a plurality of field emission devices, and each field emission device comprises;

(a) a stripe-shaped gate electrode support made of an insulating material and formed on a first support member, (b) a gate electrode made of a stripe-shaped material layer having a plurality of opening portions made through the stripe-shaped material layer, and (c) an electron emitting portion, wherein the stripe-shaped material layer is arranged such that the stripe-shaped material layer is in contact with a top surface of the gate electrode support and that the opening portion is positioned above the electron emitting portion.

The above structure will be referred to as a field emission device having a fourth structure for convenience. Various electron emission electrodes or electron emitting portions in the field emission devices having the first to third structures can be employed as electron emitting portions in the field emission device having the fourth structure.

The material for constituting the gate electrode of the field emission device having the first, second or third structure or the material for constituting the focus electrode includes at least one metal selected from the group consisting of tungsten (W), niobium (Nb), tantalum (Ta), titanium (Ti), molybdenum (Mo), chromium (Cr), aluminum (Al), copper (Cu), gold (Au), silver (Ag), nickel (Ni), cobalt (Co), zirconium (Zr), iron (Fe), platinum (Pt) and zinc (Zn); alloys or compounds containing these metal elements (for example, nitrides such as TiN and silicides such as $WSi_2$, $MoSi_2$, $TiSi_2$, $TaSi_2$, etc.); a semiconductor material such as silicon (Si); and electrically conductive metal oxides such as ITO (indium tin oxide), indium oxide and zinc oxide. When the gate electrode or the focus electrode is formed, a thin film made of the above material is formed on the insulating layer by a known thin film forming method such as a CVD method, a sputtering method, a vapor deposition method, an ion plating method, an electrolytic plating method, an electroless plating method, a screen printing method, a laser abrasion method or a sol-gel method. When the thin film is formed on the entire surface of the insulating layer, the thin film is patterned by a known patterning method, to form the stripe-shaped gate electrode. The opening portion may be formed in the gate electrode after the formation of the stripe-shaped gate electrode, or the opening portion may be formed in the gate electrode concurrently with the formation of the stripe-shaped gate electrode. Further, if a patterned resist is formed on the insulating layer before the formation of the electrically conductive material layer for the gate electrode, the gate electrode can be formed by a lift-off method. Further, if vapor deposition is carried out using a mask having an opening portion having the form corresponding to the form of the gate electrode, or if screen printing is carried out with a screen having such an opening portion, the patterning after the formation of the thin film is no longer necessary. Further, the gate electrode may be formed by preparing a stripe-shaped material layer having an opening portion in advance and fixing such a stripe-shaped material layer on the gate electrode support portion, whereby the field emission device having the fourth structure can be obtained.

In the field emission device having the first structure of a Spindt-type field emission device, the material for constituting an electron-emitting electrode can be made of at least one material selected from the group consisting of tungsten, a tungsten alloy, molybdenum, a molybdenum alloy, titanium, a titanium alloy, niobium, a niobium alloy, tantalum, a tantalum alloy, chromium, a chromium alloy and impurity-containing silicon (polysilicon or amorphous silicon).

In the field emission device having the first structure of a crown-type field emission device, the material for constituting an electron-emitting electrode includes electrically conductive particles and a combination of electrically conductive particles with a binder. The material of the electrically conductive particles includes carbon-containing materials such as graphite; refractory metals such as tungsten (W), niobium (Nb), tantalum (Ta), titanium (Ti), molybdenum (Mo) and chromium (Cr); and transparent electrically conductive materials such as ITO (indium tin oxide). The binder includes glass such as water glass and general purpose resins. Examples of the general purpose resins include thermoplastic resins such as a vinyl chloride resin, a polyolefin resin, a polyamide resin, a cellulose ester resin and a fluorine resin, and thermosetting resins such as an epoxy resin, an acrylic resin and a polyester resin. For improving electron emission efficiency, preferably, the particle size of the electrically conductive particles is sufficiently small as compared with dimensions of the electron-emitting electrode. Although not specially limited, the form of the electrically conductive particles is spherical, polyhedral, plate-like, acicular, columnar or amorphous. Preferably, the electrically conductive particles have such a form that exposed portions of the electrically conductive particles form acute projections. Electrically conductive particles having different dimensions and different forms may be used as a mixture.

In the field emission device having the first structure of a plane-type field emission device, preferably, the electron-emitting electrode is made of a material having a smaller work function Φ than a material for constituting a cathode electrode. The material for constituting an electron-emitting electrode can be selected on the basis of the work function of a material for constituting a cathode electrode, a potential difference between the gate electrode and the cathode electrode, a required current density of emitted electrons, and the like. Typical examples of the material for constituting a cathode electrode of the field emission device include tungsten (Φ=4.55 eV), niobium (Φ=4.02–4.87 eV), molybdenum (Φ=4.53–4.95 eV), aluminum (Φ=4.28 eV), copper (Φ=4.6 eV), tantalum (Φ=4.3 eV), chromium (Φ=4.5 eV) and silicon (Φ=4.9 eV). The material for constituting an electron-emitting electrode preferably has a smaller work function Φ than these materials, and the value of the work function thereof is preferably approximately 3 eV or smaller. Examples of such a material include carbon Φ<1 eV), cesium (Φ=2.14 eV), $LaB_6$ (Φ=2.66–2.76 eV), BaO (Φ=1.6–2.7 eV), SrO (Φ=1.25–1.6 eV), $Y_2O_3$ (Φ=2.0 eV), CaO (Φ=1.6–1.86 eV), BaS (Φ=2.05 eV), TiN (Φ=2.92 eV) and ZrN (Φ=2.92 eV). More preferably, the electron-emitting electrode is made of a material having a work function Φ of 2 eV or smaller. The material for constituting an electron-emitting electrode is not necessarily required to have electric conductivity.

As a material for constituting an electron-emitting electrode, particularly, carbon is preferred. More specifically, diamond is preferred, and above all, amorphous diamond is preferred. When the electron-emitting electrode is made of amorphous diamond, an emitted-electron current density necessary for the display can be obtained at an electric field intensity of $5\times10^7$ V/m or lower. Further, since amorphous diamond is an electric resister, emitted-electron currents obtained from the electron-emitting electrodes can be brought into uniform currents, and the fluctuation of brightness can be suppressed when such field emission devices are incorporated into a display. Further, since the amorphous diamond exhibits remarkably high durability against sputtering by ions of residual gas in the display, field emission devices having a longer lifetime can be attained.

Otherwise, in the field emission device having the first structure of a plane-type field emission device, the material for constituting an electron-emitting electrode can be selected from materials having a secondary electron gain δ greater than the secondary electron gain δ of the electrically conductive material for constituting a cathode electrode. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (w) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (BeO), calcium oxide (CaO), magnesium oxide (MgO), tin oxide ($SnO_2$), barium fluoride ($BaF_2$) and calcium fluoride ($CaF_2$). The material for constituting an electron-emitting electrode is not necessarily required to have electric conductivity.

In the field emission device having the second structure (flat-type or crater-type field emission device) or the field emission device having the third structure (edge-type field emission device), the material for constituting a cathode electrode corresponding to the electron-emitting portion can be selected from metals such as tungsten (W), tantalum (Ta), niobium (Nb), titanium (Ti), molybdenum (Mo), chromium (Cr), aluminum (Al), copper (Cu), gold (Au) and silver (Ag); alloys and compounds of these metals (for example, nitrides such as TiN and silicides such as $WSi_2$, $MoSi_2$, $TiSi_2$ and $TaSi_2$); semiconductors such as diamond; and a thin carbon film. Although not specially limited, the thickness of the above cathode electrode is approximately 0.05 to 0.5 μm, preferably 0.1 to 0.3 μm. The method for forming the cathode electrode includes deposition methods such as an electron beam deposition method and a hot filament deposition method, a sputtering method, a combination of a CVD method or an ion plating method with an etching method, a screen-printing method and a plating method. When a screen-printing method or a plating method is employed, the cathode electrodes in the form of stripes can be directly formed.

In the field emission device having the second structure (flat-type field emission device or crater-type field emission device), the field emission device having the third structure (edge-type field emission device) or the field emission device having the first structure of the plane-type field emission device, the cathode electrode or the electron-emitting electrode can be formed from an electrically conductive paste prepared by dispersing electrically conductive fine particles. Examples of the electrically conductive fine particles include a graphite powder; a graphite powder mixed with at least one of metal powders, a barium oxide powder and a strontium oxide powder; diamond particles or a diamond-like carbon powder containing an impurity such as nitrogen, phosphorus, boron and triazole; a carbon-nanotube powder; an (Sr, Ba, Ca) $CO_3$ powder; and a silicon carbide powder. It is particularly preferred to select a graphite powder as electrically conductive fine particles in view of a decrease in threshold electric field and an improvement in durability of the electron-emitting portion. The electrically conductive fine particles may have the form of spheres or scales, or they may have any fixed or amorphous form. The particle diameter of the electrically conductive fine particles is not critical so long as it is equal to, or less than, the thickness or the pattern width of the cathode electrode or the electron-emitting electrode. With a decrease in the above particle diameter, the number of electrons emitted per unit area can be increased. When the above particle diameter is too small, however, the cathode electrode or the electron-emitting electrode may deteriorate in electric conductivity. The above particle diameter is therefore preferably in the range of from 0.01 to 4.0 μm. Such electrically conductive fine particles are mixed with a glass component or other proper binder to prepare an electrically conductive paste, a desired pattern of the electrically conductive paste is formed by a screen-printing method and the pattern is calcined or sintered, whereby the cathode electrode which works as an electron-emitting portion or the electron-emitting electrode can be formed. Otherwise, the cathode electrode which works as an electron-emitting portion or the electron-emitting electrode can be formed by a combination with a spin coating method and an etching technology or by a lift-off method.

In the field emission device having the first structure of the Spindt-type field emission device or the crown-type field emission device, the material for constituting a cathode electrode can be selected from metals such as tungsten (W), niobium (Nb), tantalum (Ta), molybdenum (Mo), chromium (Cr), aluminum (Al) and copper (Cu); alloys and compounds of these metals (for example, nitrides such as TiN and silicides such as $WSi_2$, $MoSi_2$, $TiSi_2$ and $TaSi_2$); semiconductors such as silicon (Si); and ITO (indium-tin oxide). The method for forming the cathode electrode includes deposition methods such as an electron beam deposition method and a hot filament deposition method, a sputtering method, a combination of a CVD method or an ion plating method with an etching method, a screen-printing method, a plating method and lift-off method. When a screen-printing method or a plating method is employed, the cathode electrodes in the form of stripes can be directly formed.

The material for constituting an anode electrode can be properly selected depending upon the constitution of the display. That is, when the display is a transmission type (the anode panel corresponds to a display screen), and when the anode electrode and the phosphor layer are stacked on the second support member in this order, not only the second support member but also the anode electrode itself is required to be transparent, and a transparent electrically conductive material such as ITO (indium-tin oxide) is used. When the display is a reflection type (the cathode panel corresponds to a display screen), and even when the display is a transmission type and the phosphor layer and the anode electrode are stacked on the second support member in this order, the materials for constituting a cathode electrode and the gate electrode can be properly selected from the above materials in addition to ITO.

The anode electrode may be an anode electrode having a form in which the effective field is covered with a sheet of an electrically conductive material, or may be an anode electrode having a form in which anode electrode units, each of which corresponds to one or a plurality of electron emitting portions or one or a plurality of pixels, are gathered.

The phosphor for constituting the phosphor layer can be selected from a fast electron exciting phosphor or a slow electron exciting phosphor. When the display is a monochromatic display, the phosphor layer may be non-patterned. When the display is a color display, preferably, phosphor layers which correspond to three primary colors of red (R), green (G) and blue (B) and are patterned in the form of a stripe or dots are alternately arranged. Gaps between one phosphor layer and another phosphor layer may be filled with a black matrix intended for improving a display screen in contrast.

The constitution of the anode electrode and the phosphor layer includes (1) a constitution in which the anode electrode is formed on the second support member and the phosphor layer is formed on the anode electrode and (2) a constitution in which the phosphor layer is formed on the second support member and the anode electrode is formed on the phosphor layer. In the above constitution (1), a so-called metal back layer electrically connected to the anode electrode may be formed on the phosphor layer. In the above constitution (2), a metal back layer may be formed on the anode electrode.

From the viewpoint of simplification of the structure of the display, preferably, the projection image of the gate electrode in the form of a stripe and the projection image of the cathode electrode in the form of a stripe extend in directions in which these projection images cross each other at right angles. The electron-emitting portion (constituted of one or a plurality of the field emission device(s)) is formed in an overlapping region of the projection images of the cathode electrode in the form of a stripe and the gate electrode in the form of a stripe (the overlapping region corresponds to a region of one pixel or a region of one sub-pixel). Such overlapping regions are arranged in the effective field of the cathode panel (which field works as an actual display screen portion) and generally arranged in the form of a two-dimensional matrix.

In the field emission device having any one of the first to third structures, the plan form of the opening portion (form obtained by cutting the opening portion with an imaginary plane in parallel with the first support member) may be any form such as a circle, an oval, a rectangle, a polygon, a rounded rectangle or a rounded polygon. The opening portion can be formed, for example, by isotropic etching or by a combination of anisotropic etching and isotropic etching. There may be employed a constitution in which one opening portion is made through the gate electrode, one opening portion communicating with the above one opening portion made through the gate electrode is made through the insulating layer, and one or a plurality of electron emission electrodes are formed in the above opening portion made through the insulating layer, or there may be employed a constitution in which a plurality of opening portions are made through the gate electrode, one opening portion communicating with a plurality of the opening portions made through the gate electrode is made through the insulating layer and one or a plurality of electron emission electrodes are formed in the above one opening portion made through the insulating layer.

The material for constituting the insulating layer includes $SiO_2$, SiN, SiON, SOG (spin on glass), low melting glass and glass paste, and these materials may be used alone or in combination. The insulating layer can be formed by a known process such as a CVD method, an application method, a sputtering method or a screen printing method.

The gate electrode support made of an insulating layer may be formed in the form of a rib. In this case, the gate electrode support in the form of a rib can be formed between one stripe-shaped cathode electrode and another adjacent stripe-shaped cathode electrode or between one cathode electrode group and another adjacent cathode electrode group in which each group consists of a plurality of cathode electrodes. The material for constituting the gate electrode support in the form of a rib can be selected from known insulating materials. For example, a material prepared by mixing widely used low melting glass with a metal oxide such as alumina can be used. The gate electrode support in the form of a rib can be formed, for example, by a screen printing method, a sand blasting method, a dry film method or a photo-sensitive method. The dry film method refers to a method in which a photosensitive film is laminated on the first support member, the photosensitive film in a portion where the gate electrode support in the form of a rib is to be formed is removed by exposure and development, and a material for forming the gate electrode support is filled in an opening formed by the removal and is calcined or sintered. The photosensitive film is combusted and removed by the calcining or sintering, and the material for forming the gate electrode support filled in the opening remains and constitutes the gate electrode support in the form of a rib. The photo-sensitive method refers to a method in which a photosensitive material for forming the gate electrode support is formed on the first support member and the material for forming the gate electrode support is patterned by exposure and development and then is calcined or sintered. The gate electrode support made of an insulating material in the field emission device having the fourth structure can be formed by any one of the above methods.

A resistance layer may be formed between the cathode electrode and the electron-emitting electrode. Otherwise, when the surface of the cathode electrode or the edge portion of the cathode electrode corresponds to the electron-emitting portion, the cathode electrode may have a three-layered structure constituted of an electrically conductive material layer, a resistance layer and an electron-emitting layer corresponding to the electron-emitting portion. The resistance layer can stabilize performances of the field emission device and can attain uniform electron-emitting properties. The material for constituting a resistance layer includes carbon-containing materials such as silicon carbide (SiC); SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7$ Ω, preferably several MΩ.

The focus electrode may be a focus electrode having a form in which the effective field is covered with a sheet of an electrically conductive material, or may be a focus electrode having a form in which focus electrode units, each of which corresponds to one or a plurality of electron emitting portions or one or a plurality of pixels, are gathered. The focus electrode is an electrode that is for converging the pass of electrons emitted from the electron emitting portion toward an electron irradiation surface of the anode panel to improve a brightness or prevent an optical crosstalk between adjacent pixels. A relatively negative voltage is applied to the focus electrode. The focus electrode may be formed integrally with the electron emitting portion or may be formed separately from the electron emitting portion. While the focus electrode is required to have an opening portion through which electrons emitted from the electron emitting portion are to pass, such an opening portion may be formed such that one opening portion corresponds to one electron emitting portion or a plurality of electron emitting portions.

The first support member for constituting the cathode panel or the second support member for constituting the anode panel may be a support member so long as they have a surface made of an insulation material. The support member includes a glass substrate, a glass substrate having an insulation layer formed on its surface, a quartz substrate, a quartz substrate having an insulation layer formed on its surface and semiconductor substrate having an insulation layer formed on its surface.

The cathode panel and the anode panel can be bonded to each other with an adhesive layer or they can be bonded to each other with a combination of a frame made of an insulating rigid material such as glass or ceramic with an adhesive layer. When the frame and the adhesive layer are used in combination, a large distance between the cathode panel and the anode panel can be secured by selecting a proper height of the frame as compared with a case using an adhesive alone. While frit glass is generally used as a material constituting an adhesive layer, a so-called low-melting metal material having a melting point of 120 to 400° C. may be used. The low-melting metal material includes In (indium, melting point 157° C.); an indium-gold-containing low-melting alloy; tin (Sn)-containing high-temperature solders such as $Sn_{80}Ag_{20}$ (melting point 220–370° C.) and $Sn_{95}Cu_5$ (melting point 227–370° C.); lead (Pb)-containing high-temperature solders such as $Pb_{97.5}Ag_{2.5}$ (melting point 304° C.), $Pb_{94.5}Ag_{5.5}$ (melting point 304–365° C.) and $Pb_{97.5}Ag_{1.5}Sn_{1.0}$ (melting point 309° C.); zinc (Zn)—containing high-temperature solders such as $Zn_{95}Al_5$ (melting point 380° C.); tin-lead-containing standard solders such as $Sn_5Pb_{95}$ (melting point 300–314° C.) and $Sn_2Pb_{98}$ (melting point 316–322° C.); and soldering materials such as $Au_{88}Ga_{12}$ (melting point 381° C.). All of the above subscript values show atomic %.

When the cathode panel, the anode panel and the frame are bonded, these members may be bonded at the same time, or one of the panels and the frame may be bonded in advance at a first step and the other panel may be bonded to the frame at a second step. When these three members are bonded at the same time or the other panel is bonded to the frame at the second step in a vacuum atmosphere, the space surrounded by the cathode panel, the anode panel and the frame comes to be a vacuum concurrently with the bonding. Otherwise, the space surrounded by the cathode panel, the anode panel and the frame may be vacuumed to form a vacuum space after these three members are bonded. When the vacuuming is carried out after the bonding, the atmosphere for the bonding may have atmospheric pressure or reduced pressure, and the gas constituting the atmosphere may be ambient atmosphere or an inert gas containing nitrogen gas or a gas coming under the group 0 of the periodic low table (for example, Ar gas).

When the vacuuming is carried out after the bonding, the vacuuming can be carried out through a tip tube pre-connected to the cathode panel and/or the anode panel. Typically, the tip tube is made of a glass tube and is bonded to a circumference of a through hole formed in an ineffective field of the cathode panel and/or the anode panel with frit glass or the above low-melting metal material. After the space reaches a predetermined vacuum degree, the tip tube is sealed by thermal fusion. When the entire display is once heated and then temperature-decreased before the sealing, properly, a residual gas can be released into the space, and the residual gas can be removed out of the space by the vacuuming.

[Spindt-Type Field Emission Device]

Figure 10A:
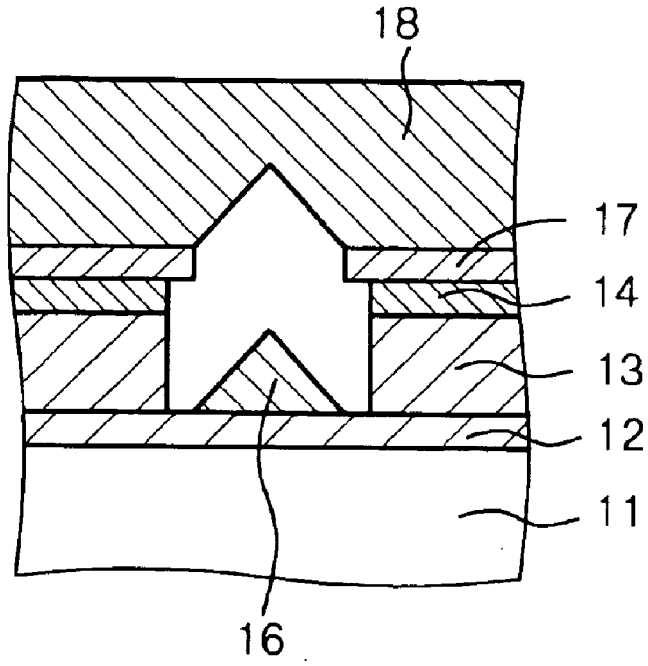
FIGS. 10A and 10B, following
Figure 10B:
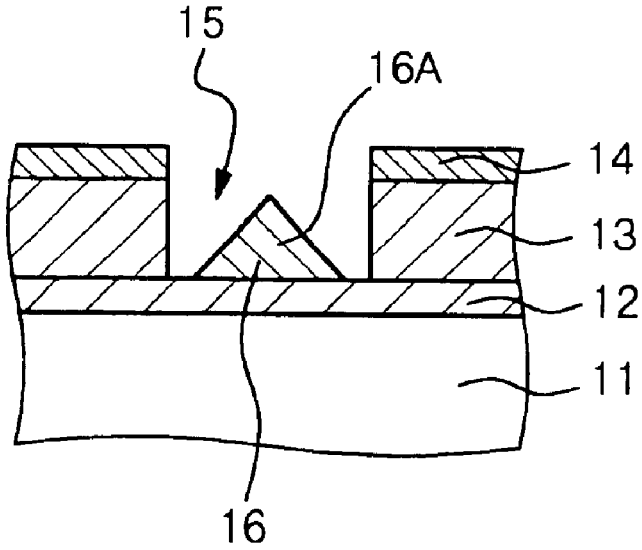
Figure 11A:
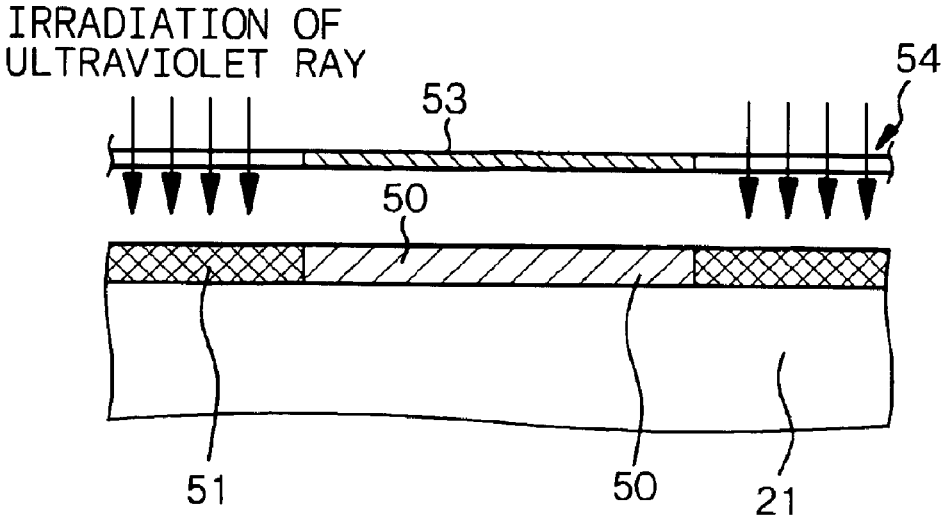
FIGS. 11A to 11D are schematic partial end views of a substrate, etc., for explaining one example of a method for producing an anode panel.
Figure 11B:
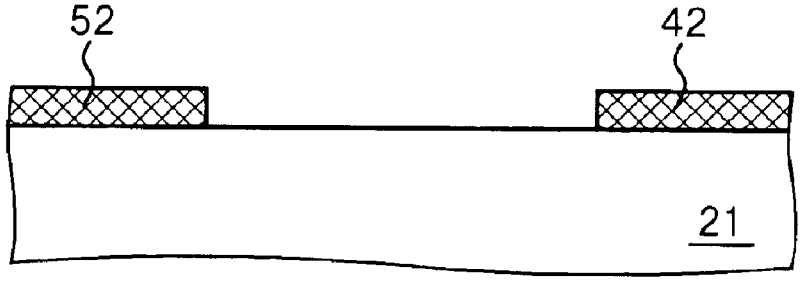
Figure 11C:
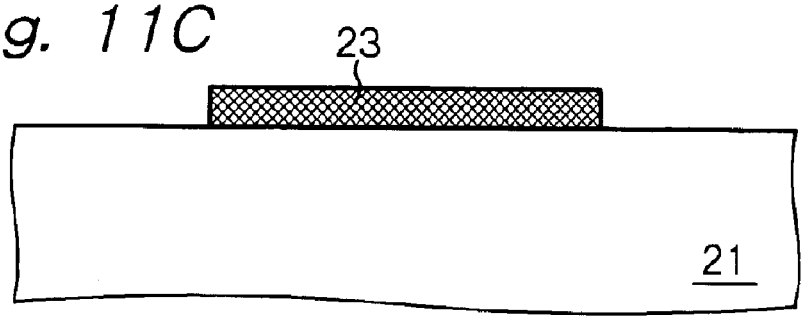
Figure 11D:
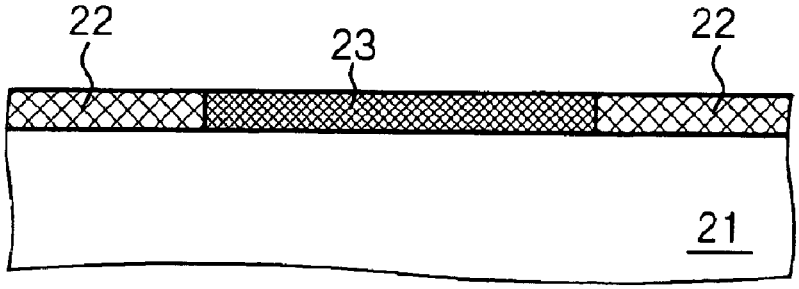

FIG. 10B shows a schematic partial end view of a field emission device having the first structure constituted of a Spindt-type field emission device. The Spindt-type field emission device comprises a cathode electrode 12 formed on a first support member 11, an insulating layer 13 formed on the first support member 11 and the cathode electrode 12, a gate electrode 14 formed on the insulating layer 13, an opening portion 15 made through the gate electrode 14 and the insulating layer 13, and a conical electron emission electrode 16A formed on the cathode electrode 12 positioned in a bottom portion of the opening portion 15. The conical electron emission electrode 16A exposed in the bottom portion of the opening portion 15 corresponds to the electron emitting portion 16.

The method of forming the Spindt-type field emission device is in principle a method in which the conical electron emission electrode 16A is formed by perpendicular vapor deposition of a metal material. That is, vaporized particles enter perpendicularly to the opening portion 15, a shielding effect of a deposit formed in an over-hanging state around the opening portion 15 is used to gradually decrease the amount of vaporized particles that reach the bottom portion of the opening portion 15, whereby the electron emission electrode 16A that is a conical deposit is formed in a self-aligned manner. For making it easy to remove the unnecessary overhanging deposit, a peel-off layer 17 is formed on the insulating layer 13 and the gate electrode 14 in advance. The method for forming the Spindt-type field emission device will be explained with reference to FIGS. 9A and 9B and FIGS. 10A and 10B showing schematic partial end views of the first support member and the like.

[Step-100]

First, the cathode electrode 12 made of niobium (Nb) in the form of a stripe is formed on the first support member 11 made, for example, of glass substrate, and the insulating layer 13 made of $SiO_2$ is formed on the entire surface. Further, the gate electrode 14 is formed on the insulating layer 13. The gate electrode 14 can be formed, for example, by a sputtering method, lithography and a dry etching method. Then, the opening portion 15 is formed in the gate electrode 14 and the insulating layer 13 by an RIE (reactive ion-etching) method, to expose the cathode electrode 12 in a bottom portion of the opening portion 15 (see FIG. 9A). The cathode electrode 12 may be a single-material layer, or it may be a stack of a plurality of material layers. For suppressing the fluctuation of electron emission characteristics of the electron-emitting electrodes to be formed at a step to come later, the surface layer portion of the cathode electrode 12 can be made of a material having a higher electric resistivity than a material forming the remaining portion.

[Step-110]

Then, the electron-emitting electrode 16A is formed on the cathode electrode 12 exposed in the bottom portion of the opening portion 15. Specifically, aluminum is obliquely deposited on the surface to form the peel layer 17. In this case, it is arranged to make a sufficiently large incidence angle of vaporized particles with regard to a normal of the first support member 11, whereby the peel layer 17 can be formed on the gate electrode 14 and the insulating layer 13 almost without depositing aluminum in the bottom portion of the opening portion 15. The peel layer 17 extends from the opening edge portion of the opening portion 15 like eaves, whereby the opening portion 15 is substantially decreased in diameter (see FIG. 9B).

[Step-120]

Then, for example, molybdenum (Mo) is vertically deposited on the entire surface. In this case, as shown in FIG. 10A, with the growth of an electrically conductive layer 18 made of molybdenum having an overhanging form on the peel layer 17, the substantial diameter of the opening portion 15 is gradually decreased, so that vaporized particles which contribute to deposition in the bottom portion of the opening portion 15 gradually come to be limited to particles which pass by the center of the opening portion 15. As a result, a conical deposit is formed on the bottom portion of the opening portion 15, and the conical deposit made of molybdenum constitutes the electron-emitting electrode 16A.

Then, the peel layer 17 is peeled off from the insulating layer 13 and the gate electrode 14 by an electrochemical process and a wet process, to selectively remove the electrically conductive layer 18 on the insulating layer 13 and the gate electrode 14. As a result, as shown in FIG. 10B, the conical electron-emitting electrode 16A can be retained on the cathode electrode 12 positioned in the bottom portion of the opening portion 15.

The cathode panel 10 having such field emission devices formed in a large number and the anode panel 20 are combined, whereby the display shown in FIG. 7 can be obtained. Specifically, an approximately 1 mm high frame (not shown) made, for example, of ceramic or glass is provided, the frame, the cathode panel 10 and the anode panel 20 are bonded, for example, with frit glass, and the frit glass is dried, then followed by calcining the frit glass at approximately 450° C. for 10 to 30 minutes. Then, the inner space of the display is vacuumed until it has a vacuum degree of approximately $10^{-4}$ Pa, and then the inner space is sealed by a proper method. Alternatively, the frame, the cathode panel 10 and the anode panel 20 may be bonded in a high-vacuum atmosphere. Alternatively, for some structure of the display, the cathode panel 10 and the anode panel 20 may be bonded to each other without the frame.

One example of the method for producing the anode panel will be explained with reference to FIGS. 11A to 11D. First, a luminescence crystal particle composition is prepared. For this purpose, for example, a dispersing agent is dispersed in purified water, and the dispersion is stirred with a homomixer at 3000 rpm for 1 minute. Then, the luminescence crystal particles are placed in the purified water in which the dispersing agent is dispersed, and the mixture is stirred with a homomixer at 5000 rpm for 5 minutes. Then, for example, polyvinyl alcohol and ammonium bichromate are added, and the mixture is fully stirred and then filtered.

In the production of the anode panel, a photosensitive film 50 is formed (applied) on the entire surface of the second support member 21 made, for example, of glass. Then, the photosensitive film 50 formed on the second support member 21 is exposed to light which has been irradiated from a light source (not shown), and has passed through an opening 54 formed in a mask 53, to form an exposed region 51 (see FIG. 11A). Then, the photosensitive film 50 is developed to remove it selectively, whereby a remaining portion (exposed and developed photosensitive film) 52 is retained on the second support member 21 (see FIG. 11B). Then, a carbon agent (carbon slurry) is applied to the entire surface, dried and calcined, and the remaining portion 52 of the photosensitive film and the carbon agent thereon are removed by a lift-off method, to form a black matrix 23 made of the carbon agent on the exposed second support member 21 and also to remove the remaining portion 52 of the photosensitive film (see FIG. 11C). Then, phosphor layers 22 (22R, 22G, 22B) for red, green and blue are formed on the exposed second support member 21 (see FIG. 11D). Specifically, luminescence crystal particle compositions made of the luminescence crystal particles (phosphor particles) are used. For example, a red photosensitive luminescence crystal particle composition (phosphor slurry) can be applied to the entire surface, exposed to light and developed, then, a green photosensitive luminescence crystal particle composition (phosphor slurry) can be applied to the entire surface, exposed to light and developed, and then a blue photosensitive luminescence crystal particle composition (phosphor slurry) can be applied to the entire surface, exposed to light and developed. Then, the anode electrode 24 made of a thin aluminum film having a thickness of approximately 0.07 $\mu$m is formed on the phosphor layers 22 and the black matrix 23 by a sputtering method. Alternatively, each phosphor layer 22 can be formed by a screen printing method and the like.

The anode electrode may have a constitution in which an effective field is covered with an electrically conductive material having the form of one sheet or may have a constitution in which the anode electrode is constituted of anode electrode units that correspond individually to one or a plurality of electron-emitting portions or correspond individually to one or a plurality of pixels.

[Crown-Type Field Emission Device]

Figure 14A:
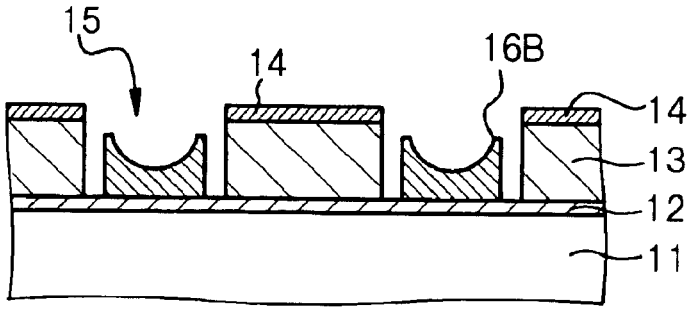
FIGS. 14A and 14B are a schematic partial end view and a partial perspective view of the first support member, etc., for explaining the method for producing the field emission device having a first structure constituted of a crown-type field emission device.
Figure 14B:
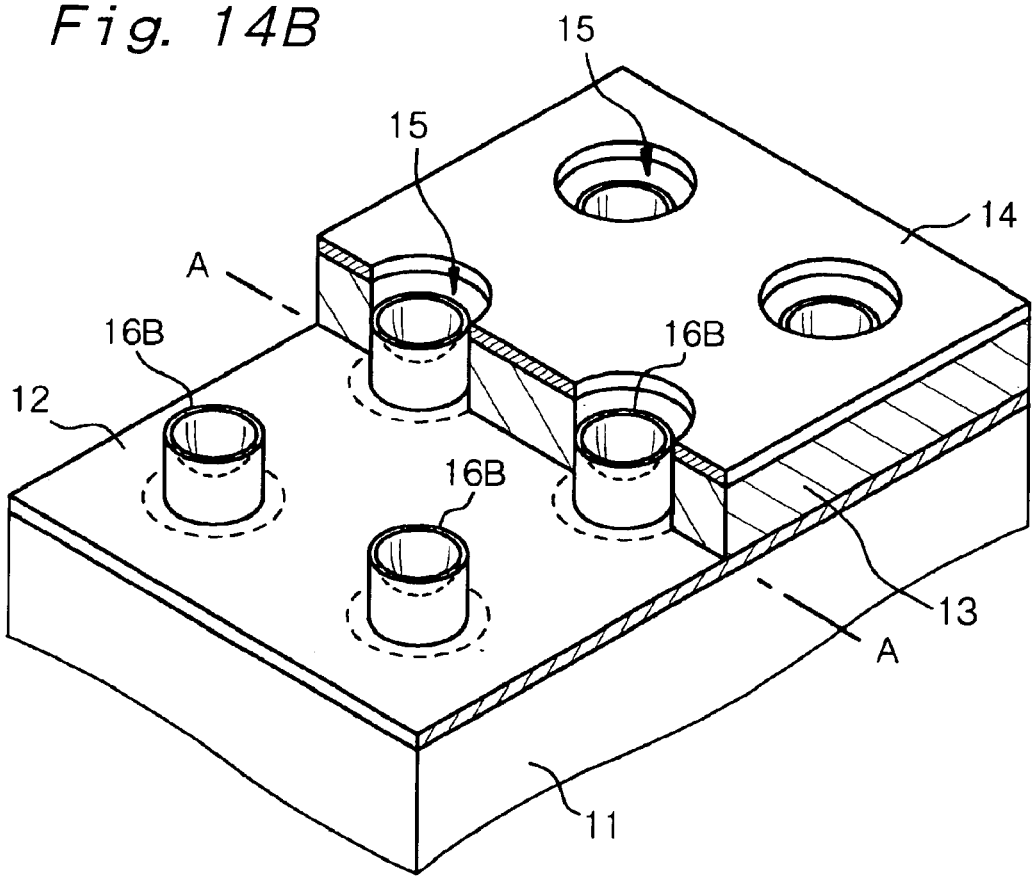

FIG. 14A shows a schematic partial end view of a field emission device having the first structure of a crown-type field emission device, and FIG. 14B shows a partial cut-off schematic perspective view thereof. The crown-type field emission device comprises. a cathode electrode 12 formed on a first support member 11; an insulating layer 13 formed on the first support member 11 and the cathode electrode 12; a gate electrode 14 formed on the insulating layer 13; an opening portion 15 penetrating through the gate electrode 14 and the insulating layer 13; and a crown-type electron-emitting electrode 16B formed on a portion of the cathode electrode 12 which portion is positioned in the bottom portion of the opening portion 15. The crown-type electron-emitting electrodes 16B exposed in the bottom portions of the opening portions 15 correspond to the electron-emitting portion 16.

The method for producing the crown-type field emission device will be explained below with reference to FIGS. 12A, 12B, 13A, 13B, 13C, 14A and 14B showing a schematic partial end views and so on of a first support member, etc.

[Step-200]

First, the cathode electrode 12 in the form of a stripe is formed on the first support member 11 made, for example, of glass. The cathode electrode 12 extends leftward and rightward on a paper surface of the drawings. The cathode electrode 12 in the form of a stripe can be formed, for example, by forming an approximately 0.2 $\mu$m thick ITO film on the entire surface of the first support member 11 by a sputtering method and then patterning the ITO film. The cathode electrode 12 can be a single-material layer or can be formed by stacking a plurality of material layers. For example, for suppressing the fluctuation of electron emission characteristics of the electron-emitting electrodes to be formed at a step to come later, the surface layer portion of the cathode electrode 12 may be made of a material having a higher electric resistivity than a material constituting the remaining portion. Then, the insulating layer 13 is formed on the first support member 11 and the cathode electrode 12. In this embodiment, for example, a glass paste is screen-printed on the entire surface to form a glass paste layer having a thickness of approximately 3 $\mu$m. Then, for removing water and a solvent contained in the insulating layer 13 and flattening the insulating layer 13, two-stage calcining procedures such as temporary calcining at 100° C. for 10 minutes and main calcining at 500° C. for 20 minutes are carried out. The above screen-printing using a glass paste may be replaced with the formation of an $SiO_2$ layer, for example, by a CVD method.

Figure 12A:
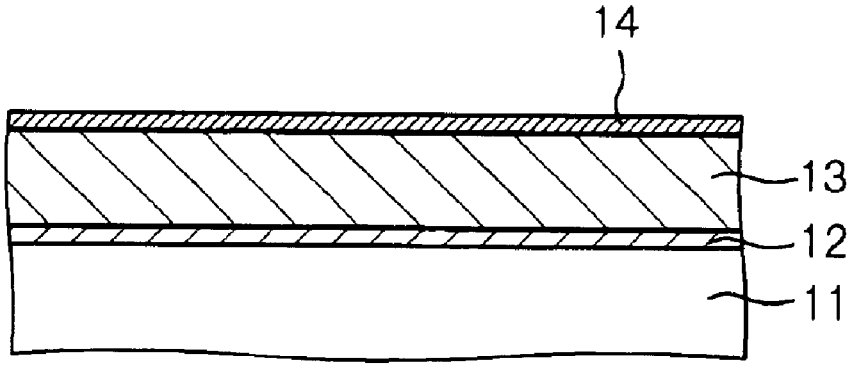
FIGS. 12A and 12B are schematic partial end views of a first support member, etc., for explaining a method for producing a field emission device having a first structure constituted of a crown-type field emission device.

Then, the gate electrode 14 in the form of a stripe is formed on the insulating layer 13 (see FIG. 12A). The gate electrode 14 extends in the direction perpendicular to the paper surface of the drawings. The gate electrode 14 can be formed, for example, by forming an approximately 20 nm thick chromium (Cr) film and a 0.2 $\mu$m thick gold (Au) film on the entire surface of the insulating layer 13 in this order by using an electron beam deposition method and then patterning the resultant stacked layers. The chromium film is formed for supplying insufficient adhesion of the gold film to the insulating layer 13. The extending direction of projection image of the gate electrode 14 forms an angle of 90° with the extending direction of projection image of the cathode electrode 12. in the form of a stripe.

[Step-2101]

Figure 12B:
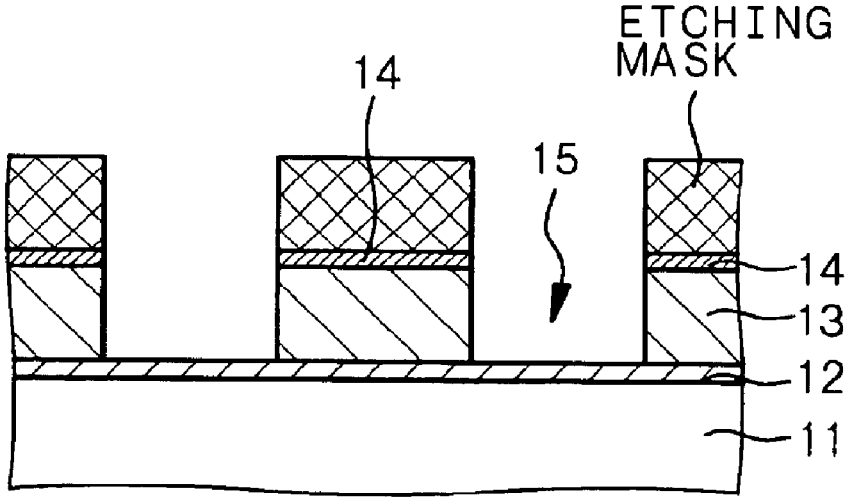

Then, the gate electrode 14 and the insulating layer 13 are etched through an etching mask composed, for example, of a photoresist material according to an RIE method, to form the opening portion 15 through the gate electrode 14 and the insulating layer 13 and to expose the cathode electrode 12 in the bottom portion of the opening portion 15 (see FIG. 12B). The opening portion 15 has a diameter of approximately 2 to 50 $\mu$m.

[Step-220]

Figure 13A:
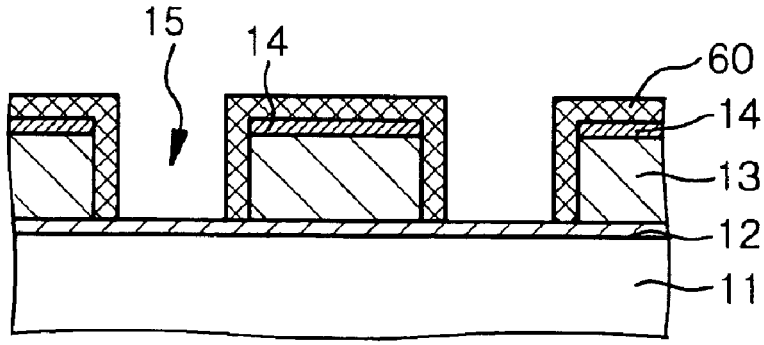
FIGS. 13A to 13C, following

Then, the etching mask is removed, and a peel layer 60 is formed on the gate electrode 14, the insulating layer 13 and the side wall surface of the opening portion 15 (see FIG. 13A). The above peel layer 60 can be formed, for example, by applying a photoresist material onto the entire surface by a spin coating method and patterning the photoresist material layer such that only part (central portion) on the bottom portion of the opening portion 15 is removed. At this stage, the diameter of the opening portion 15 is substantially decreased to approximately 1 to 20 $\mu$m.

[Step-230]

Figure 13B:
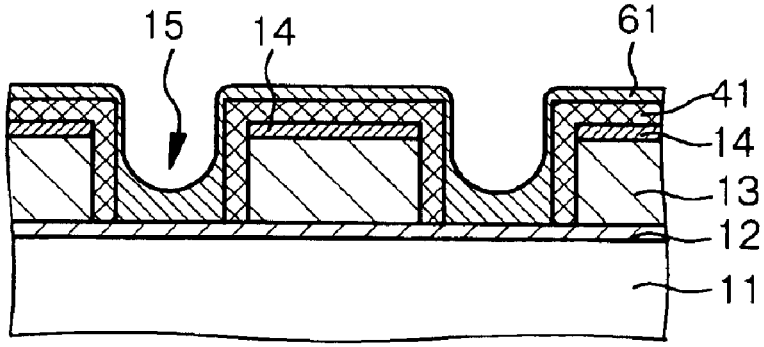
Figure 13C:
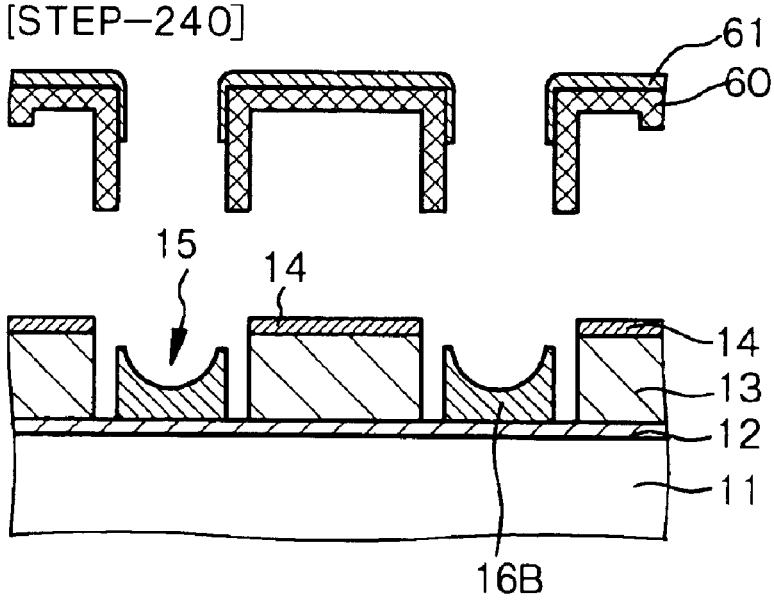

Then, as shown in FIG. 13B, an electrically conductive composition layer 61 made of a composition material is formed on the entire surface. The above composition material contains, for example, 60% by weight of graphite particles having an average particle diameter of approximately 0.1 $\mu$m as electrically conductive particles and 40% by weight of No. 4 water glass as a binder. The composition material is spin-coated on the entire surface, for example, at 1400 rpm for 10 seconds. The surface of the electrically conductive composition layer 61 in the opening portion 15 rises along the side wall surface of the opening portion 15 and dents toward the central portion of the opening portion 15 due to the surface tension of the composition material. Then, temporary calcining for removing water contained in the electrically conductive composition layer 61 is carried out, for example, in atmosphere at 400° C. for 30 minutes.

In the composition material, (1) the binder may be a dispersing medium for forming a dispersion of the electrically conductive particles in itself, or (2) the binder may coat each electrically conductive particle, or (3) the binder may constitute a dispersing medium for the electrically conductive particles when the binder is dispersed or dissolved in a proper solvent. A typical example of the above case (3) is water glass, and the water glass can be selected from Nos. 1 to 4 defined under Japan Industrial Standard (JIS) K1408 or products equivalent thereto. Nos. 1 to 4 refer to four grades based on different molar amounts (approximately 2 to 4 mols) of silicon dioxide ($SiO_2$) per one mol of sodium oxide ($Na_2O$) as a component of water glass, and greatly differ from one another in viscosity. When water glass is used in a lift-off process, therefore, it is preferred to select optimum water glass while taking into account various conditions such as a kind and a content of the electrically conductive particles to be dispersed in water glass, affinity to the peel layer 60, an aspect ratio of the opening portion 15, and the like, or it is preferred to prepare water glass equivalent to such a grade before use.

The binder is generally poor in electric conductivity. When the content of the binder is too large relative to the content of the electrically conductive particles in the composition material, therefore, the electron-emitting electrode 16B formed may show an increase in electric resistance value, and electron emission may not proceed smoothly. For example, in a composition material which is a dispersion of carbon-containing material particles as electrically conductive particles in water glass, the content of the carbon-containing material particles based on the total amount of the composition material is preferably determined to be in the range of approximately 30 to 95% by weight while taking into account properties such as an electric resistance value of the electron-emitting electrode 16B, a viscosity of the composition material and mutual adhesion of the electrically conductive particles. When the content of the carbon-containing material particles is selected from the above range, the electric resistance value of the electron-emitting electrode 16B formed can be sufficiently decreased, and the mutual adhesion of the carbon-containing material particles can be maintained under a good condition. However, when a mixture of carbon-containing material particles with alumina particles is used as electrically conductive particels, the mutual adhesion of the electrically conductive particles is liable to decrease, so that it is preferred to increase the content of the carbon-containing material particles depending upon the content of the alumina particles. In this case, the content of the carbon-containing material particles is particularly preferably 60% by weight or more. The composition material may contain a dispersing agent for stabilizing the dispersing state of the electrically conductive particles and additives such as a pH adjuster, a desiccant, a curing agent and an antiseptic. There may be used a composition material prepared by coating the electrically conductive particles with a binder to prepare a powder and dispersing the powder in a proper dispersing medium.

For example, when the crown-shaped electron-emitting electrode 16B has a diameter of approximately 1 to 20 $\mu$m and when carbon-containing material particles are used as electrically conductive particles, preferably, the particle diameter of the carbon-containing material particles is approximately in the range of from 0.1 $\mu$m to 1 $\mu$m. When the particle diameter of the carbon-contaning material particles is in the above range, an edge portion of the crown-shaped electron-emitting electrode 16B is imparted with sufficiently high mechanical strength, and the adhesion of the electron-emitting electrode 16B to the cathode electrode 12 comes to be excellent.

[Step-240]

Then, as shown in FIG. 1C, the peel layer 60 is removed. The peeling is carried out by immersion in a 2 weight % sodium hydroxide aqueous solution for 30 seconds. The peeling may be carried out under ultrasonic vibration. In this manner, the peel layer 60 and part of the electrically conductive composition layer 61 on the peel layer 60 are removed together, and only that portion of the electrically conductive material layer 61 which portion is on the exposed cathode electrode 12 in the bottom portion of the opening portion 15 remains. The above remaining portion constitutes the electron-emitting electrode 16B. The electron-emitting electrode 16B has a surface denting toward the central portion of the opening portion 15 and comes to have the form of a crown. FIGS. 14A and 14B show a state after [Step-240] is finished. FIG. 14B is a schematic perspective view of part of the field emission devices, and FIG. 14A is a schematic partial end view taken along line A—A in FIG. 14B. In FIG. 14B, part of the insulating layer 13 and part of the gate electrode 14 are cut out for showing the whole of the electron-emitting electrode 16B. It is sufficient to form approximately 5 to 100 electron-emitting electrodes 16B per overlapping region. For reliably exposing the electrically conductive particles on the surface of each electron-emitting electrode 16B, a binder exposed on the surface of each electron-emitting electrode 16B may be removed by etching.

[Step-250]

Then, the electron-emitting electrode 16B is calcined or sintered. The calcining or sintering is carried out in dry atmosphere at 400° C. for 30 mintues. The calcining or sintering temperature can be selected depending upon the kind of the binder contained in the composition material. For example, when the binder is an inorganic material such as water glass, it is sufficient to carry out heat treatment at a temperature at which the inorganic material can be calcined or sintered. When the binder is a thermosetting resin, the heat treatment can be carried out at a temperature at which the thermosetting resin can be cured. For maintaining mutual adhesion of the electrically conductive particles, however, the heat treatment is preferably carried out at a temperature at which the thermosetting resin is neither decomposed to excess nor carbonized. In either case, the heat treatment temperature is required to be a temperature at which neither damage nor a defect is caused on the gate electrode, the cathode electrode and the insulating layer. The heat treatment atmosphere is preferably an inert gas atmosphere for preventing an oxidation from causing an increase in the electric resistivity of the gate electrode and the cathode electrode and for preventing the gate electrode and the cathode electrode from suffering damage or defects. When a thermoplastic resin is used as a binder, no heat treatment may be required in some cases.

[Plane-Type Field Emission Device (No. 1)]

Figure 15A:
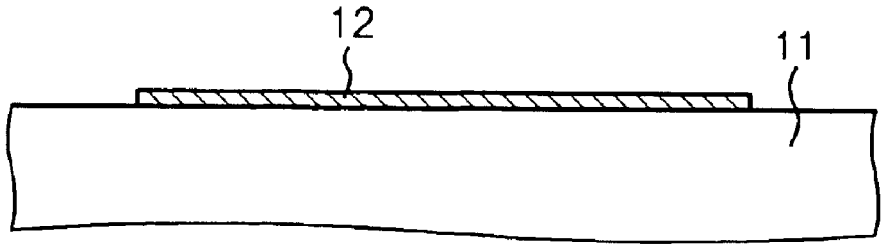
FIGS. 15A to 15C are schematic partial cross-sectional views of a first support member, etc., for explaining a method for producing a field emission device having a first structure constituted of a plane-type field emission device.
Figure 15B:
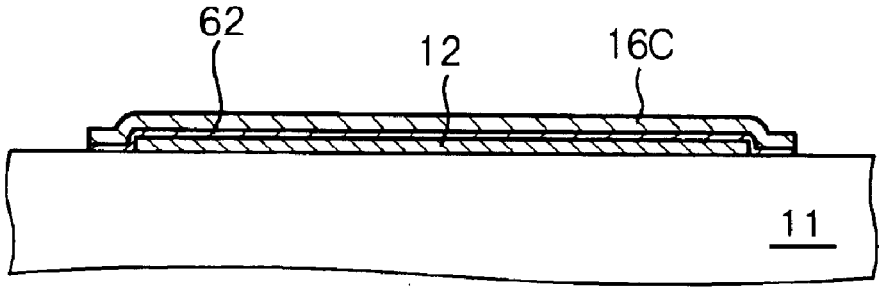
Figure 15C:
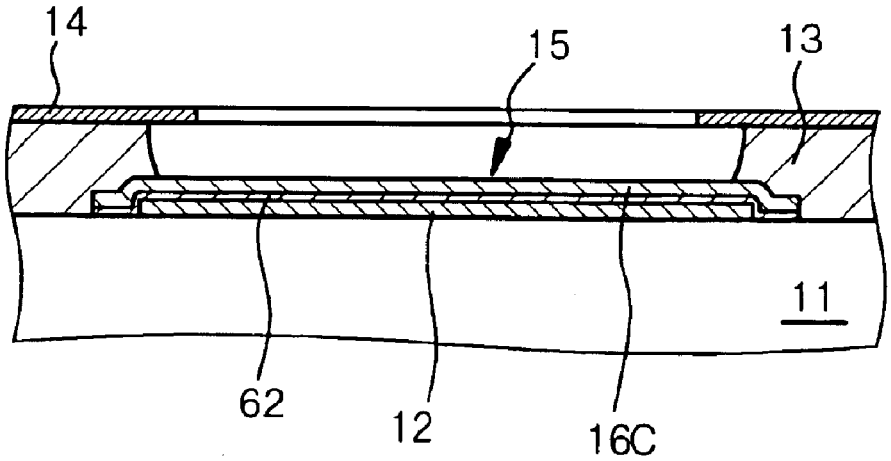

FIG. 15C shows a schematic partial cross-sectional view of a field emission device having the first structure of a plane-type field emission device. The plane-type field emission device comprises a cathode electrode 12 formed on a first support member 11 made, for example, of glass; an insulating layer 13 formed on the first support member 11 and the cathode electrode 12; a gate electrode 14 formed on the insulating layer 13; an opening portion 15 penetrating through the gate electrode 14 and the insulating layer 13; and a flat electron-emitting electrode 16C formed on a portion of the cathode electrode 12 which portion is positioned in the bottom portion of the opening portion 15. The electron-emitting electrode 16C is formed on the cathode electrode 12 in the form of a stripe extending in the direction perpendicular to the paper surface of FIG. 15C. Further, the gate electrode 14. extends leftward and rightward on the paper surface of FIG. 15C. The cathode electrode 12 and the gate electrode 14 are made of chromium. Specifically, the electron-emitting electrode 16C is constituted of a thin layer made of a graphite powder. A resistance layer 62 made of SiC is formed between the cathode electrode 12 and the electron-emitting electrode 16C for stabilizing the performance of the field emission device and attaining uniform electron emission characteristics. In the plane-type field emission device shown in FIG. 15C, the resistance layer 62 and the electron-emitting electrode 16C are formed all over the surface of the cathode electrode 12. However, the present invention shall not be limited to such a structure, and it is sufficient to form the electron-emitting electrode 16C at least in the bottom portion of the opening portion 15.

The method of producing the plane-type field emission device will be explained hereinafter with reference to FIGS. 15A, 15B and 15C showing the schematic partial cross-sectional views of the first support member, etc.

[Step-300]

First, an electrically conductive material layer made of chromium (Cr) for a cathode electrode is formed on the first support member 11 by a sputtering method and patterned by lithography and a dry etching method, whereby the cathode electrode 12 in the form of a stripe can be formed on the first support member 11 (see FIG. 15A). The cathode electrode 12 extends in the direction perpendicular to the paper surface of the Figures.

[Step-310]

Then, the electron-emitting electrode 16C is formed on the cathode electrode 12. Specifically, the resistance layer 62 made of SiC is formed on the entire surface by a sputtering method. Then, the electron-emitting electrode 16C made of a graphite powder coating is formed on the resistance layer 62 by a spin coating method and the electron-emitting electrode 16C is dried. Then, the electron-emitting electrode 16C and the resistance layer 62 are patterned by a known method (see FIG. 15B). The electron-emitting portion is constituted of such electron-emitting electrodes 16C.

[Step-320]

Then, the insulating layer 13 is formed on the entire surface. Specifically, the insulating layer 13 made of $SiO_2$ is formed on the electron-emitting electrode 16C and the first support member 11, for example, by a sputtering method. Alternatively, the insulating layer 13 may be formed by a method in which a glass paste is screen-printed or by a method in which a layer of $SiO_2$ is formed by a CVD method. Then, the gate electrode 14 in the form of a stripe is formed on the insulating layer 13.

[Step-330]

Then, after an etching mask is formed on the gate electrode 14 and the insulating layer 13, the opening portion 15 is formed through the gate electrode 14 and the insulating layer 13 to expose the electron-emitting electrode 16C in the bottom portion of the opening portion 15. Then, the etching mask is removed, and heat treatment is carried out at 400° C. for 30 minutes for removing an organic solvent in the electron-emitting electrode 16C, whereby the field emission device shown in FIG. 15C can be obtained. [Plane-Type Field Emission Device(No. 2)]

Figure 16A:
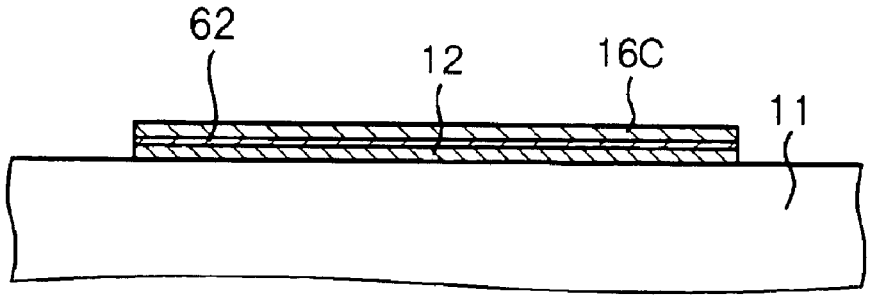
FIGS. 16A to 16C are schematic partial cross-sectional views of a first support member, etc., for explaining a method for producing a variant of the field emission device having a first structure constituted of a plane-type field emission device.
Figure 16B:
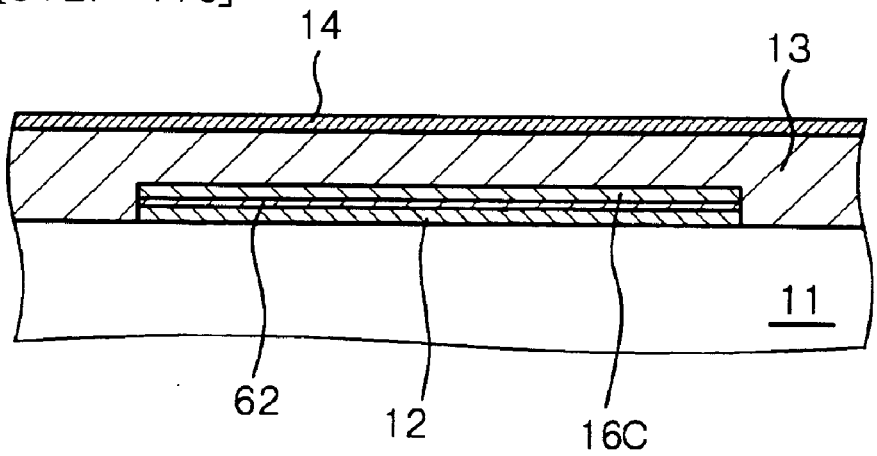
Figure 16C:
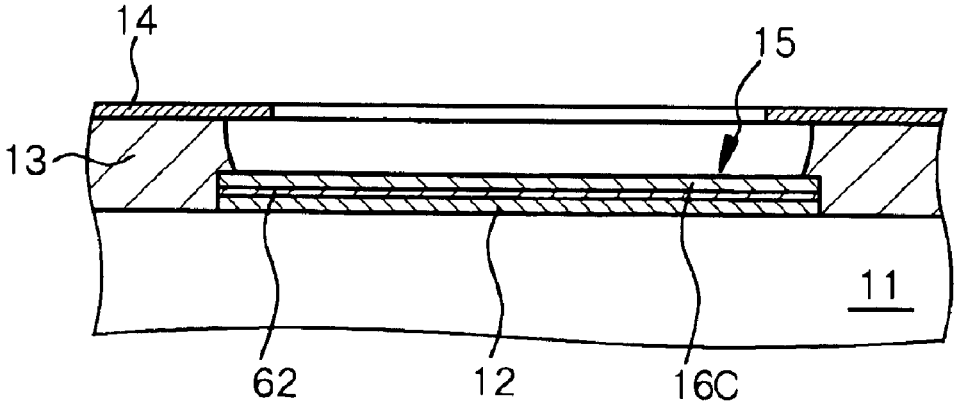

FIG. 16C shows a schematic partial cross-sectional view of a variant of the field emission device having the first structure of the plane-type field emission device. The plane-type field emission device shown in FIG. 16C differs from the plane-type field emission device shown in FIG. 15C in the structure of the electron-emitting electrode 16C to some extent. The method for producing such a field emission device will be explained below with reference to FIGS. 16A, 16B and 16C showing schematic partial cross-sectional views of the first support member, etc.

[Step-400]

First, the electrically conductive material layer for a cathode electrode is formed on the first support member 11. Specifically, a resist material layer (not shown) is formed on the entire surface of the first support member 11, and then the resist material layer is removed from a portion where the cathode electrode is to be formed. Then, the electrically conductive material layer made of chromium (Cr) for a cathode electrode is formed on the entire surface by a sputtering method. Further, the resistance layer 62 made of SiC is formed on the entire surface by a sputtering method, and a graphite powder coating layer is formed on the resistance layer 62 by a spin coating method and the graphite powder coating layer is dried. Then, the resist material layer is removed with a peeling solution. In this case, the electrically conductive material layer for a cathode electrode, the resistance layer 62 and the graphite powder coating layer, which are formed on the resist material layer, are also removed. In this manner, a structure in which the cathode electrode 12, the resistance layer 62 and the electron-emitting electrode 16C are stacked can be obtained (see FIG. 16A).

[Step-410]

Then, the insulating layer 13 is formed on the entire surface, and the gate electrode 14 in the form of a stripe is formed on the insulating layer 13 (see FIG. 16B). Then, the opening portion 15 is formed through the gate electrode 14 and the insulating layer 13 to expose the electron-emitting electrode 16C in the bottom portion of the opening portion 15 (see FIG. 16C). The electron-emitting portion is constituted of the electron-emitting electrode 16C formed on the surface of the cathode electrode 12 which surface is exposed in the bottom portion of the opening portion 15.

[Plane-Type Field Emission Device(No. 3)]

Figure 18A:
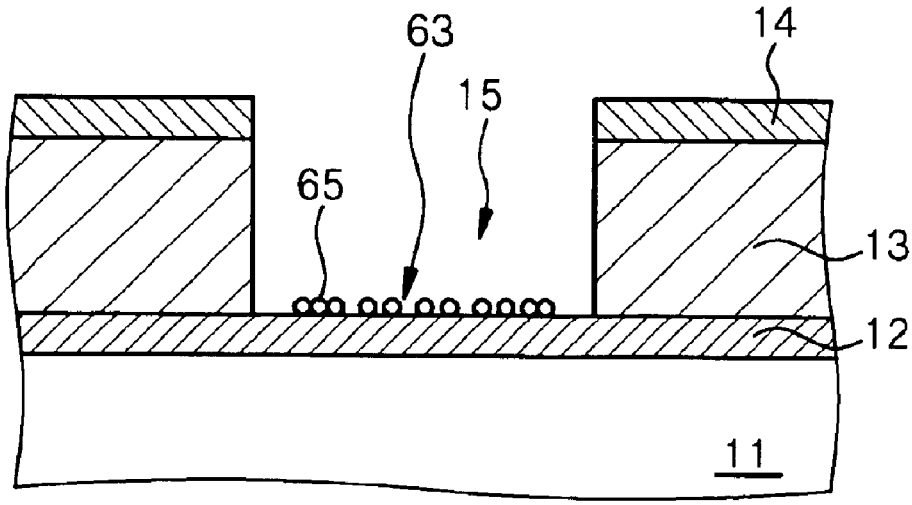
FIGS. 18A and 18B, following
Figure 18B:
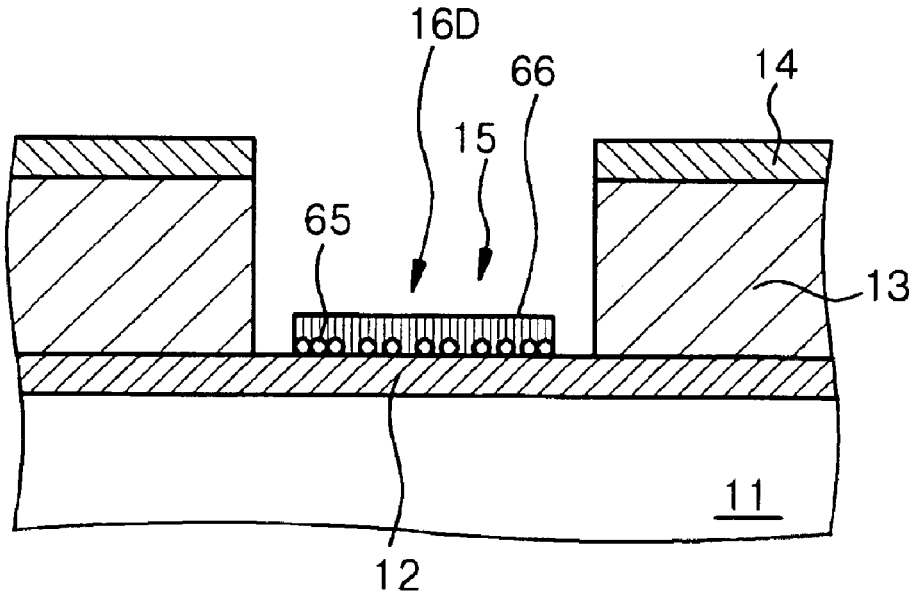

FIG. 18B shows a schematic partial end view of another variant of the electron emission device having the first structure of a plane-type field emission device. In this plane-type field emission device, an electron-emitting electrode 16D is constituted of a thin carbon film formed by a CVD method.

It is preferred to constitute the electron-emitting portion of the carbon film, since carbon (C) has a low work function and since a high emitted-electron current can be attained. For allowing the thin carbon film to emit electrons, it is sufficient to bring the thin carbon film into a state where the carbon film is placed in a proper electric field (for example, an electric field having an intensity of approximately $10^6$ volts/m).

When a thin carbon film such as diamond thin film is plasma-etched with oxygen gas using a resist layer as an etching mask, a deposition product of a $(CH_x)$— or $(CF_x)$— based carbon polymer is generated as a reaction byproduct in the etching reaction system. When a deposition product is generated in the etching reaction system in the plasma etching, generally, the deposition product is deposited on a side wall surface of the resist layer which side wall surface has a low ion incidence probability or is deposited on a processed end surface of a material being etched, to form a so-called side wall protective film, and it contributes to accomplishment of the form obtained by anisotropic processing of a material being etched. When oxygen gas is used as an etching gas, however, the side wall protective film made of the carbon polymer is removed by oxygen gas upon the formation thereof. Further, when oxygen gas is used as an etching gas, the resist layer is worn to a great extent. For these reasons, in the conventional oxygen plasma process of a diamond thin film, the pattern transfer difference of the diamond thin film from the mask is large, and an anisotropic processing is also difficult in many cases.

For overcoming the above problem, for example, there can be employed a constitution in which a thin carbon film selective-growth region is formed in or on the surface of the cathode electrode and an electron-emitting portion made of a thin carbon film is formed on the thin carbon film selective-growth region. That is, in the production of the above electron emission device, the cathode electrode is formed on the first support member, then the thin carbon film selective-growth region is formed in or on the surface of the cathode electrode and then the thin carbon film (corresponding to the electron-emitting portion) is formed on the thin carbon film selective-growth region. The step of forming the thin carbon film selective-growth region in or on the surface of the cathode electrode will be referred to as a thin carbon film selective-growth region formation step.

The above thin carbon film selective-growth region is preferably that portion of the cathode electrode onto which portion metal particles adheres, or that portion of the cathode electrode on which portion a thin metal layer is formed. For making the selective growth of the thin carbon film on the thin carbon film selective-growth region more reliable, desirably, the surface of the thin carbon film selective-growth region has sulfur (S), boron (B) or phosphorus (P) adhering thereto. It is considered that the above materials work as a kind of a catalyst, and the presence of such materials can improve the carbon film more in the property of selective growth. It is sufficient that the thin carbon film selective-growth region should be formed in or on the surface of the portion of the cathode electrode which portion is positioned in the bottom portion of the opening portion. The thin carbon film selective-growth region may be formed so as to extend from the portion of the cathode electrode which portion is positioned in the bottom portion of the opening portion to a surface of a portion of the cathode electrode which portion is located in other than the bottom portion of the opening portion. Further, the thin carbon film selective-growth region may be formed on the entirety of the surface of the portion of the cathode electrode which portion is positioned in the bottom portion of the opening portion, or it may be formed in part of the above portion.

Preferably, the thin carbon film selective-growth region formation step comprises the step of allowing metal particles to adhere onto, or forming a metal thin layer on, the surface of the portion of the cathode electrode (sometimes, to be referred to as "cathode electrode surface) on which portion the thin carbon film selective-growth region is to be formed, whereby there is formed the thin carbon film selective-growth region constituted of the portion of the cathode electrode which portion has the surface onto which the metal particles adhere or on which the metal thin layer is formed. In this case, for making more reliable the selective growth of the carbon film on the thin carbon film selective-growth region, desirably, sulfur (S), boron (B) or phosphorus (P) is allowed to adhere onto the surface of the thin carbon film selective-growth region, whereby the carbon film can be more improved in the property of selective growth. The method for allowing sulfur, boron or phosphorus to adhere onto the surface of the thin carbon film selective-growth region includes, for example, a method in which a compound layer composed of a compound containing sulfur, boron or phosphorus is formed on the surface of the thin carbon film selective-growth region, and then, the compound layer is heat-treated to decompose the compound constituting the compound layer, to retain sulfur, boron or phosphorus on the surface of the thin carbon film selective-growth region. The sulfur-containing compound includes thionaphthene, thiophthene and thiophene. The boron-containing compound includes triphenylboron. The phosphorus-containing compound includes triphenylphosphine.

Otherwise, for making more reliable the selective growth of the carbon film on the thin carbon film selective-growth region, after the metal particles are allowed to adhere onto, or the metal thin layer is formed on, the cathode electrode surface, it is preferred to remove a metal oxide (so-called natural oxide film) on the surface of each metal particle or on the surface of the metal thin layer. The metal oxide on the surface of each metal particle or on the surface of the metal thin layer is preferably removed, for example, by plasma reduction treatment in a hydrogen gas atmosphere according to a microwave plasma method, a transformer-coupled plasma method, an inductively coupled plasma method, an electron cyclotron resonance plasma method or an RF plasma method; by sputtering in an argon gas atmosphere; or by washing, for example, with an acid such as hydrofluoric acid or a base. When the step of allowing sulfur, boron or phosphorus to adhere onto the surface of the thin carbon film selective-growth region, or the step of removing the metal oxide on the surface of each metal particle or on the surface of the metal thin layer is included, preferably, these steps are carried out after the formation of the opening portion in the insulating layer and before the formation of the thin carbon film on the thin carbon film selective-growth region.

The method for allowing the metal particles to adhere onto the cathode electrode surface for obtaining the thin carbon film selective-growth region includes, for example, a method in which, in a state where a region other than the region in the cathode electrode where the thin carbon film selective-growth region is to be formed is covered with a proper material (for example, a mask layer), a layer composed of a solvent and the metal particles is formed on the surface of the portion of the cathode electrode where the thin carbon film selective-growth region is to be formed, and then, the solvent is removed while retaining the metal particles. Alternatively, the step of allowing the metal particles to adhere onto the cathode electrode surface includes, for example, a method in which, in a state where a region other than the region in the cathode electrode where the thin carbon film selective-growth region is to be formed is covered with a proper material (for example, a mask layer), metal compound particles containing metal atoms constituting the metal particles are allowed to adhere onto the cathode electrode surface, and then the metal compound particles are heated to decompose them, to obtain the thin carbon film selective-growth region constituted of the portion of the cathode electrode which portion has the surface onto which the metal particles adhere. In the above method, specifically, a layer composed of a solvent and metal compound particles is formed on the surface of the portion of the cathode electrode where the thin carbon film selective-growth region is to be formed, and the solvent is removed while retaining the metal compound particles. The above metal compound particles are preferably composed of at least one material selected from the group consisting of halides (for example, iodides, chlorides, bromides, etc.), oxides and hydroxides of the metal for constituting the metal particles. In the above methods, the material (for example, mask layer) covering the region other than the region in the cathode electrode where the thin carbon film selective-growth region is to be formed is removed at a proper stage.

The method for forming the metal thin layer on the cathode electrode surface for obtaining the thin carbon film selective-growth region includes, for example, known methods such as an electroplating method, an electroless plating method, a chemical vapor deposition method (CVD method) including an MOCVD method, a physical vapor deposition method (PVD method), etc., which are carried out in a state where a region other than the region in the cathode electrode where the thin carbon film selective-growth region is to be formed is covered with a proper material. The physical vapor deposition method includes (a) vacuum deposition methods such as an electron beam heating method, a resistance heating method and a flash deposition method, (b) a plasma deposition method, (c) sputtering methods such as a bipolar sputtering method, a DC sputtering method, a DC magnetron sputtering method, a high-frequency sputtering method, a magnetron sputtering method, an ion beam sputtering method and a bias sputtering method, and (d) ion plating methods such as a DC (direct current) method, an RF method, a multi-cathode method, an activating reaction method, an electric field deposition method, a high-frequency ion plating method and a reactive ion-plating method.

The above metal particles or the metal thin layer are/is preferably composed of at least one metal selected from the group consisting of molybdenum (Mo), nickel (Ni), titanium (Ti), chromium (Cr), cobalt (Co), tungsten (w), zirconium (Zr), tantalum (Ta), iron (Fe), copper (Cu), platinum (Pt) and zinc (Zn).

The above thin carbon film includes a graphite thin film, an amorphous carbon thin film, a diamond-like carbon thin film and a fullerene thin film. The method for forming the thin carbon film includes CVD methods based on a microwave plasma method, a transformer-coupled plasma method, an inductively coupled plasma method, an electron cyclotron resonance plasma method or an RF plasma method and a CVD method using a diode parallel plate plasma enhanced CVD system. The form of the thin carbon film includes the form of a thin film, and it also includes the form of a carbon whisker and the form of a carbon nano-tube (including hollow and solid tubes).

The cathode electrode may have any structure such as a single-layer structure of an electrically conductive material layer or a three-layered structure having a lower electrically conductive material layer, a resistance layer formed on the lower electrically conductive material layer and an upper electrically conductive material layer formed on the resistance layer. In the latter case, the thin carbon film selective growth region is formed on a surface of the upper electrically conductive material layer. The above-formed resistance layer works to attain uniform electron emission properties of the electron-emitting electrodes.

One example of the method for producing the plane-type electron emission device will be explained hereinafter with reference to schematic partial end views of the first support member, etc., shown in FIGS. 17A, 17B, 18A and 18B.

[Step-500]

First, an electrically conductive material layer for a cathode electrode is formed on the first support member 11 made, for example, of glass substrate. Then, the electrically conductive material layer is patterned by known lithography and a known RIE method, to form the cathode electrode 12 having the form of a stripe on the first support member 11. The cathode electrode 12 in the form of a stripe extends leftward and rightward on the paper surface of the drawing. The cathode electrode 12 is made, for example, of an approximately 0.2 $\mu$m thick chromium (Cr) layer formed by a sputtering method.

[Step-510]

Then, the insulating layer 13 is formed on the entire surface, specifically, on the first support member 11 and the cathode electrode 12.

[Step-520]

Figure 17A:
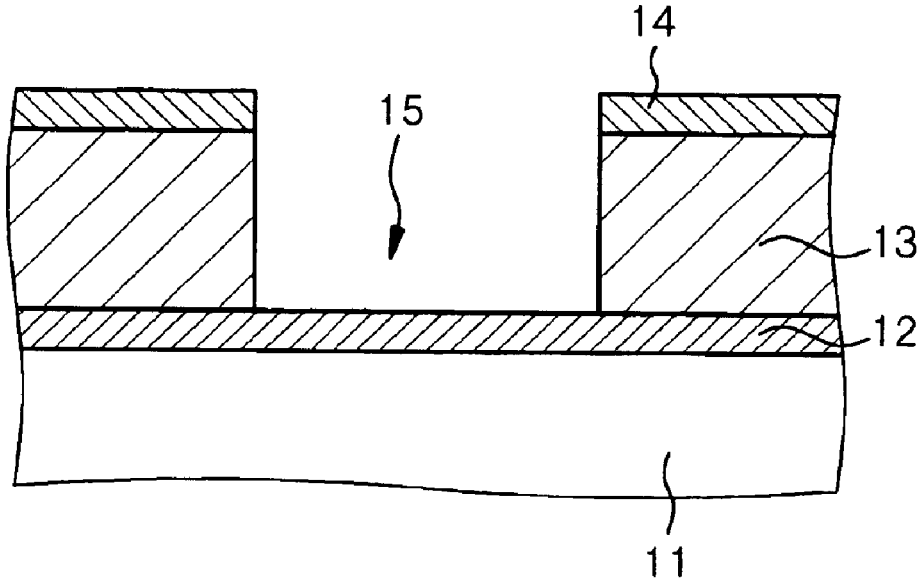
FIGS. 17A and 17B are schematic partial end views of a first support member, etc., for explaining a method for producing another variant of the field emission device having a first structure constituted of a plane-type field emission device.
Figure 17B:
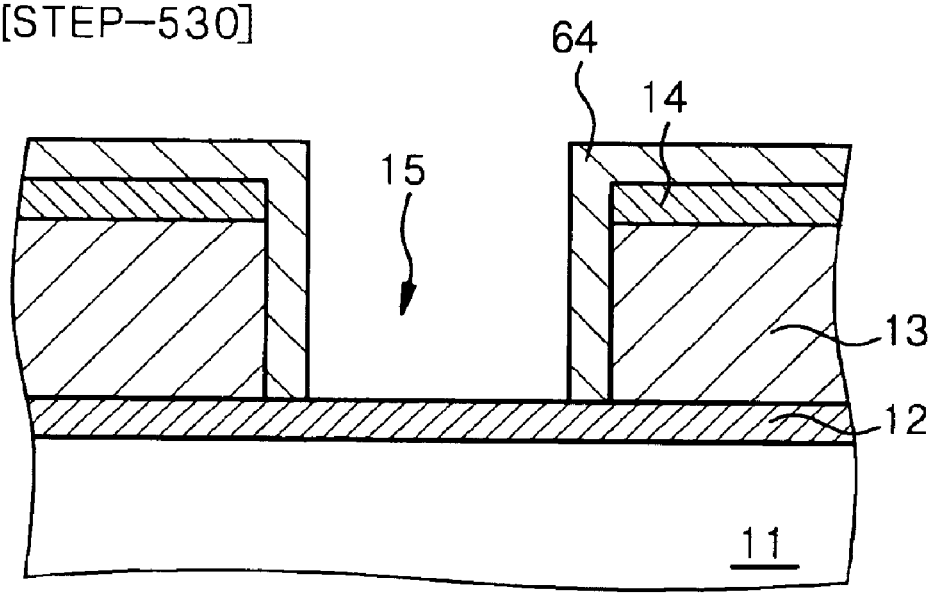

Then, the gate electrode 14 having the form of a stripe is formed on the insulating layer 13, and then the opening portion 15 is formed in the gate electrode 14 and the insulating layer 13 to expose the cathode electrode 12 in the bottom portion of the opening portion 15 (see FIG. 17A). The gate electrode 14 in the form of a stripe extends perpendicularly to the paper surface of the drawing. When viewed as a plan view, the opening portion 15 has the form of a circle having a diameter of 1 to 30 $\mu$m. It is sufficient to form such opening portions 15 in the quantity of approximately 1 to 3000 per pixel (overlapping region).

[Step-530]

Then, the electron-emitting electrode 16D is formed on the cathode electrode 12 exposed in the bottom portion of the opening portion 15. Specifically, the thin carbon film selective-growth region 63 is formed on the surface of the portion of the cathode electrode 12 which portion is positioned in the bottom portion of the opening portion 15. For this purpose, first, a mask layer 64 is formed so as to expose the surface of the cathode electrode 12 in the central portion of the bottom portion of the opening portion 15 (see FIG. 17B). Specifically, a resist material layer is formed on the entire surface including the inner surface of the opening portion 15 by a spin coating method, and then a hole is formed in the resist material layer positioned in the central portion of the bottom portion of the opening portion 15 by lithography, whereby the mask layer 64 can be obtained. The mask layer 64 covers part of the cathode electrode 12 which part is positioned in the bottom portion of the opening portion 15, the side wall of the opening portion 15, the gate electrode 14 and the insulating layer 13. While the thin carbon film selective-growth region is to be formed on the surface of the portion of the cathode electrode 12 which portion is positioned in the central portion of the bottom portion of the opening portion 15 in a step to come thereafter, the above mask layer can reliably prevent short-circuiting between the cathode electrode 12 and the gate electrode 14 with metal particles.

Then, metal particles are allowed to adhere onto the mask layer 64 and the exposed surface of the cathode electrode 12. Specifically, a dispersion prepared by dispersing nickel (Ni) fine particles in a polysiloxane solution (using isopropyl alcohol as a solvent) is,applied to the entire surface by a spin coating method, to form a layer composed of the solvent and the metal particles on the surface of the portion of the cathode electrode 12 on which portion the thin carbon film selective-growth region 63 is to be formed. Then, the mask layer 64 is removed, and the solvent is removed by heating the above layer up to approximately 400° C., to retain the metal particles 65 on the exposed surface of the cathode electrode 12, whereby the thin carbon film selective-growth region 63 can be obtained (see FIG. 18A). The above polysiloxane works to fix the metal particles 65 to the exposed surface of the cathode electrode 12 (so-called adhesive function).

[Step-540]

Then, the thin carbon film 66 having a thickness of approximately 0.2 $\mu$m is formed on the thin carbon film selective-growth region 63, to obtain the electron-emitting electrode 16D. FIG. 18B shows the thus-obtained state. Table 1 shows a condition of forming the thin carbon film 66 by a microwave plasma CVD method.

TABLE 1

| [Condition of forming thin carbon film] | |
|---|---|
| Gas used | $CH_4/H_2$ = 100/10 SCCM |
| Pressure | $1.3 \times 10^3$ Pa |
| Microwave power | 500 W (13.56 Mz) |
| Film forming temperature | 500° C. |

[Flat-Type Field Emission Device (No. 1)]

Figure 19A:
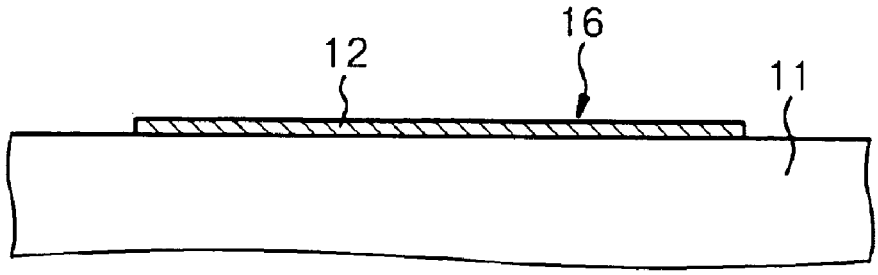
FIGS. 19A to 19C are schematic partial cross-sectional views of a first support member, etc., for explaining a method for producing a field emission device having a second structure constituted of a flat-type field emission device.
Figure 19B:
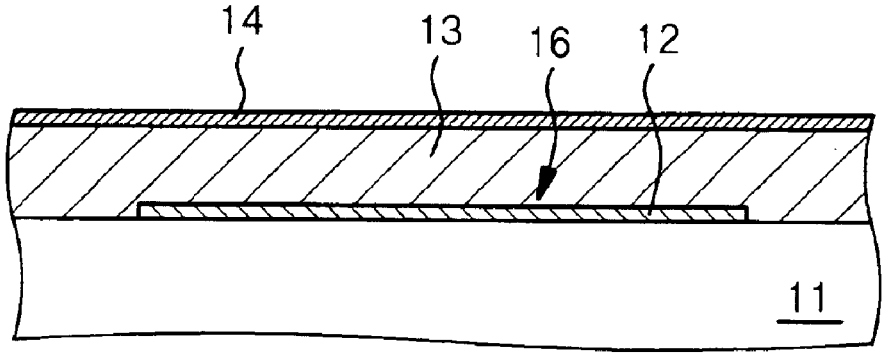
Figure 19C:
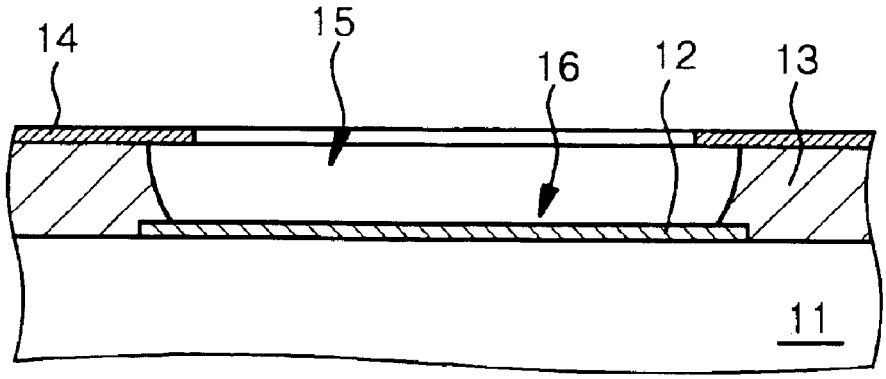

FIG. 19C shows a schematic partial cross-sectional view of a field emission device having the second structure of a flat-type field emission device. The flat-type field emission device comprises a stripe-shaped cathode electrode 12 formed on a first support member 11 made, for example, of glass; an insulating layer 13 formed on the first support member 11 and the cathode electrode 12; a stripe-shaped gate electrode 14 formed on the insulating layer 13; and an opening portion 15 which penetrates the gate electrode 14 and the insulating layer 13 and has the cathode electrode 12 exposed in the bottom portion thereof. The cathode electrode 12 extends in the direction perpendicular to the paper surface of FIG. 19C, and the gate electrode 14 extends rightward and leftward on the paper surface of the FIG. 19C. The cathode electrode 12 and the gate electrode 14 are made of chromium (Cr), and the insulating layer 13 is made of $SiO_2$. A portion of the cathode electrode 12 which portion is exposed in the bottom portion of the opening portion 15 corresponds to an electron-emitting portion 16.

The method for producing the flat-type field emission device will be explained hereinafter with reference to FIGS.

19A, 19B and 19C showing schematic partial cross-sectional views of the first support member, etc.

[Step-600]

First, the cathode electrode 12, which is to work as the electron-emitting portion 16, is formed on the first support member 11. Specifically, an electrically conductive material layer made of chromium (Cr) for constituting a cathode electrode is formed on the first support member 11 by a sputtering method, and then the electrically conductive material layer for constituting a cathode electrode is patterned by lithography and a dry etching method, whereby the cathode electrode 12 in the form of a stripe can be formed on the first support member 11 (see FIG. 19A). The cathode electrode 12 extends in the direction perpendicular to the paper surface of the Figures.

[Step-610]

Then, the insulating layer 13 made of $SiO_2$ is formed on the first support member 11 and the cathode electrode 12, for example, by a CVD method. Alternatively, the insulating layer 13 can be formed from a glass paste according to a screen printing method.

[Step-620]

The gate electrode 14 in the form of a stripe is formed on the insulating layer 13. Specifically, an electrically conductive material layer made of chromium is formed on the entire surface by a sputtering method, and then the electrically conductive material layer is patterned according to lithography and a dry etching method, whereby the stripe-shaped gate electrode 14 can be formed (see FIG. 19B). The gate electrode 14 extends leftward and rightward on the paper surface of the Figures. The stripe-shaped gate electrode 14 can be formed directly on the insulating layer 13, for example, by a screen printing method.

[Step-630]

Then, the opening portion 15 is formed in the gate electrode 14 and the insulating layer 13 to expose the cathode electrode 12 in the bottom portion of the opening portion 15. The cathode electrode 12 is to work as the electron-emitting portion 16 (see FIG. 19C).

[Flat-Type Field Emission Device (No. 2)]

Figure 20A:
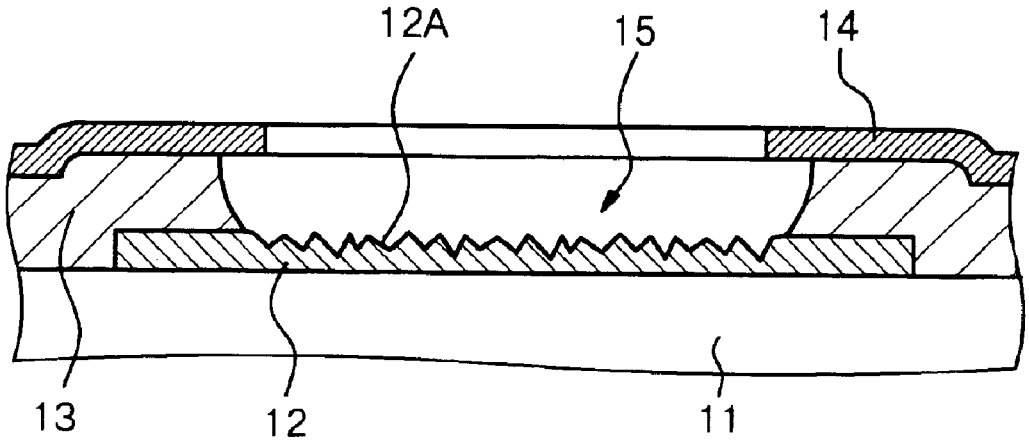
FIGS. 20A and 20B are schematic partial cross-sectional views of variants of the field emission device having a second structure constituted of a flat-type field emission device.

The flat-type field emission device shown in FIG. 20A as a schematic partial cross-sectional view differs from the flat-type field emission device shown in FIG. 14C in that a fine convexo-concave portion 12A is formed in the surface (corresponding to the electron-emitting portion 16) of the cathode electrode 12 which surface is exposed in the bottom portion of the opening portion 15. The above flat-type field emission device can be produced by the following method.

[Step-700]

In the same manner as in [Step-600] to [Step-620], the stripe-shaped cathode electrode 12 is formed on the first support member 11, the insulating layer 13 is formed on the entire surface, and then the stripe-shaped gate electrode 14 is formed on the insulating layer 13. That is, a tungsten layer having a thickness of approximately 0.2 $\mu$m is formed on the first support member 11 made, for example, of glass substrate by a sputtering method, and the tungsten layer is patterned in the form of a stripe according to conventional procedures, to form the cathode electrode 12. Then, the insulating layer 13 is formed on the first support member 11 and the cathode electrode 12. The insulating layer 13 can be formed by a CVD method using TEOS (tetraethoxysilane) as a source gas. Further, an approximately 0.2 $\mu$m thick electrically conductive material layer made of chromium is formed on the insulating layer 13 and patterned in the form of a stripe, to form the gate electrode 14. A state where the above process is thus far completed is substantially as shown in FIG. 19B.

[Step-710]

Then, in the same manner as in [Step-630], the opening portion 15 is formed in the gate electrode 14 and the insulating layer 13, to expose the cathode electrode 12 in the bottom portion of the opening portion 15. Then, a fine convexo-concave portion 12A is formed in a portion of the cathode electrode 12 which portion is exposed in the bottom portion of the opening portion 15. When the fine convexo-concave portion 12A is formed, a drying etching using $SF_6$ as an etching gas is carried out by an RIE method under a condition where an etching rate of grain boundaries comes to be greater than that of tungsten crystal particles constituting the cathode electrode 12. As a result, the fine convexo-concave portion 12A having dimensions nearly reflecting the crystal grain diameter of the tungsten can be formed.

In the above flat-type field emission device, an intense electric field from the gate electrode 14 is applied to the fine convexo-concave portion 12A of the cathode electrode 12, more specifically to convex portions of the fine convexo-concave portion 12A. In this case, the electric field applied on the convex portions is intense as compared with a case where the surface of the cathode electrode 12 is flat and smooth, so that electrons are efficiently emitted from the convex portions due to a quantum tunnel effect. It can be therefore expected that the display into which the above flat-type field emission devices are incorporated is improved in brightness as compared with the flat-type field emission device having simply a flat and smooth cathode electrode 12 exposed in the bottom portion of the opening portion 15. In the flat-type field emission device shown in FIG. 20A, therefore, a sufficient current density of emitted electrons can be obtained even if the potential difference between the gate electrode 14 and the cathode electrode 12 is relatively small, and higher brightness of the display can be achieved. In other words, the gate voltage required can be decreased if the levels of the brightness are the same, so that the power consumption can be lowered.

In the above embodiment, the opening portion 15 is formed by etching the insulating layer 13 and then the fine convexo-concave portion 12A is formed in the cathode electrode 12 by an anisotropic etching method. However, the fine convexo-concave portion 12A can be also simultaneously formed by the etching which is carried out for forming the opening portion 15. That is, when the insulating layer 13 is etched, an anisotropic etching condition which is expected to have ion-sputtering functions to some extent is employed, and the etching is continued until after the opening portion 15 having a perpendicular wall is formed, whereby the fine convexo-concave portion 12A can be formed in that portion of the cathode electrode 12 which is exposed in the bottom portion of the opening portion 15. Then, the insulating layer 13 can be isotropically etched.

In a step similar to [Step-600], an electrically conductive material layer made of tungsten for a cathode electrode is formed on the first support member 11 by a sputtering method, and then, the electrically conductive material layer for a cathode electrode is patterned by lithography and a dry etching method. Then, the fine convexo-concave portion 12A is formed in a surface of the electrically conductive material layer for a cathode electrode, and steps similar to [Step-610] to [Step-630] are carried out, whereby a field emission device similar to one shown in FIG. 20A can be produced.

Otherwise, in a step similar to [Step-600], the electrically conductive material layer made of tungsten for a cathode electrode is formed on the first support member 11 by a sputtering method, and then, the fine convexo-concave portion 12A is formed in a surface of the electrically conductive material layer for a cathode electrode. Then, the electrically conductive material layer for a cathode electrode is patterned by lithography and a dry etching method, and steps similar to [Step-610] to [Step-630] are carried out, whereby a field emission device similar to one shown in FIG. 20A can be produced.

Figure 20B:
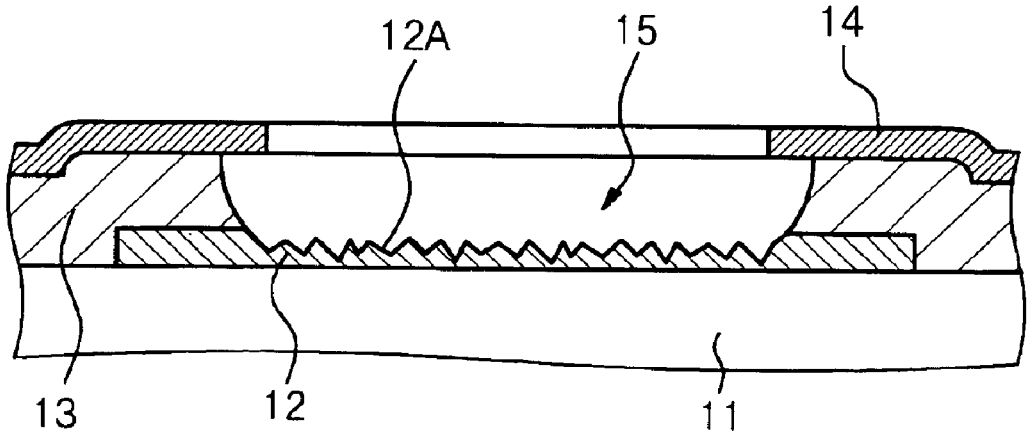

FIG. 20B shows a variant of the field emission device shown in FIG. 20A. In the field emission device shown in FIG. 20B, the average height position of peaks of the fine convexo-concave portion 12A is present at a level lower than the lower surface of the insulating layer 13 on the first support member 11 side (that is, lowered). For producing such a field emission device, the dry etching in a step similar to [Step-710] can be continued for a longer period of time. In such a constitution, the electric field intensity near the central portion of the opening portion 15 can be further increased.

Figure 21:
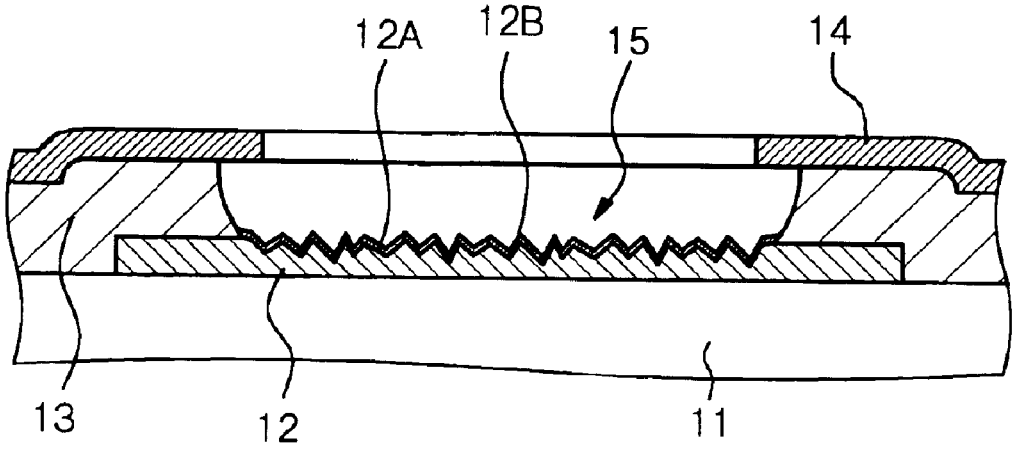
FIG. 21 is a schematic partial cross-sectional view of another variant of the field emission device having a second structure constituted of a flat-type field emission device.

FIG. 21 shows a flat-type field emission device in which a coating layer 12B is formed on the surface of the cathode electrode 12 corresponding to the electron-emitting portion 16 (more specifically, at least on the fine convexo-concave portion 12A).

Preferably, the above coating layer 12B is made of a material having a smaller work function Φ than a material constituting the cathode electrode 12. The material for the coating layer 12B can be determined depending upon the work function of a material constituting the cathode electrode 12, a potential difference between the gate electrode 14 and the cathode electrode 12, the current density of emitted electrons to be required and so on. The material for the coating layer 12B includes amorphous diamond. When the coating layer 12B is made of amorphous diamond, the current density of emitted electrons required for a display can be obtained at an electric field of $5\times10^7$ V/m or less.

The thickness of the coating layer 12B is determined to such an extent that the coating layer 12B can reflect the fine convexo-concave portion 12A. That is because it is meaningless to form the fine convexo-concave portion 12A if the concave portions of the fine convexo-concave portion 12A are filled with the coating layer 12B to flatten the surface of the electron-emitting portion. Therefore, when the fine convexo-concave portion 12A is formed while reflecting, for example, crystal grain diameters of the electron-emitting portion, preferably, the thickness of the coating layer 12B is approximately 30 to 100 nm, although the thickness differs depending upon dimensions of the fine convexo-concave portion 12A. When the average height position of peaks of the fine convexo-concave portion 12A is lowered to a level below the lower surface position of the insulating layer, to be exact, it is more preferred to lower the average height position of peaks of the coating layer 12B to a level below the lower surface position of the insulating layer.

Specifically, after [Step-710], the coating layer 12B made of amorphous diamond can be formed on the entire surface, for example, by a CVD method. The coating layer 12B is also deposited on an etching mask (not shown) formed on the gate electrode 14 and the insulating layer 13. This deposit portion is removed concurrently with the removal of the etching mask. The coating layer 12B can be formed by a CVD method using, for example, $CH_4/H_2$ mixed gas or $CO/H_2$ mixed gas as a source gas, and the coating layer 12B made of amorphous diamond is formed by thermal decomposition of the compound containing carbon.

Otherwise, in a step similar to [Step-600], an electrically conductive material layer made of tungsten for a cathode electrode is formed on the first support member 11 by a sputtering method, then, the electrically conductive material layer for a cathode electrode is patterned by lithography and a dry etching method, and then, the fine convexo-concave portion 12A is formed in a surface of the electrically conductive material layer for a cathode electrode. Then, the coating layer 12B is formed, and then, procedures similar to those in [Step-610] to [Step-630] are carried out, whereby the field emission device shown in FIG. 21 can be produced.

Otherwise, in a step similar to [Step-600], an electrically conductive material layer made of tungsten for a cathode electrode is formed on the first support member 11 by a sputtering method, then, the fine convexo-concave portion 12A is formed in a surface of the electrically conductive material layer for a cathode electrode, and then, the coating layer 12B is formed. Then, the coating layer 12B and the electrically conductive material layer for a cathode electrode are patterned by lithography and a dry etching method, and procedures similar to those in [Step-610] to [Step-630] are carried out, whereby the field emission device shown in FIG. 21 can be produced.

Otherwise, the material for constituting the coating layer can be properly selected from materials which have a larger secondary electron gain δ than an electrically conductive material which is to constitute the cathode electrode.

The coating layer may be formed on the electron-emitting portion 16 (on the surface of the cathode electrode 12) of the flat-type field emission device shown in FIG. 19C. In this case, after [Step-630], the coating layer 12B can be formed on the surface of the cathode electrode 12 which surface is exposed in the bottom portion of the opening portion 15. Otherwise, in [Step-600], for example, an electrically conductive material layer for a cathode electrode is formed on the first support member 11, then, the coating layer 12B is formed on the electrically conductive material layer for a cathode electrode, and these layers are patterned by lithography and a dry etching method.

[Crater-Type Field Emission Device (No. 1)]

Figure 24A:
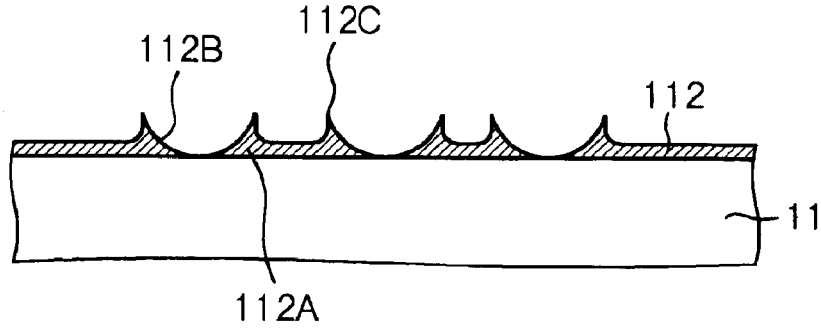
FIGS. 24A and 24B, following
Figure 24B:
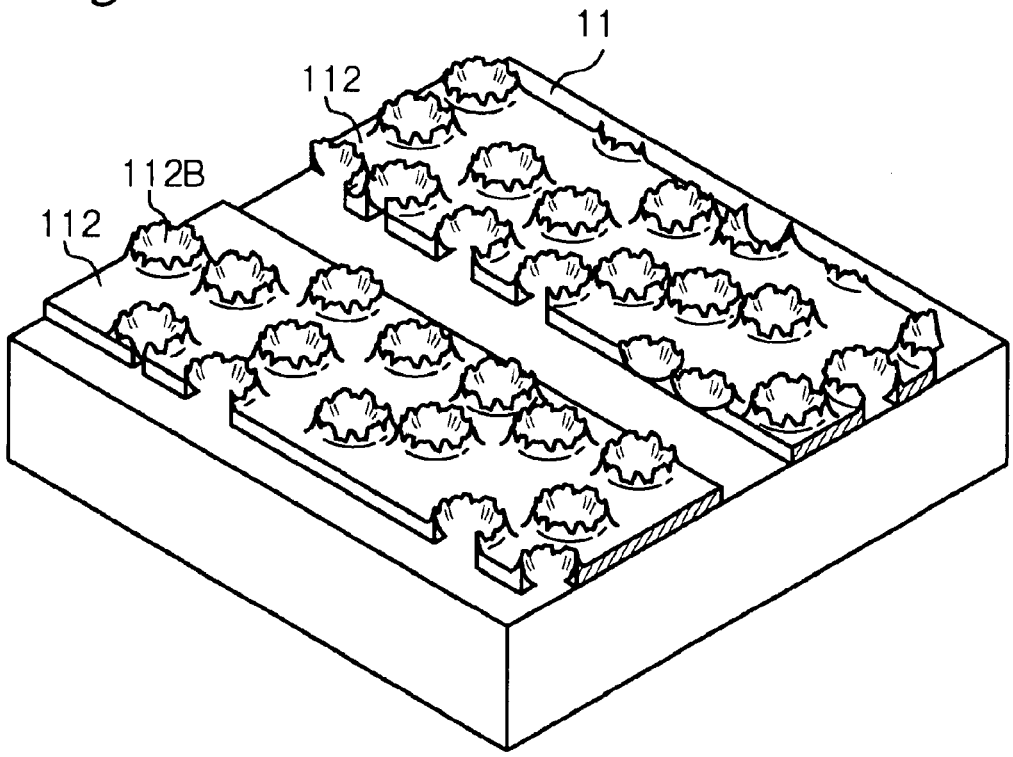
Figure 25A:
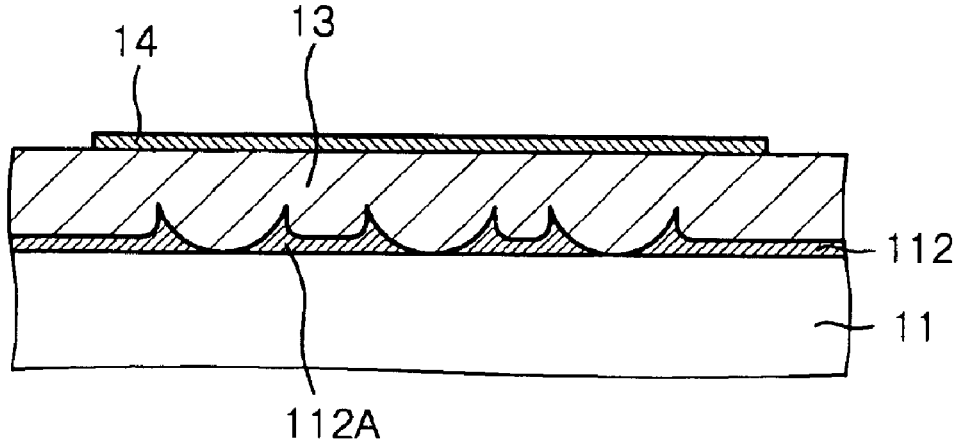
FIGS. 25A and 25B, following
Figure 25B:
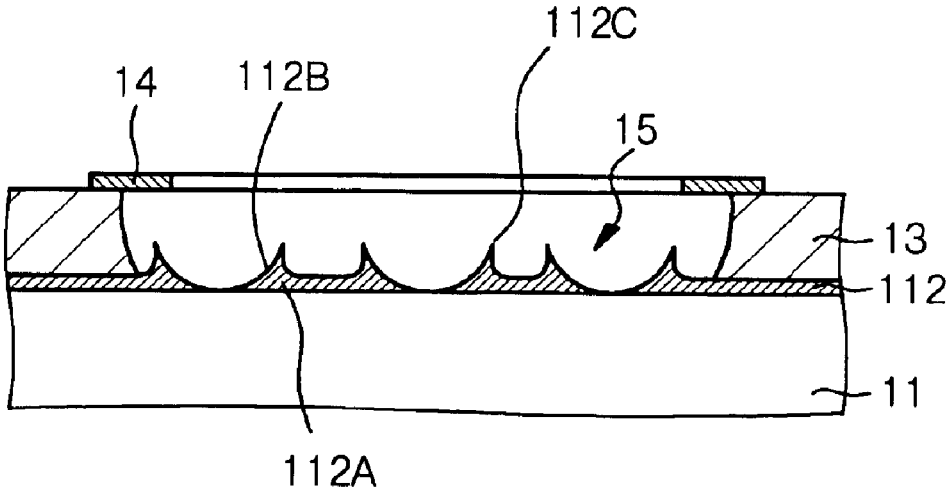

FIG. 25B shows a schematic partial cross-sectional view of the crater-type field emission device. In the crater-type field emission device, a cathode electrode 112 having a plurality of projection portions 112A for emitting electrons and concave portions 112B each of which is surrounded by the projection portion 112A is provided on the first support member 11. FIG. 24B shows a schematic perspective view of the crater-type field emission device from which an insulating layer 13 and a gate electrode 14 are removed.

While the form of each concave portion is not specially limited, each concave portion typically has a nearly spherical surface, which is related to the following fact. In the production of the above crater-type field emission device, spheres are used, and part of, each sphere is reflected in,the formation of each concave portion 112B. When each concave portion 112B has a nearly spherical surface, the projection portion 112A surrounding the concave portion 112B is ringed or circular, and in this case, the concave portion 112B and the projection portion 112A as a whole have a crater-like or caldera-like form. The projection portion 112A is for emitting electrons, so that the top end portion 112C of each particularly preferably is sharp in view of improving electron emission efficiency. The profile of top end portion 112C of each projection portion 112A may have an irregular convexo-concave form or may be flat. The layout of the projection portions 112A per pixel may be regular or random. Each concave portion 112B may be surrounded by the projection portion 112A continued along the circumferential direction of the concave portion 112B, and in some cases, each concave portion 112B may be surrounded by the projection portion 112A discontinuous along the circumferential direction of the concave portion 112B.

In the method of producing the above crater-type field emission device, more specifically, the step of forming the cathode electrode in the form of a stripe on the first support member comprises the steps of forming a cathode electrode in the form of a stripe on the first support member, the cathode electrode covering a plurality of spheres; and removing the spheres to remove a portion of the cathode electrode which portion covers the spheres, to form the cathode electrode having a plurality of projection portions for emitting electrons and concave portions each of which is surrounded by the projection portion and reflects part of the sphere.

Preferably, the spheres are removed by state change and/or chemical change of the spheres. The state change and/or chemical change of the sphere refer(s) to changes such as expansion, sublimation, foaming, gas generation, decomposition, combustion and carbonization and combinations of these. For example, when the spheres are made of an organic material, more preferably, the spheres are removed by combustion. The removal of the spheres and the removal of portion of the cathode electrode which portion covers the sphere are not necessarily required to take place concurrently, or the removal of the spheres and the removal of portions of the cathode electrode, the insulating layer and the gate electrode which portions cover the sphere are not necessarily required to take place concurrently. For example, when part of the spheres remain after the portion of the cathode electrode which portion covers the sphere is removed or after the above portion and the portions of the insulating layer and the gate electrode are removed, the remaining spheres can be removed later.

In particular, when the spheres are made of an organic material and when the spheres are combusted, for example, carbon monoxide, carbon dioxide and vapor steam are generated to increase a pressure in a closed space near the sphere, and the cathode electrode near the sphere bursts when a pressure durability limit is exceeded. The portion of the cathode electrode which portion covers the sphere is dissipated by the force of the burst, to form the projection portion and the concave portion, and the sphere is also removed. Otherwise, when the spheres are, for example, combusted, the cathode electrode, the insulating layer and the gate electrode burst according to a similar mechanism when a pressure durability limit is exceeded. The portions of the cathode electrode, the insulating layer and the gate electrode which portions cover the sphere are dissipated by the force of the burst, to form the projection portion and the concave portion and to form the opening portion at the same time, and the sphere is also removed. That is, no opening portion exists in the insulating layer and the gate electrode before the removal of the spheres, and the opening portion is formed together with the removal of the sphere. In this case, the initial process of combustion of the spheres proceeds in a closed space, so that part of the spheres may be carbonized. Preferably, the thickness of portion of the cathode electrode which portion covers the sphere is decreased to such an extent that the portion can be dissipated by the burst. Otherwise, preferably, the thickness of each of portions of the cathode electrode, the insulating layer and the gate electrode which portions cover the sphere is decreased to such an extent that the portions can be dissipated by the burst. In the insulating layer, more preferably, the portion covering no spheres has a thickness nearly equal to a diameter of each sphere.

In [Crater-type field emission device (No. 3)] to be described later, the spheres can be removed by state change and/or chemical change of the spheres. Since, however, the bursting of the cathode electrode is not involved, the spheres can be easily removed by exerting an external force in some cases. In [Crater-type field-emission device (No. 4)] to be described later, the opening portion is formed prior to the removal of the sphere. When the opening portion has a larger diameter than the sphere, the sphere can be removed with an external force. The external force includes physical forces such as a pressure caused by blowing with air or an inert gas, a pressure caused by blowing a wash liquid, a magnetic suction force, an electrostatic force and a centrifugal force. Unlike [Crater-type field emission device (No. 1)], in [Crater-type field emission device (No. 3)] or [Crater-type field emission device (No. 4)], it is not required to dissipate the portion of the cathode electrode which covers the sphere, or, in some cases, it is not required to dissipate the above portion and portions of the insulating layer and the gate electrode, so that there is an advantage that there is caused no residue from the cathode electrode, the insulating layer or the gate electrode.

In [Crater-type field emission device (No. 3)] or [Crater-type field emission device (No. 4)] to be described later, preferably, at least the surface of the sphere used therein is made of a material having a larger interfacial tension (surface tension) than a material constituting a cathode electrode, or in some cases, than materials constituting an insulating layer and a gate electrode. In [Crater-type field emission device (No. 4)], the cathode electrode, the insulating layer and the gate electrode thereby do not cover at least top portions of the spheres, and there can be obtained a state where the opening portion is formed in the insulating layer and the gate electrode from the beginning. The diameter of the opening portion differs depending, for example, upon a relationship between the thickness of a material for each of the cathode electrode, the insulating layer and the gate electrode and the diameter of each sphere; methods of forming the cathode electrode, the insulating layer and the gate electrode; and the interfacial tension (surface tension) of a material for each of the cathode electrode, the insulating layer and the gate electrode.

In [Crater-type field emission device (No. 3)] or [Crater-type field emission device (No. 4)] to be described later, it is sufficient that the spheres have at least the surfaces which satisfy the above condition concerning the interfacial tension. That is, the portion having a larger interfacial tension than any one of the cathode electrode, the insulating layer and the gate electrode may be only a surface of the sphere or may be the entirety of the sphere. Further, the material for the surface and/or the entirety of the sphere may be an inorganic material, an organic material or a combination of an inorganic material with an organic material. In [Crater-type field emission device (No. 3)] or [Crater-type field emission device (No. 4)], when the cathode electrode and the gate electrode are made of a general metal material and when the insulating layer is made of a silicon dioxide material such as glass, generally, a highly hydrophilic state is formed since hydroxyl groups derived from adsorbed water are present on the metal material and since dangling bonds of Si—O bonds and hydroxyl group derived from adsorbed water are present on the surface of the insulating layer. It is therefore particularly effective to use spheres having hydrophobic surface-treatment layers. The material for the hydrophobic surface-treatment layer includes fluorine resins such as polytetrafluoroethylene. When the sphere has a hydrophobic surface-treatment layer, and, if a portion inside the hydrophobic surface-treatment layer is considered a core, the material for the core may be glass, ceramic or a polymer material other than the fluorine resin.

Although not specially limited, the organic material for constituting a sphere is preferably a general-purpose polymer material. When the polymer material has an extremely high polymerization degree or has an extremely large content of double and triple bonds, too high a combustion temperature is required, and when the spheres are removed by combustion, a detrimental effect may be caused on the cathode electrode, the insulating layer or the gate electrode. It is therefore preferred to select a polymer material which is combustible or carbonizable at a temperature at which no detrimental effect is caused on the above layer and electrodes. When a material which requires calcining or sintering at a post step, such as a glass paste, is used for forming the insulating layer, it is preferred to select a polymer material which is combustible or carbonizable at a calcining or sintering temperature of the glass paste, in order to decrease the number of the manufacturing steps. Since a glass paste has a typical calcining temperature of approximately 530° C., the combustion temperature of the polymer material is preferably approximately 350 to 500° C. Typical examples of the polymer material include styrene, urethane, acryl, vinyl, divinylbenzene, melamine, formaldehyde and polymethylene homopolymers or copolymers. For securing a reliable layout of the spheres on the first support member, there may be used fixable spheres capable of adhering. As fixable spheres, spheres made of an acryl resin can be used.

Otherwise, thermally expandable microspheres having, for example, a vinylidene chloride-acrylonitrile copolymer as outer shells and encapsulating isobutane as a foaming agent can be used as spheres. In [Crater-type field emission device (No. 1)], the above thermally expandable microspheres are employed and heated. In this case, a polymer constituting the outer shells is softened, and the encapsulated isobutane is gasified to undergo expansion. As a result, there are formed hollow true spheres having a diameter approximately 4 times as large as a diameter found before the expansion. As a result, [Crater-type field emission device (No. 1)], the projection portions for emitting electrons and the concave portions each of which is surrounded by the projection portion and reflects part of form of the sphere can be formed in the cathode electrode. In addition to the above concave portions and the above projection portions, the opening portions can also be formed through the gate electrode and the insulating layer. In the present specification, the expansion of thermally expandable microspheres by heating is also included in the concept of the removal of the sphere. Then, thermally expandable microspheres can be removed with a proper solvent.

In [Crater-type field emission device (No. 1)], the cathode electrode covering the spheres can be formed after a plurality of the spheres are arranged on the first support member. In this case or in [Crater-type field emission device (No. 3)] or [Crater-type field emission device (No. 4)] to be described later, the method of arranging a plurality of the spheres on the first support member includes a dry method in which the spheres are sprayed onto the first support member. For spraying the spheres, there can be applied a method in which spacers are sprayed for maintaining a panel distance at a constant distance in the field of producing a liquid crystal display. Specifically, a so-called spray gun for ejecting the spheres through a nozzle with a compressed gas can be used. When the spheres are ejected through the nozzle, the spheres may be in a state in which they are dispersed in a volatile solvent. Otherwise, the spheres can be sprayed by means of an apparatus or a method which is generally used in the field of an electrostatic powder application or coating. For example, the spheres negatively charged can be sprayed to the first support member grounded, with an electrostatic spray gun, using a corona discharge. Since the spheres used are very small as will be described later, the spheres sprayed onto the first support member adhere to the surface of the first support member, for example, with an electrostatic force, and the adhering spheres do not easily fall off the first support member in procedures to come thereafter. When the spheres are pressed after a plurality of the spheres are arranged on the first support member, overlapping of a plurality of the spheres on the first support member can be overcome, and the spheres can be densely arranged on the first support member so as to form a single layer.

Otherwise, there may be employed a constitution in which, in [Crater-type field emission device (No. 2)] to be described later, a composition layer composed of a dispersion of the spheres and a cathode electrode material in a dispersing agent is formed on the first support member, thereby to arrange plurality of the spheres on the first support member and to cover each sphere with the cathode electrode composed of the cathode electrode material, and thereafter, the dispersing agent is removed. The composition can have the property of a slurry or paste, and the component and viscosity of the dispersing agent can be selected as required depending upon the above properties. Preferably, the method of forming the composition layer on the first support member includes a screen-printing method. Typically, the cathode electrode material is preferably formed of fine particles having a lower precipitation rate than the sphere in the dispersing agent. The material for the above fine particles includes carbon, barium, strontium and iron. After the dispersing agent is removed, the cathode electrode is calcined or sintered as required. The method of forming the composition layer on the first support member includes a spraying method, a dropping method, a spin coating method and a screen-printing method. When the spheres are arranged, each sphere is concurrently covered with the cathode electrode made of a cathode electrode material. In some method of forming the above composition layer, it is required to pattern the cathode electrode.

Otherwise, in [Crater-type field emission device (No. 3)] or [Crater-type field emission device (No. 4)] to be described later, there may be employed a constitution in which a composition layer composed of a dispersion of the spheres in a dispersing agent is formed on the first support member, thereby to arrange a plurality of the spheres on the first support member, and then the dispersing agent is removed. The composition can have the property of a slurry or paste, and the component and viscosity of the dispersing agent can be selected as required depending upon the above properties to be required. Typically, an organic solvent such as isopropyl alcohol is used as a dispersing agent, and the dispersing agent can be removed by volatilization. The method of forming the composition layer on the first support member includes a spraying method, a dropping method, a spin coating method and a screen-printing method.

The gate electrode and the cathode electrode extend in directions different from each other (for example, a projection image of the gate electrode in the form of a stripe and a projection image of the cathode electrode in the form of a stripe make an angle of 90°), and for example, they are patterned in the form of stripes. Electrons are emitted from the projection portions positioned in the overlapping region. It is therefore functionally sufficient that the projection portions are present in the overlapping region alone. Even if the projection portions and the concave portions exist in a region different from the overlapping region, however, such projection portions and concave portions remain covered with the insulating layer and do not work to emit electrons. It is therefore no problem if the spheres are arranged on the entire surface.

In contrast, when portions of the cathode electrode, the insulating layer and the gate electrode (gate electrode) which portions cover the sphere are removed, arrangement positions of individual spheres and formation positions of the opening portions have one-to-one correspondence, so that opening portions are made in a region different from the overlapping region. The opening portion formed in a region different from the overlapping region will be referred to as "ineffective opening portion" and distinguished from the original opening portion which works for electron emission. Meanwhile, even if ineffective opening portions are formed in a region other than the overlapping region, the ineffective opening portions do not at all work as field emission devices, nor do they cause any detrimental effect on the performance of the field emission devices formed in the overlapping region. The reason therefore is as follows. Even if the projection portion and the concave portion are exposed in the bottom portion of the ineffective opening portion, no gate electrode is formed on the upper end portion of the ineffective opening portion. Otherwise, even if the gate electrode is formed in the upper end portion of the ineffective opening portion, neither the projection portion nor the concave portion is exposed in the bottom portion; or neither the projection portion nor the concave portion is exposed in the bottom portion of the ineffective opening portion and no gate electrode is formed in the upper end portion and the surface of the first support member is merely exposed. It therefore causes no problem even if the spheres are arranged on the entire surface. A hole formed in a boundary between the overlapping region and other region is included in the opening portion.

The diameter of the sphere can be selected depending upon the diameter of a desired opening portion, the diameter of the concave portion, display screen dimensions of a display having the field emission devices, the number of pixels, dimensions of the overlapping region and the number of the field emission devices per pixel. The diameter of the sphere is preferably in the range of from 0.1 to 10 $\mu$m. For example, spheres commercially available as spacers for a liquid crystal display are preferred since they have a particle diameter distribution of 1 to 3%. While the form of the sphere is ideally truly spherical, it is not necessarily required to be truly spherical. In some methods of producing the field emission devices, opening portions or ineffective opening portions can be formed in portions where the spheres are arranged, and it is preferred to arrange the spheres on the first support member in a density of approximately 100 to 5000 spheres/mm$^2$. For example, when the spheres are arranged on the first support member in a density of approximately 1000 spheres/mm$^2$, and for example, if the overlapping region has dimensions of 0.5 mm×0.2 mm, approximately 100 spheres are present in the overlapping region, and approximately 100 projection portions are formed. When the projection portions approximately in such a number are formed per overlapping region, the fluctuation of diameters of the concave portions, caused by the fluctuation in the particle diameter distribution and the sphericity of the spheres, is nearly averaged, and the current density of emitted electrons per pixel (or per subpixel) and the brightness come to be uniform in practice.

In [Crater-type field emission device (No. 1)] or anyone of [Crater-type field emission device (No. 2)] to [Crater-type field emission device (No. 4)] to be described later, part of the form of the sphere is reflected in the form of the concave portion constituting the electron-emitting portion. The profile of top end portion of each projection portion may have an irregular convexo-concave form or may be flat. In [Crater-type field emission device (No. 1)] or [Crater-type field emission device (No. 2)] in particular, the above top end portion is formed by fracture of the cathode electrode, so that the top end portion of each projection portion is liable to have an irregular form. When the top end portion of the each projection portion is sharpened by fracture, advantageously, the top end portion can function as a highly efficient electron-emitting portion. In [Crater-type field emission device (No. 1)] to [Crater-type field emission device (No. 4)], the projection portion surrounding the concave portion comes to be ringed or circular, and in this case, the concave portion and the projection portion as a whole have the form of a crater or caldera.

The layout of the projection portions on the first support member may be regular or random and depends upon the method of arranging the spheres. When the above dry method or the wet method is employed, the layout of the projection portions on the substrate comes to be random.

In [Crater-type field emission device (No. 1)) to [Crater-type field emission device (No. 4)], when the opening portion is formed in the insulating layer after the formation of the insulating layer, there may be employed a constitution in which a protective layer is formed for avoiding damage of top end portions of the projection portions after the formation of the projection portions, and the protective layer is removed after the opening portion is formed. The material for the protective layer includes chromium.

Figure 22A:
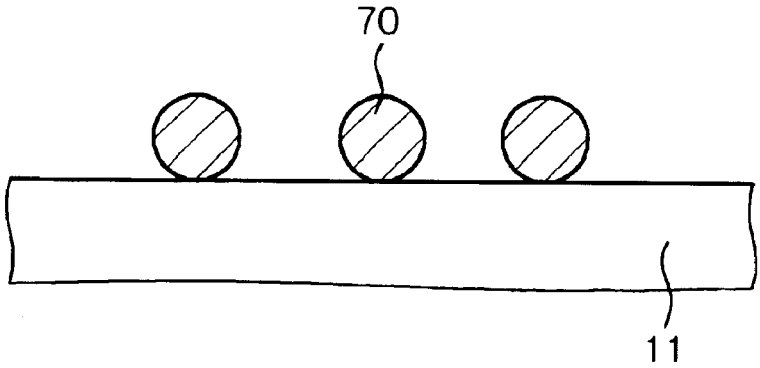
FIGS. 22A and 22B are a schematic partial end view and a partial perspective view of a first support member, etc., for explaining a method for producing still another variant of the field emission device having a second structure constituted of a flat-type field emission device.
Figure 22B:
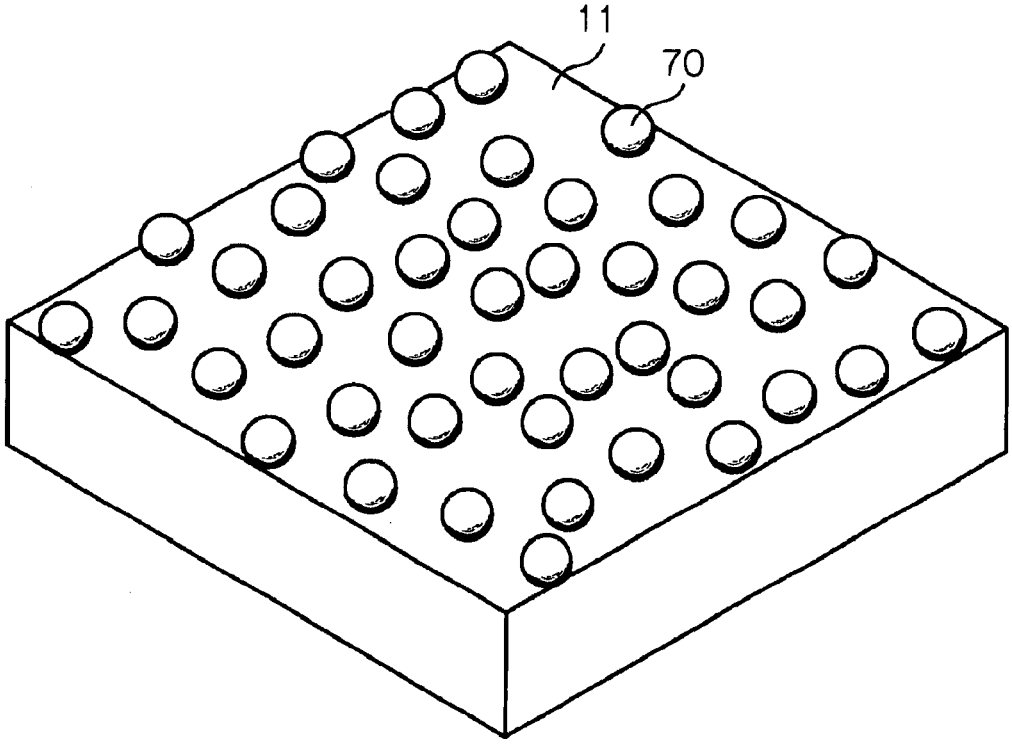
Figure 23A:
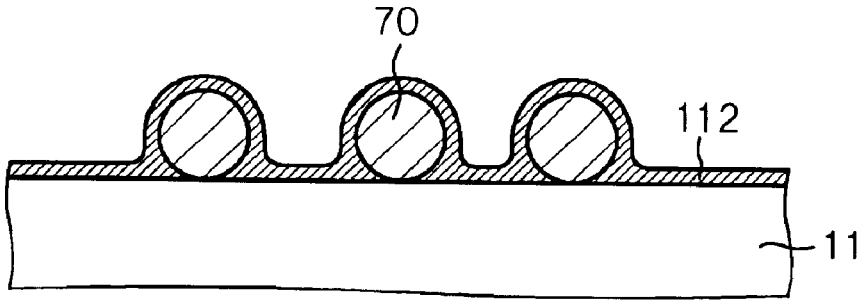
FIGS. 23A and 23B, following
Figure 23B:
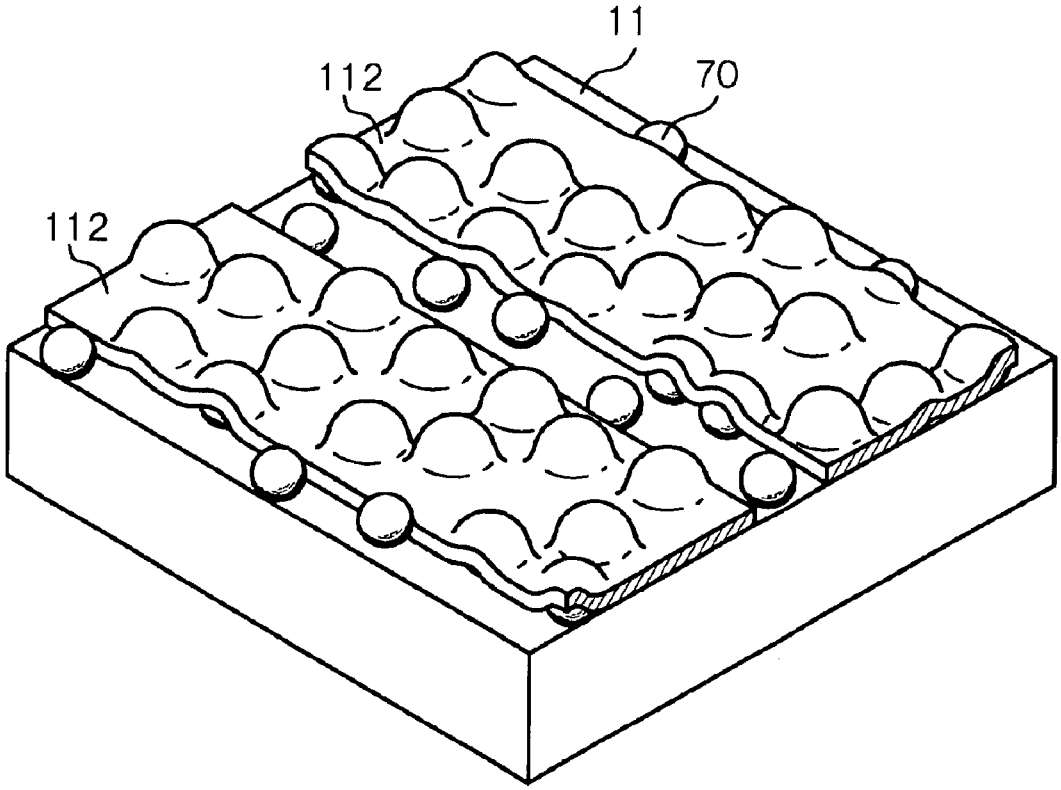

The method of producing the field emission device of [Crater-type field emission device (No. 1)] will be explained with reference to FIGS. 22A, 22B, 23A, 23B, 24A, 24B, 25A and 25B. FIGS. 22A, 23A and 24A are schematic partial end views, FIGS. 25A and 25B are schematic partial cross-sectional views, and FIGS. 22B, 23B and 24B are schematic partial perspective views showing wider ranges than those in FIGS. 22A, 23A and 24A.

[Step-800]

First, the cathode electrode 112 covering a plurality of spheres 70 is formed on the first support member 11. Specifically, the spheres 70 are arranged on the entire surface of the first support member 11 made, for example, of glass substrate. The spheres 70 are made, for example, of a polymethylene-based polymer material, and they have an average particle diameter of approximately 5 $\mu$m and a particle diameter distribution of less than 1%. The spheres 70 are arranged on the first support member 11 at random at a density of approximately 1000 spheres/mm$^2$ with a spray gun. The method of spraying the spheres with a spray gun includes a method of spraying a mixture of the spheres with a volatile solvent and a method of ejecting the spheres in a powder state from a nozzle. The arranged spheres 70 are held on the first support member 11 by an electrostatic force. FIGS. 22A and 22B show such a state.

[Step-810]

The cathode electrode 112 is formed on the spheres 70 and the first support member 11. FIGS. 23A and 23B show a state where the cathode electrode 112 is formed. The cathode electrode 112 can be formed, for example, by screen-printing a carbon paste in the form of a stripe. In this case, the spheres 70 are arranged on the entire surface of the first support member 11, so that some of the spheres 70 are naturally not covered with the cathode electrode 112 shown in FIG. 23B. Then, the cathode electrode 112 is dried, for example, at 150° C. for removing water and a solvent contained in the cathode electrode 112 and flattening the cathode electrode 112. At this temperature, the spheres 70 do not undergo any state change and/or chemical change. The above screen-printing using a carbon paste may be replaced with a method in which an electrically conductive material for a cathode electrode 112 for constituting a cathode electrode 112 is formed on the entire surface and the electrically conductive material layer for a cathode electrode 112 is patterned by general lithography and a general dry etching method to form the cathode electrode 112 in the form of a stripe. When the lithography is applied, generally, a resist layer is formed by a spin coating method. In the spin coating, if the number of spinning of the first support member 11 is approximately 500 rpm and if the spinning time period is approximately several seconds long, the spheres 70 are held on the first support member 11 without dropping off or shifting in position.

[Step-820]

Portions of the cathode electrode 112 which cover the spheres 70 are removed by removing the spheres 70, whereby there is formed a cathode electrode 112 having a plurality of projection portions 112A for emitting electrons and concave portions 112B each of which is surrounded by the projection portion 112A and reflects part of form of each sphere 70. FIGS. 24A and 24B show the thus-obtained state. Specifically, the spheres 70 are combusted by heating them to around 530° C. while the cathode electrode 112 is also calcined. The pressure in each closed space in which each sphere 70 is captured increases together with the combustion of the spheres 70, and the portion of the cathode electrode 112, which portion covers the sphere 70, bursts when a certain pressure durability limit is exceeded, and such a portion is removed. As a result, the projection portions 112A and the concave portions 112B are formed in part of the cathode electrode 112 formed on the first support member 11. When some portions of the sphere remain as a residue after the removal of the spheres, the residue can be removed with a proper wash liquid depending upon a material constituting the spheres used.

[Step-830]

Then, the insulating layer 13 is formed on the cathode electrode 112 and the first support member 11. Specifically, for example, a glass paste is screen-printed on the entire surface to form a layer having a thickness of approximately 5 $\mu$m. Then, the insulating layer 13 is dried, for example, at 150° C. to remove water and a solvent contained in the insulating layer 13 and to flatten the insulating layer 13. The above screen-printing using a glass paste may be replaced, for example, with the formation of an $SiO_2$ layer by a plasma CVD method.

[Step-840]

Then, the stripe-shaped gate electrode 14 is formed on the insulating layer 13 (see FIG. 25A). The gate electrode 14 can be formed by screen-printing, for example, with a carbon paste in the form of a stripe. In this case, the extending direction of projection image of the stripe-shaped gate electrode 14 forms an angle of 90° with the extending direction of projection image of the stripe-shaped cathode electrode 112. Then, the gate electrode 14 is dried, for example, at 150° C. for removing water and a solvent contained in the gate electrode 14 and flattening the gate electrode 14, and then the materials constituting the gate electrode 14 and the insulating layer 13 are calcined or sintered. The screen printing with a carbon paste may be replaced with the procedures of forming a gate electrode material layer for constituting a gate electrode 14 on the entire surface of the insulating layer 13 and patterning the gate electrode material layer by general lithography and a general drying etching method.

[Step-850]

Then, in the overlapping region where the projection image of the gate electrode 14 and the projection image of the cathode electrode 112 overlap, the opening portion 15 is formed in the gate electrode 14 and the insulating layer 13, thereby to expose a plurality of the projection portions 112A and the concave portions 112B in the bottom portion of the opening portion 15. The opening portion 15 can be obtained by forming a resist mask according to general lithography and etching through the resist mask. Preferably, the etching is carried out under a condition where sufficiently high etching selectivity to the cathode electrode 112 is secured. Alternatively, after the formation of the projection portions 112A, preferably, a protective layer made of chromium is formed in advance, and after the opening portion 15 is formed, the protective layer is removed. Then, the resist mask is removed. In this manner, the field emission device shown in FIG. 22B can be obtained.

As a variant of the method of producing [Crater-type field emission device (No. 1)], there may be employed a constitution in which [Step-830] to [Step-850] are carried out after [Step-810] and then [Step-820] is carried out. In this case, the combustion of the spheres and the calcining of the materials for the gate electrode 14 and the insulating layer 13 can be carried out concurrently.

Otherwise, [Step-830] is carried out after [Step-810], and in a step similar to [Step-840], further, a stripe-shaped gate electrode free of the opening portion is formed on the insulating layer. Then, [Step-820] is carried out. In this manner, portions of the cathode electrode 112, the insulating layer 13 and the gate electrode 14 which portions cover the sphere 70 are removed, whereby the opening portion can be formed through the gate electrode 14 and the insulating layer 13 and the electron-emitting portion having the projection portion 112A for emitting electrons and the concave portion 112B which is surrounded by the projection portion 112A and reflects part of the form of each sphere 70 can be formed in the cathode electrode 112 which is positioned in the bottom portion of the opening portion. That is, the pressure in each closed space in which each sphere 70 is captured increases together with the combustion of the spheres 70, and portions of the cathode electrode 112, the insulating layer 13 and the gate electrode 14 which portions cover the sphere are burst when a certain pressure durability limit is exceeded, and the opening portion is formed together with the projection portion 112A and the concave portion 112B. Further, the spheres 70 are removed. The opening portion is formed through the gate electrode 14 and the insulating layer 13 and reflects part of form of the sphere 70. In the bottom portion of the opening portion, there remains the projection portion 112A for emitting electrons and the concave portion 112B which is surrounded by the projection portion 112A and reflects part of the form of the sphere 70.

[Crater-Type Field Emission Device (No. 2)]

Figure 26A:
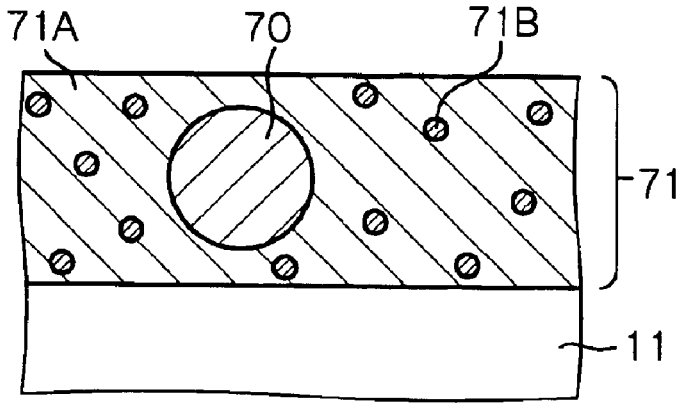
FIGS. 26A to 26C are schematic partial cross-sectional views of a first support member, etc., for explaining a method for producing still another variant of the field emission device having a second structure constituted of a flat-type field emission device.
Figure 26B:
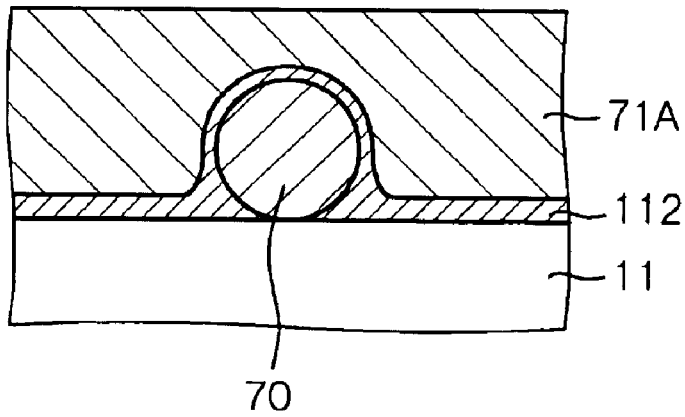
Figure 26C:
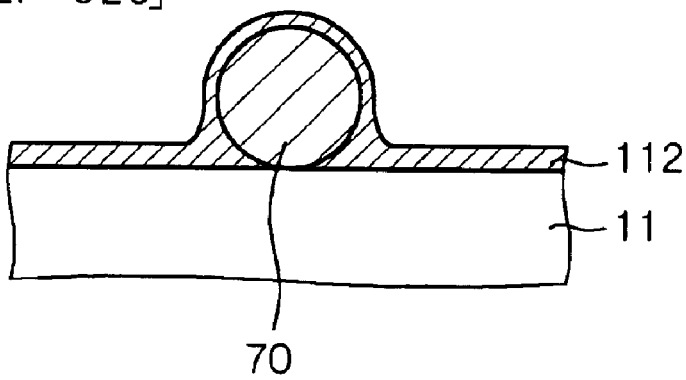

The method of producing [Crater-type field emission device (No. 2)] will be explained with reference to FIGS. 26A, 26B and 26C. The method of producing [Crater-type field emission device (No. 2)] differs from the method of producing [Crater-type field emission device (No. 1)] in that the step of arranging a plurality of the spheres 70 on the first support member 11 includes the steps of forming, on the first support member 11, a composition layer 71 composed of a composition which is a dispersion of the spheres 70 and the cathode electrode material in a dispersing agent, thereby to arrange a plurality of the spheres 70 on the first support member 11, covering the spheres with the cathode electrode 112 made of the cathode electrode material, and then, removing the dispersing agent, that is, the above step is a wet method.

[Step-900]

First, a plurality of the spheres 70 are arranged on the first support member 11. Specifically, the composition layer 71 composed of a composition which is a dispersion of the spheres 70 and the cathode electrode material 71B in a dispersing agent 71A is formed on the first support member 11. That is, for example, isopropyl alcohol is used as a dispersing agent 71A, and the composition is prepared by dispersing the spheres 70 which are made of a polymethylene polymer material and have an average particle diameter of approximately 5 μm and carbon particles having an average particle diameter of 0.05 μm as the cathode electrode material 71B, in the dispersing agent 71A. The composition is screen-printed on the first support member 11 in the form of a stripe, to form the composition layer 71. FIG. 26A shows a state found immediately after the formation of the composition layer 71.

[Step-910]

In the composition layer 71 held on the first support member 11, the spheres 70 soon precipitate to be arranged on the first support member 11 and the cathode electrode material 71B also precipitates on the spheres 70 and the first support member 11 to form a cathode electrode 112 made of the cathode electrode material 71B, whereby a plurality of the spheres 70 can be arranged on the first support member 11 and the spheres 70 can be covered with the cathode electrode 112 made of the cathode electrode material. FIG. 26B shows the thus-obtained state.

[Step-920]

Then, the dispersing agent 71A is removed by volatilization. FIG. 26C shows the thus-obtained state.

[Step-930]

Then, steps similar to [Step-820] to [Step-850] in [Crater-type field emission device (No. 1)] or variants of the production method in [Crater-type field emission device (No. 1)] are carried out, whereby a field emission device similar to the field emission device shown in FIG. 25B can be completed.

[Crater-Type Field Emission Device (No. 3)]

The method of producing [Crater-type field emission device (No. 2)] will be explained. The step of forming the cathode electrode in the form of a stripe on the first support member, more specifically, comprises the steps of arranging a plurality of spheres on a first support member; forming a cathode electrode which has a plurality of the projection portions for emitting electrons and the concave portions each of which is surrounded by the projection portion and reflects part of form of the sphere, on the first support member, each projection portion being formed in a circumference of each sphere; and removing the spheres. The spheres are arranged on the first support member by spraying. The spheres have a hydrophobic surface-treatment layer. [Crater-type field emission device (No. 2)] will be explained with reference to FIGS. 27A, 27B and 27C hereinafter.

[Step-1000]

Figure 27A:
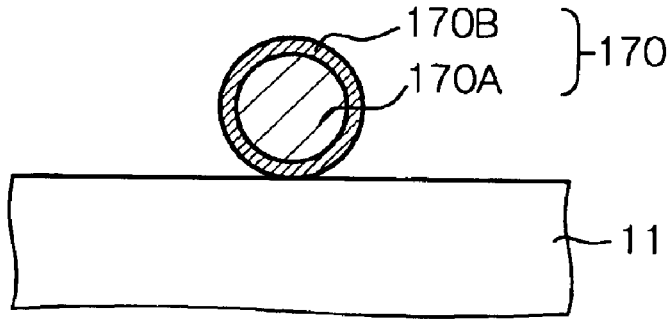
FIGS. 27A to 27C are schematic partial end views of a first support member, etc., for explaining a method for producing still another variant of the field emission device having a second structure constituted of a flat-type field emission device.

First, a plurality of spheres 170 are arranged on the first support member 11. Specifically, a plurality of the spheres 170 are arranged on the entire surface of the first support member 11 made, for example, of glass substrate. The spheres 170 are formed by providing a core material 170A made, for example, of a divinylbenzene polymer material and coating the core material 170A with a surface-treatment layer 170B made of a polytetrafluoroethylene resin, and the spheres 170 have an average diameter of approximately 5 μm and a particle diameter distribution of less than 1%. The spheres 170 are arranged on the first support member 11 in a density of approximately 1000 spheres/mm$^2$ at random with a spray gun. The arranged spheres 170 are held on the first support member 11 by an electrostatic force. FIG. 27A shows the thus-obtained state.

[Step-1010]

Figure 27B:
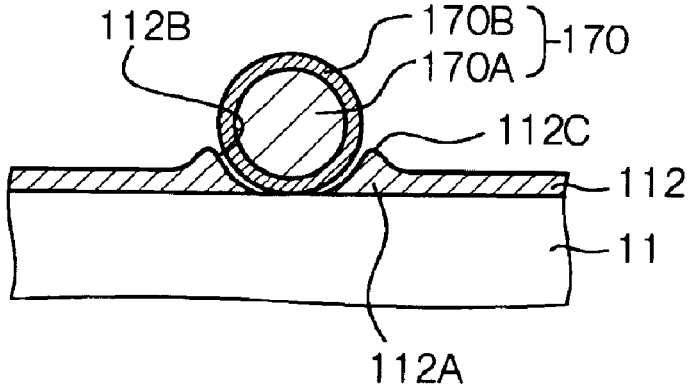

Then, on the first support member 11 is formed a cathode electrode 112 having a plurality of projection portions 112A for emitting electrons and concave portion 112B each of which is surrounded by the projection portion 112A and reflects part of form of the sphere 170, the projection portions 112A being formed around the spheres 170. Specifically, as described in [Crater-type field emission device (No. 1)], for example, a carbon paste is screen-printed in. the form of a stripe. In [Crater-type field emission device (No. 3)], the surface of each sphere 170 has hydrophobic nature due to the surface-treatment layer 170B, so that the carbon paste screen-printed on the sphere 170 is immediately repelled and dropped off and is deposited around the sphere 170 to form the projection portion 112A. The top end portion 112C of each projection portion 112A is not so sharpened as that in [Crater-type field emission device (No. 1)]. A portion of the cathode electrode 112 which portion enters between the sphere 170 and the first support member 11 constitutes the concave portion 112B. While FIG. 27B shows a state where a gap is present between the cathode electrode 112 and the sphere 170, the cathode electrode 112 and the sphere 170 are in contact with each other in some cases. Then, the cathode electrode 112 is dried, for example, at 150° C. FIG. 27B shows the thus-obtained state.

[Step-1020]

Figure 27C:
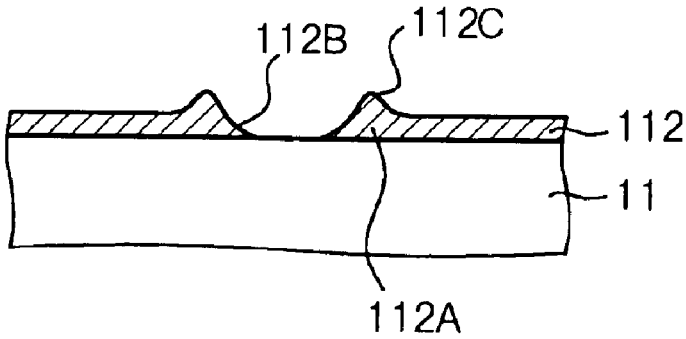

Then, an external force is exerted on the spheres 170 to remove the spheres 170 from the first support member 11. Specifically, the method of removal includes a washing method and a method of blowing a compressed gas. FIG. 27C shows the thus-obtained state. The spheres can be also removed by the state change and/or chemical change of the spheres, more specifically, for example, by combustion, which is also applicable to [Crater-type field emission device (No. 4)] to be described below.

[Step-1030]

Then, [Step-830] to [Step-850] in [Crater-type field emission device (No. 1)] are carried out, whereby there can be obtained a field emission device which is almost the same as the device shown in FIG. 25B.

In a variant of the production method of [Crater-type field emission device (No. 3)], there may be employed. a constitution in which [Step-830] to [Step-850] of [Crater-type field emission device (No. 1)] are carried out after [Step-1010] and then [Step-1020] is carried out.

[Crater-Type Field Emission Device (No. 4)]

The method of producing [Crater-type field emission device (No. 2)] will be explained. The step of forming the cathode electrode in the form of a stripe on the first support member, more specifically, comprises the steps of arranging a plurality of spheres on a first support member; and forming a cathode electrode which has a plurality of the projection portions for emitting electrons and the concave portions each of which is surrounded by the projection portion and reflects part of the form of the sphere, on the first support member, each projection portion being formed in a circumference of each sphere. When an insulating layer is formed on the entire surface, the insulating layer having opening portions above the spheres is formed on the cathode electrode and the first support member. The spheres are removed after the opening portions are formed. In the method of producing the field emission device in [Crater-type field emission device (No. 4)], a plurality of the spheres are arranged on the first support member by spraying the spheres. Each sphere has a hydrophobic surface-treatment layer. [Crater-type field emission device (No. 4)] will be explained with reference to FIGS. 28A, 28B, 29A and 29B.

[Step-1100]

First, a plurality of the spheres 170 are arranged on the first support member 11. Specifically, a step similar to the [Step-1000] of [Crater-type field emission device (No. 3)] is carried out.

[Step-1110]

Then, formed on the first support member 11 is a cathode electrode 112 having a plurality of projection portions 112A for emitting electrons and concave portions each of which is surrounded by the projection portion 112A and reflects part of the form of the sphere 170, each projection portion 112A being formed in a circumference of each sphere 170. Specifically, a step similar to [step-1010] of [Crater-type field emission device (No. 3)] is carried out.

[Step-1120]

Figure 28A:
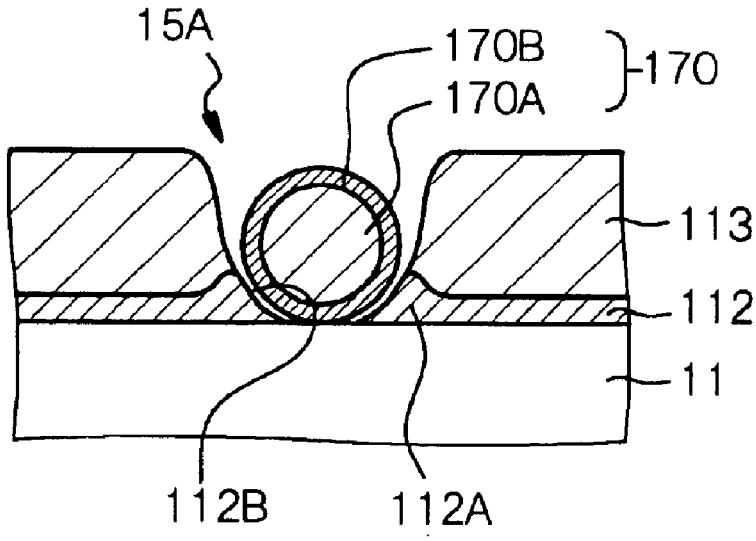
FIGS. 28A and 28B are schematic partial end views of a first support member, etc., for explaining a method for producing still another variant of the field emission device having a second structure constituted of a flat-type field emission device.

An insulating layer 113 having opening portions 15A above the spheres is formed on the cathode electrode 112 and the first support member 11. Specifically, a glass paste is screen-printed on the entire surface to form a layer for the insulating layer having a thickness of approximately 5 $\mu$m. The screen-printing with a glass paste can be carried out in the same mariner as in [Crater-type field emission device (No. 1)]. The surface of each sphere 170 has a hydrophobic nature due to the surface-treatment layer 170B, so that the screen-printed glass paste is immediately repelled and dropped off on the sphere 170 and a portion of the insulating layer 113, which portion is on each sphere 170, shrinks due to its surface tension. As a result, the top portion of each sphere 170 is exposed into the opening portion 15A without being covered with the insulating layer 113. FIG. 28A shows the thus-obtained state. In a shown embodiment, the top end portion of the opening portion 15A has a larger diameter than the sphere 170. When the surface-treatment layer 170B has a smaller interfacial tension than the glass paste, the opening portion 15A tends to have a smaller diameter. When the surface-treatment layer 170B has an extremely larger interfacial tension than the glass paste, the opening portion 15A tends to have a larger diameter. Then, the insulating layer 113 is dried, for example, at 150° C.

[Step-1130]

Figure 28B:
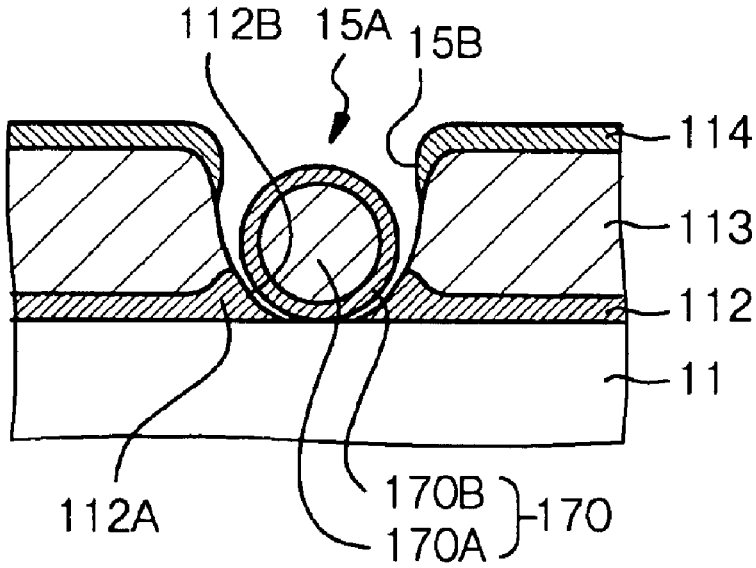

Then, a gate electrode 114 having an opening portion 15B communicating with the opening portion 15A is formed on the insulating layer 113. Specifically, a carbon paste is screen-printed in the form of a stripe. The screen-printing with a carbon paste can be carried out in the same manner as in [Crater-type field emission device (No. 1)]. Since, however, the surface of the sphere 170 has hydrophobic nature due to the surface-treatment layer 170B, the carbon paste screen-printed on the sphere 170 is immediately repelled and shrinks due to its own surface tension to form a state where it adheres only to the surface of the insulating layer 113. In this case, the gate electrode 114 may be sometimes formed so as to droop from the opening end portion of the insulating layer 113 into the opening portion 15A to some extent. Then, the gate electrode 114 is dried, for example, at 150° C. FIG. 28B shows the thus-completed state. When the surface-treatment layer 170B has a smaller interfacial tension than the carbon paste, the opening portion 15A tends to have a smaller diameter. When the surface-treatment layer 170B has an extremely larger interfacial tension than the carbon paste, the opening portion 15A tends to have a larger diameter.

[Step-1140]

Then, the sphere 170 exposed in the bottom portion of the opening portions 15A and 15B is removed. Specifically, the sphere 170 is combusted by heating the sphere at approximately 530° C., a typical temperature for calcining a glass paste, which heating also works to calcine or sinter the cathode electrode 112, the insulating layer 113 and the gate electrode 114. In this case, the insulating layer 113 and the gate electrode 114 have the opening portions 15A and 15B from the beginning unlike [Crater-type field emission device (No. 1)], so that part of the cathode electrode 112, the insulating layer 113 or the gate electrode 114 is not dissipated in any case, and the sphere 170 is readily removed. When the upper end portion of the opening portions 15A and 1SB has a larger diameter than the sphere 170, the sphere 170 can be removed by an external force such as washing or blowing of a compressed gas without combusting the sphere 170. FIG. 28A shows the thus-completed state.

[Step-1150]

Figure 29A:
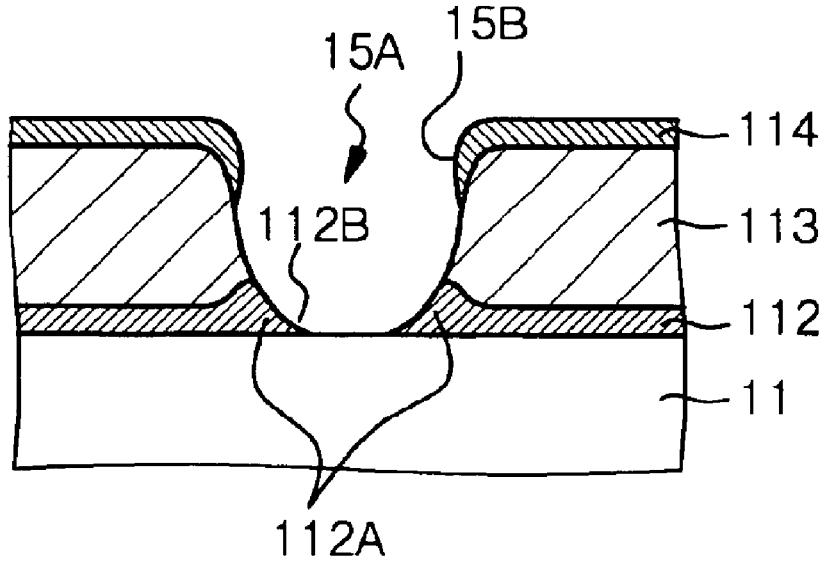
FIGS. 29A and 29B, following
Figure 29B:
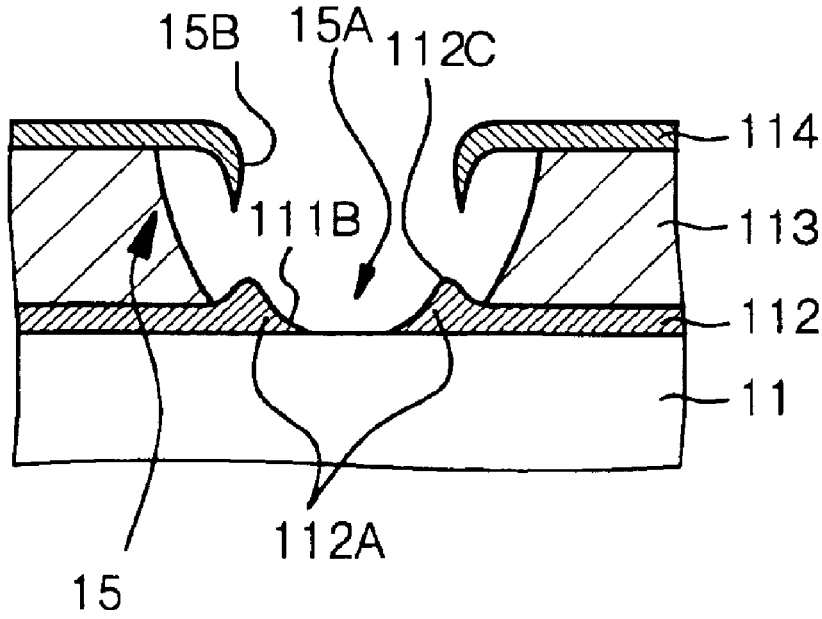

Part of the insulating layer 113 which part corresponds to the side wall surface of the opening portion 15A is isotropically etched, whereby a field emission device shown in FIG. 29B can be completed. In this embodiment, the end portion of the gate electrode 114 faces downward, which is preferred for increasing the electric field intensity in the opening portion 15.

[Edge-Type Field Emission Device]

Figure 30A:
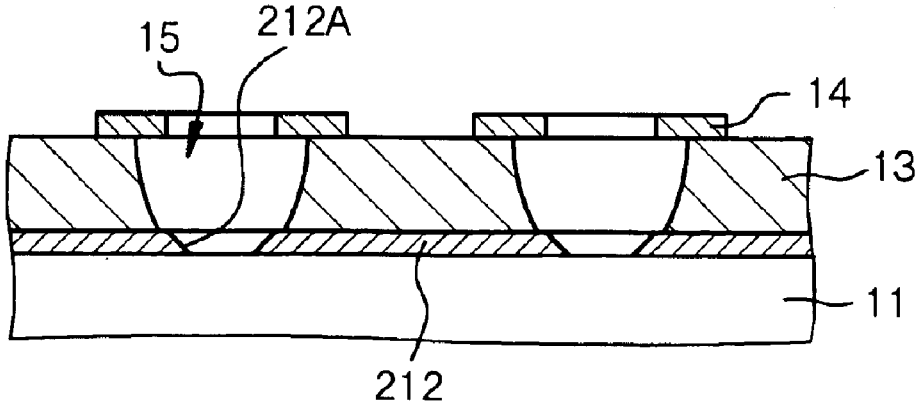
FIGS. 30A to 30C are schematic partial cross-sectional views of field emission devices having a third structure constituted of an edge-type field emission device.

FIG. 30A shows a schematic partial cross-sectional view of the edge-type field emission device. The edge-type field emission device comprises a cathode electrode 212 formed on a first support member 11 in the form of a stripe; an insulating layer 13 formed on the first support member 11 and the cathode electrode 212; and a gate electrode 14 formed on the insulating layer 13 in the form of a stripe. An opening portion 15 is formed through the gate electrode 14 and the insulating layer 13. An edge portion 212A of the cathode electrode 212 is exposed in the bottom portion of the opening portion 15. A voltage is applied to the cathode electrode 212 and the gate electrode 14, whereby electrons are emitted from the edge portion 212A of the cathode electrode 212.

Figure 30B:
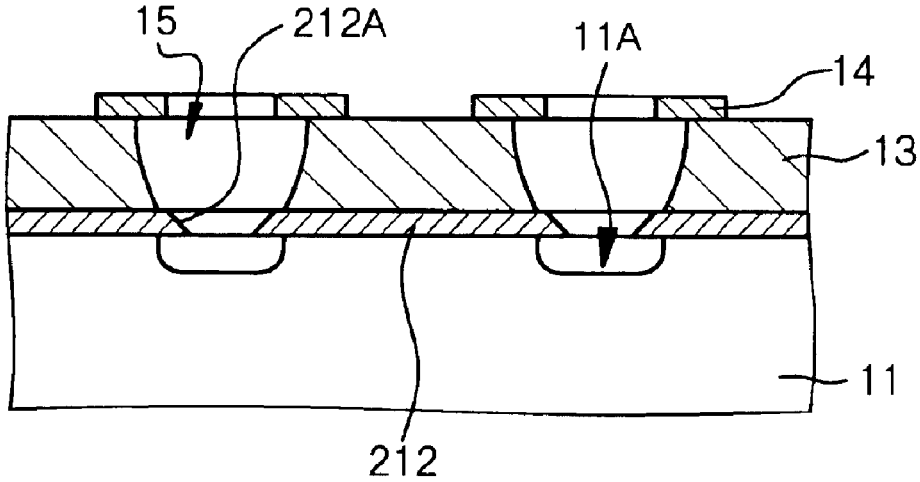
Figure 30C:
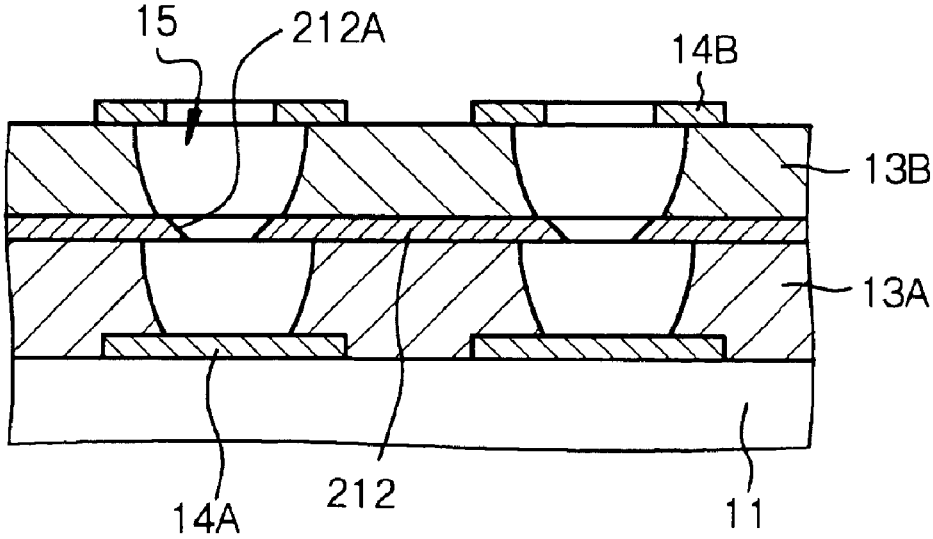

As shown in FIG. 30B, a concave portion 11A may be formed in the first support member 11 below the cathode electrode 212 inside the opening portion 15. Otherwise, as FIG. 30C shows a schematic partial cross-sectional view, the edge-type field emission device may comprise a first gate electrode 14A formed on the first support member 11; a first insulating layer 13A formed on the first support member 11 and the first gate electrode 14A; a cathode electrode 212 formed on the first insulating layer 13A; a second insulating layer 13B formed on the first insulating layer 13A and the cathode electrode 212; and a second gate electrode 14B formed on the second insulating layer 13B. And, an opening portion 15 is formed through the second gate electrode 14B, the second insulating layer 13B, the cathode electrode 212 and the first insulating layer 13A. An edge portion 212A of the cathode electrode 212 is exposed on a side wall of the opening portion 15. A voltage is applied to the cathode electrode 212 and the first and second gate electrodes 14A and 14B, whereby electrons are emitted from the edge portion 212A of the cathode electrode 212.

Figure 31A:
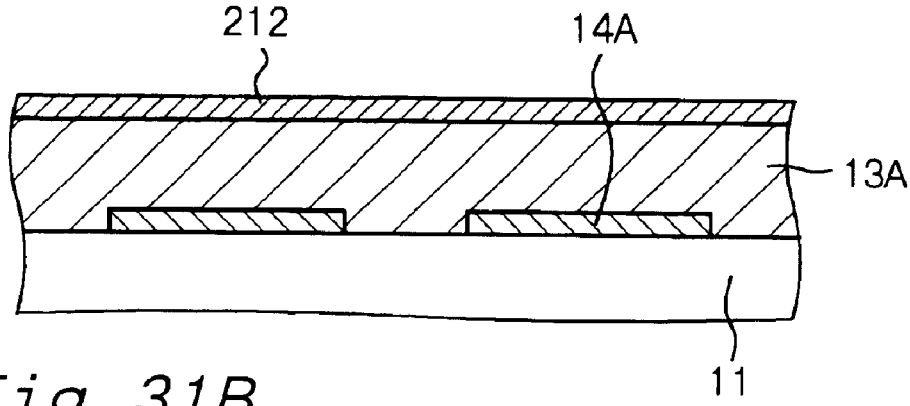
FIGS. 31A to 31C are schematic partial end views of a first support member, etc., for explaining one example of a method for producing a field emission device having a third structure constituted of an edge-type field emission device.
Figure 31B:
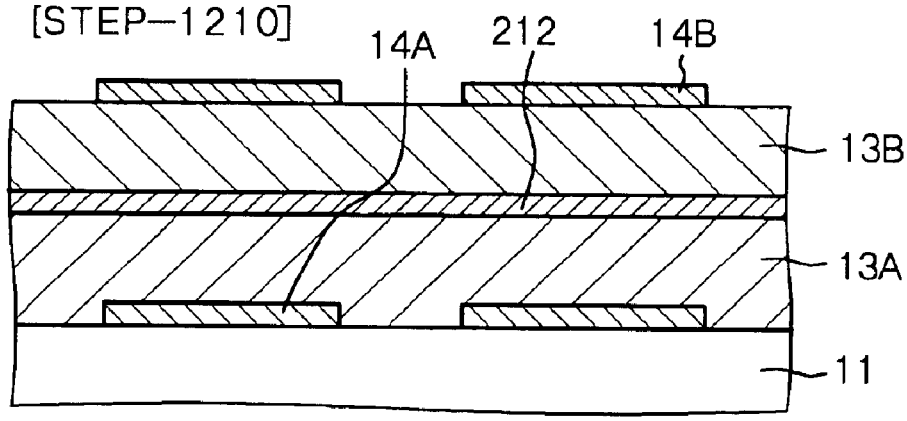
Figure 31C:
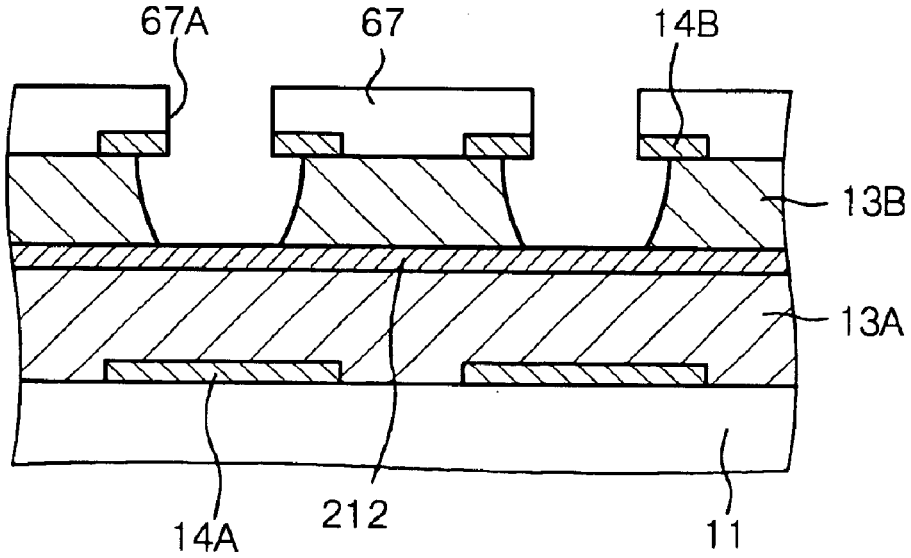

The method of producing the edge-type field emission device shown, for example, in FIG. 30C will be explained with reference to FIGS. 31A, 31B and 31C showing schematic partial end views of the first support member, etc.

[Step-1200]

First, an approximately 0.2 μm thick tungsten layer is formed on the first support member 11 made, for example, of glass substrate by a sputtering method, and the tungsten layer is patterned by photolithography and a dry etching method according to general procedures, to form the first gate electrode 14A. Then, the first insulating layer 13A, which is made of $SiO_2$ and has a thickness of approximately 0.3 μm, is formed on the entire surface, and then the cathode electrode 212 made of tungsten in the form of a stripe is formed on the first insulating layer 13A (see FIG. 31A).

[Step-1210]

Then, the second insulating layer 13B, which, for example, is made of $SiO_2$ and has a thickness of 0.7 μm, is formed on the entire surface, and then the second gate electrode 14B in the form of a stripe is formed on the second insulating layer 13B (see FIG. 31B). The material for the second gate electrode 14B may be the same as, or different from, the material for the first gate electrode 14A.

[Step-1220]

Then, a resist layer 67 is formed on the entire surface, and a resist opening portion 67A is formed in the resist layer 67 such that part of the surface of the second gate electrode 14B is exposed. The resist opening portion 67A has a rectangular form when viewed as a plan view. The rectangular form has a major side length of approximately 100 μm and a minor side length of several μm to 10 μm. Then, the second gate electrode 14B exposed in the bottom portion of the resist opening portion 67A is anisotropically etched, for example, by an RIE method, to form an opening portion. Then, the second insulating layer 13B exposed in the bottom portion of the opening portion is isotropically etched to form an opening portion (see FIG. 31C). Since the second insulating layer 13B is made of $SiO_2$, wet etching is carried out using a buffered hydrofluoric acid aqueous solution. The side wall surface of the opening portion formed in the second insulating layer 13B recedes from the opening end portion of the opening portion formed in the second gate electrode 14B. In this case, the recess amount can be controlled by adjusting the etching time period. In this embodiment, the wet etching is carried out until the lower end of the opening portion formed in the second insulating layer 13B recedes from the opening end portion of the opening portion formed in the second gate electrode 14B.

The cathode electrode 212 exposed in the bottom portion of the opening portion is dry-etched under a condition where ions are used as main etching species. In the dry-etching using ions as main etching species, ions as charged particles can be accelerated by applying a biased voltage to an object to be etched or utilizing interaction of plasma and a magnetic field, and generally, anisotropic etching proceeds, so that the etched object has a perpendicular wall as a processed surface. In this step, however, the main etching species in plasma contains some incidence components having angles different from the perpendicularity, and obliquely entering components are also generated due to scattering on the end portion of the opening portion, so that, in the exposed surface of the cathode electrode 212, at some probability, main etching species enter regions which ion originally should not reach since the regions are shielded by the opening portion. In this case, main etching species having a smaller incidence angle with regard to the normal of the first support member 11 show a higher entering probability, and main etching species having a larger incidence angle show a lower entering probability.

Therefore, while the position of upper end portion of the opening portion formed in the cathode electrode 212 is nearly lined up with the lower end portion of the opening portion formed in the second insulating layer 13B, the position of the lower end portion of the opening portion formed in the cathode electrode 212 is projected from the upper end portion thereof. That is, the thickness of the edge portion 212A of the cathode electrode 212 decreases toward the forward end portion in the projection direction, and the edge portion 212A is sharpened. For example, when $SF_6$ is used as an etching gas, the cathode electrode 212 can be excellently processed.

The first insulating layer 13A exposed in a bottom portion of the opening portion formed in the cathode electrode 212 is isotropically etched, to form an opening portion in the first insulating layer 13A, whereby the opening portion 15 is completed. In this embodiment, wet etching is carried out using a buffered hydrofluoric acid aqueous solution. The side wall surface of the opening portion formed in the first insulating layer 13A recedes from the lower end portion of the opening portion formed in the cathode electrode 212. In this case, the recess amount can be controlled by adjusting the etching time period. After the completion of the opening portion 15, the resist layer 90 is removed, whereby the constitution shown in FIG. 30C can be obtained.

(Spindt-Type Field Emission Device: Variant-1 of Production Method]

A variant of the method for producing a Spindt-type field emission device already explained in the [Spindt-type field emission device] will be explained with reference to FIGS. 32A and 32B, FIGS. 33A and 33B and FIGS. 34A and 34B showing schematic partial end views of a first support member and the like. The Spindt-type field emission device (see FIG. 35) is produced in principle by the following steps of;

(a) forming a cathode electrode 12 on a first supporting substrate 11, (b) forming an insulating layer 13 on the cathode electrode 12 and the first supporting substrate 11, (c) forming a gate electrode 14 on the insulating layer 13, (d) forming an opening portion 15 having the cathode electrode 12 exposed in a bottom portion thereof, at least in the insulating layer 13, (e) forming an electrically conductive material layer 81 for an electron-emitting portion on the entire surface including the inside of the opening portion 15, (f) forming a mask material layer 82 on the electrically conductive material layer 81 so as to mask a region of the electrically conductive material layer 81 which region is positioned in a central portion of the opening portion 15, and (g) etching the electrically conductive material layer 81 and the mask material layer 82 under an anisotropic etching condition where an etching rate of the electrically conductive material layer 81 in the direction perpendicular to the first supporting substrate 11 is higher than an etching rate of the mask material layer 82 in the direction perpendicular to the first supporting substrate 11, to form an electron-emitting electrode 16E which is constituted of the electrically conductive material layer 81 and has a top end portion having a conical form, on the cathode electrode 12 exposed in the opening portion 15.

[Step-1300]

The cathode electrode 12 composed of chromium (Cr) is formed on the first supporting substrate 11 prepared, for example, by forming an approximately 0.6 μm thick $SiO_2$ layer on a glass substrate. Specifically, an electrically conductive material layer composed of chromium for a cathode electrode is deposited on the first supporting substrate 11, for example, by a sputtering method or a CVD method, and the electrically conductive material layer is patterned, whereby there can be formed a plurality of cathode electrodes 12. The cathode electrode 12 has a width, for example, of 50 μm and one cathode electrode 12 is spaced from another cathode electrode 12 at a distance, for example, of 30 μm. Then, the insulating layer 13 composed of $SiO_2$ is formed on the entire surface, specifically, on the cathode electrode 12 and the first supporting substrate 11 by a plasma CVD method using TEOS (tetraethoxysilane) as a source gas. The insulating layer 13 has a thickness of approximately 1 μm. Then, the gate electrode 14 is formed on the entire surface on the insulating layer 13, the gate electrode 14 has the form of a stripe and extending in the direction at right angles with the cathode electrode 12.

Then, in an overlapping region where a cathode electrode 12 in the form of a stripe and the gate-electrode 14 in the form of a stripe, that is, in a one pixel region, opening portions 15 are formed through the gate-electrode 14 and the insulating layer 13. The opening portion 15 has, for example, the form of a circle having a diameter of 0.3 μm when viewed as a plan view. Generally, hundreds to thousands of opening portions 15 are formed per one pixel region (one overlapping region). For forming the opening portions 15, while a resist layer formed by general photolithography is used as a mask, first, the opening portions 15 are formed in the gate-electrode 14, and the opening portions 15 are formed in the insulating layer 13. After RIE, the resist layer is removed by ashing (see FIG. 32A).

[Step-1310]

Figure 32A:
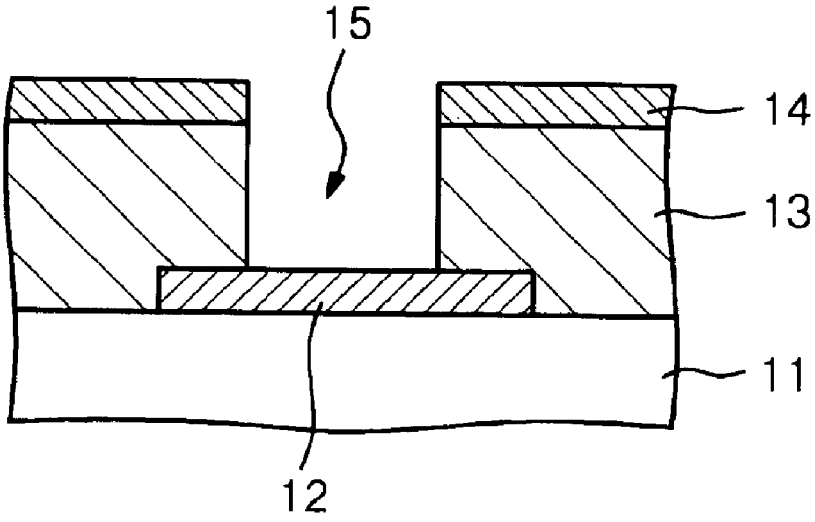
FIGS. 32A and 32B are schematic partial end views of a first support member, etc., for explaining [Spindt-type field emission device: Variant-1 of production method] for producing a Spindt-type field emission device shown in FIG. 35.
Figure 32B:
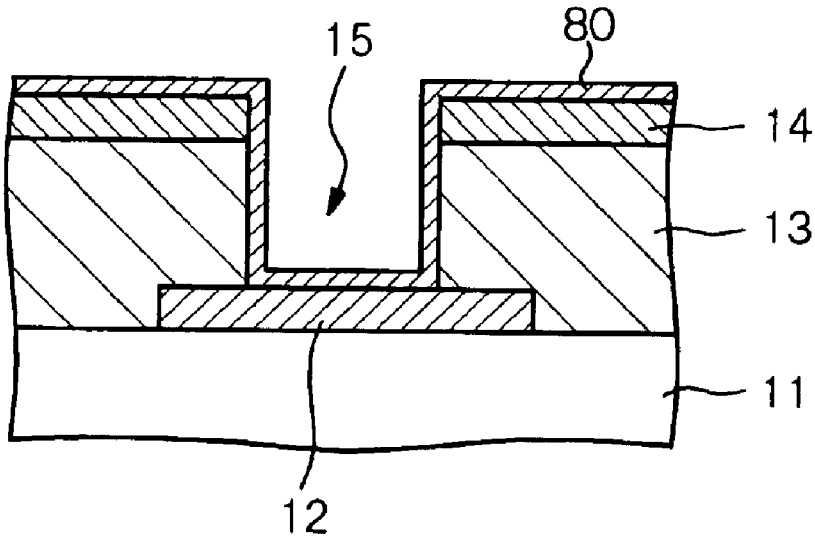

Then, an adhesion layer 80 is formed on the entire surface by a sputtering method (see FIG. 32B). The adhesion layer is provided for improving the adhesion of an electrically conductive material layer 81 to be formed in a step to follow to the insulating layer 13 exposed in a region where no gate-electrode is formed and to the side wall surfaces of the opening portions 15. On condition that tungsten is used to form the electrically conductive material layer 81, the adhesion layer 80, which is composed of tungsten, is formed as a 0.07 μm thick layer by a DC sputtering method.

[Step-1320]

Figure 33A:
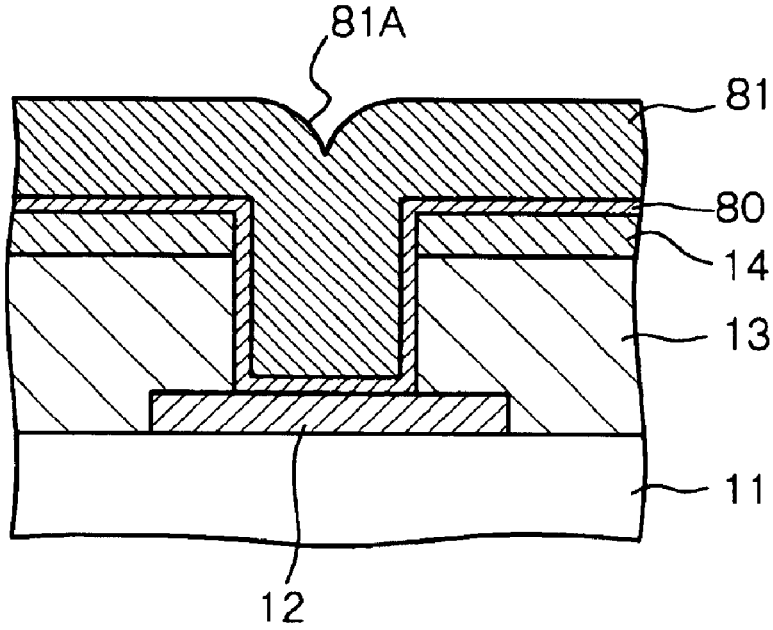
Figure 33B:
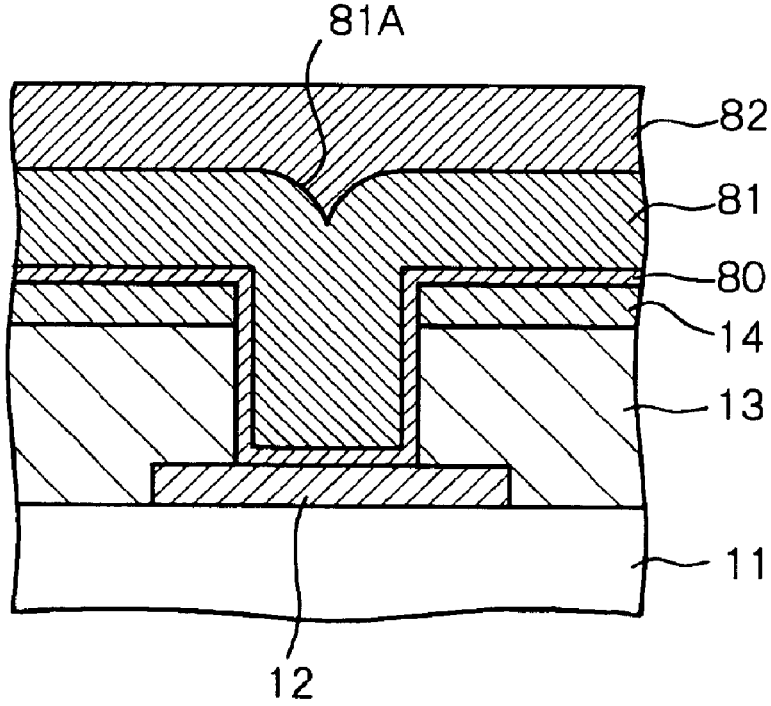
FIG. 33B, are schematic partial end views of the first support member, etc., for explaining [Spindt-type field emission device: Variant-1 of production method] for producing the Spindt-type field emission device shown in FIG. 35.

The electrically conductive material layer 81 for an electron-emitting portion is formed on the entire surface including the inside of the opening portion 15 by a hydrogen reduction pressure reduced CVD method, the electrically conductive material layer 81 having a thickness of approximately 0.6 μm and being composed of tungsten (see FIG. 33A). In the surface of the formed electrically conductive material layer 81, formed is a recess 81A reflecting a step between the top end surface and the surface of bottom portion of the opening portion 15.

[Step-1330]

A mask material layer 82 is formed so as to cover a region (specifically, the recess 81A) of the electrically conductive material layer 81 which region is positioned in the central portion of the opening portion 15. Specifically, a 0.35 μm thick resist layer as the mask material layer 82 is formed on the electrically conductive material layer 81 by a spin coating method (see FIG. 33B). The mask material layer 82 absorbs the recess 81A of the electrically conductive material layer 81 to form a nearly flat surface. Then, the mask material layer 82 is etched by an RIE method using oxygen-containing gas. The etching is terminated when a flat surface of the electrically conductive material layer 81 is exposed, whereby the mask material layer 82 remains so as to form a flat surface by filling itself in the recess 81A of the electrically conductive material layer 81 (see FIG. 34A).

[Step-1340]

Figure 34A:
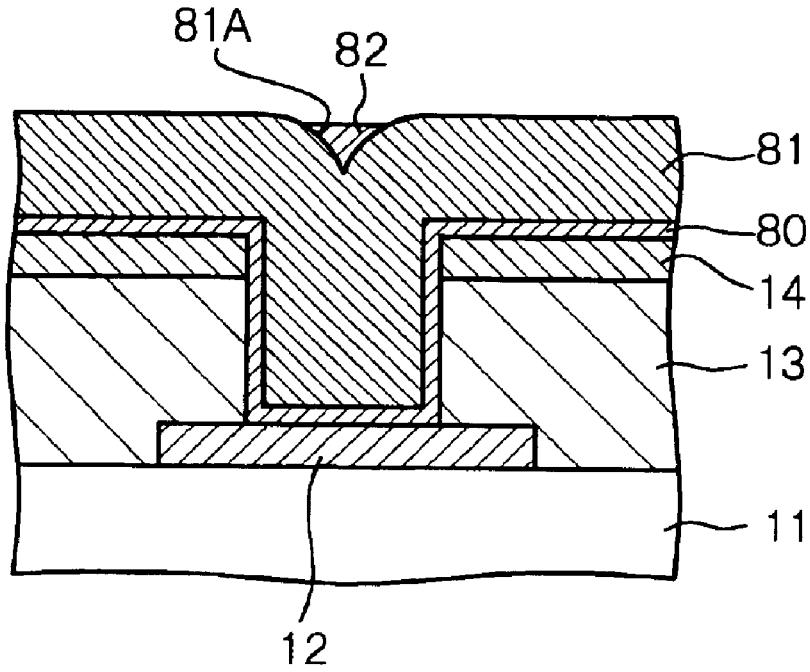
FIGS. 34A and 34B, following
Figure 34B:
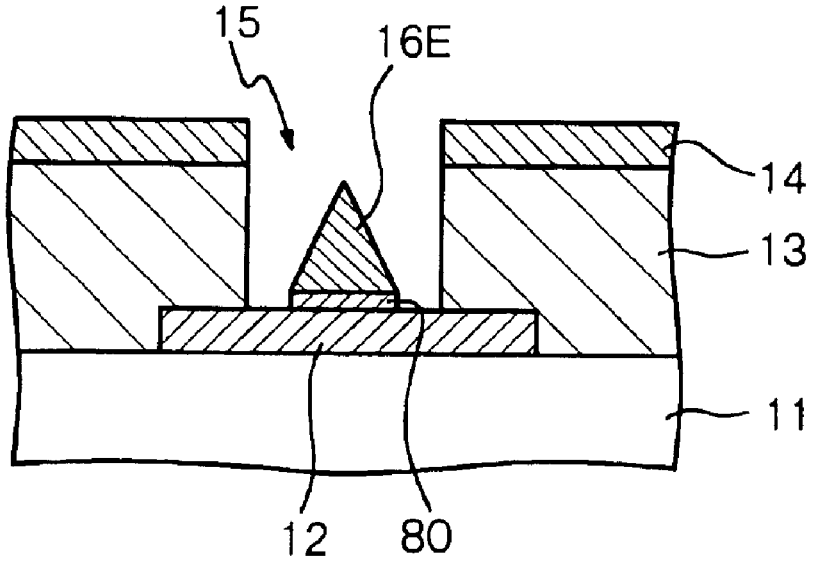

Then, the electrically conductive material layer 81, the mask material layer 82 and the adhesion layer 80 are etched to form a conical electron-emitting electrode 16E (see FIG. 34B). These are etched under an anisotropic etching condition where an etching rate of the electrically conductive material 81 is higher than an etching rate of the mask material layer 82. The following Table 2 shows the etching condition.

TABLE 2

[Etching condition of electrically conductive material layer 81, etc]

| | |
|---|---|
| $SF_6$ flow rate | 150 SCCM |
| $O_2$ flow rate | 30 SCCM |
| Ar flow rate | 90 SCCM |
| Pressure | 35 Pa |
| RF power | 0.7 kW (13.56 MHz) |

[Step-1350]

Figure 35:
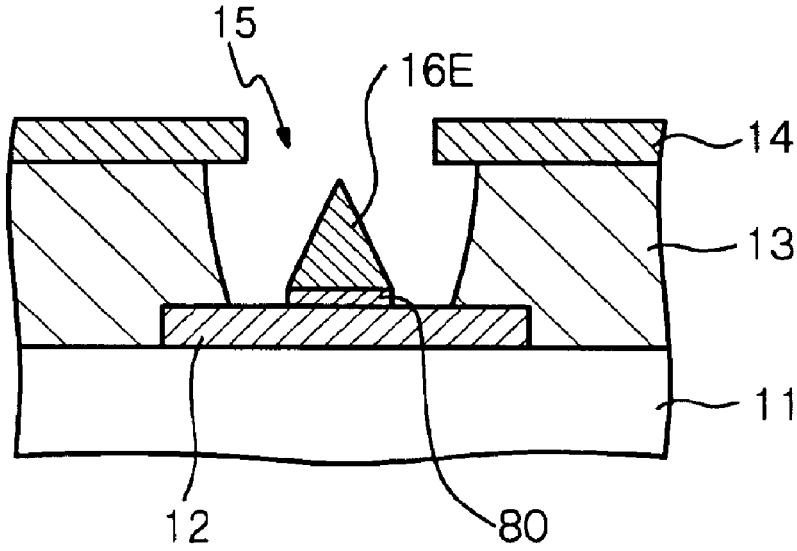
FIG. 35 is a schematic partial end view of a Spindt-type field emission device obtained in [Spindt-type field emission device: Variant-1 of production method].

Inside the opening portion 15 formed in the insulating layer 13, the side wall surface of the opening portion 15 is receded under an isotropic etching condition, whereby a field emission device shown in FIG. 35 is completed. The isotropic etching can be carried out by a dry etching method using radical as main etching species such as chemical dry etching, or by a wet etching method using an etching solution. As an etching solution, for example, there may be used a mixture containing a 49% hydrofluoric acid aqueous solution and pure water in a 49% hydrofluoric acid aqueous solution/pure water volume ratio of 1/100.

Figure 36A:
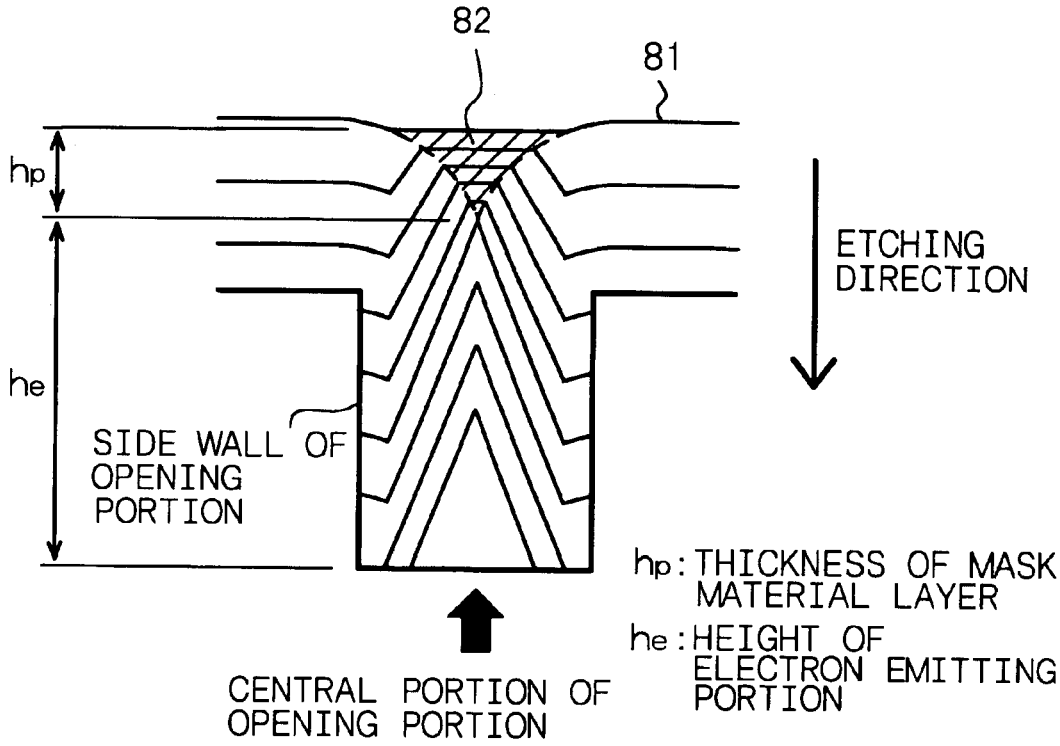
FIGS. 36A and 36B are drawings for explaining a mechanism of formation of a conical electron emitting portion.
Figure 36B:
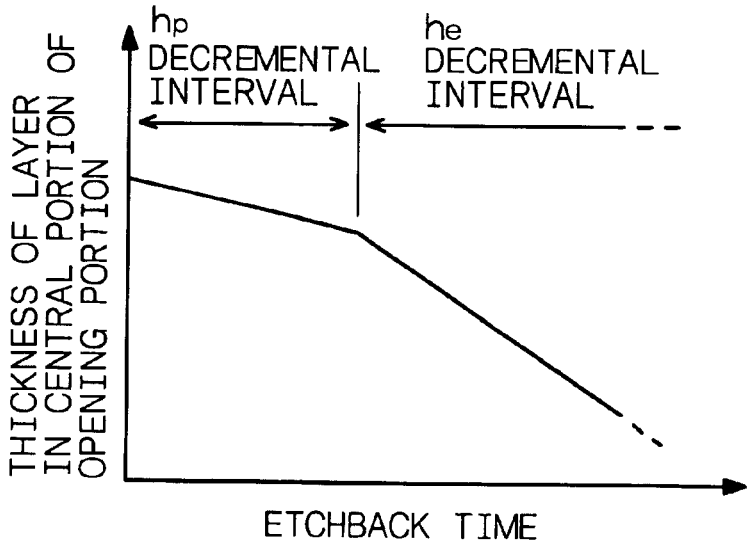

The mechanism of forming the electron-emitting electrode 16E in [Step-1340] will be explained with reference to FIGS. 36A and 36B. FIG. 36A schematically shows how the surface profile of a material to be etched changes at constant time intervals as the etching proceeds, and FIG. 36B is a graph showing a relationship between an etching time and a thickness of the material being etched in the center of the opening portion 15. The mask material layer has a thickness $h_p$ in the center of the opening portion 15, and the electron-emitting electrode 16E has a height $h_e$ in the center of the opening portion 15.

Under the etching condition shown in Table 2, the etching rate of the electrically conductive material layer 81 is naturally higher than the etching rate of the mask material layer 82 composed of a resist material. In a region where no mask material layer 82 is present, the electrically conductive material layer 81 immediately begins to be etched, and the surface of the material being etched readily goes down. In contrast, in a region where the mask material layer 82 is present, the electrically conductive material layer 81 begins to be etched only after the mask material layer 82 is removed first. While the mask material layer 82 is etched, therefore, the decremental rate of thickness of the material being etched is low ($h_p$ decremental interval), and the decremental rate of thickness of the material being etched comes to be as high as the etching rate in the region where no mask material layer 82 is present only when the mask material layer 82 disappears ($h_e$ decremental interval). The time at which the $h_e$ decremental interval begins comes last in the center of the opening portion 15 where the mask material layer 82 has a largest thickness, and comes earlier in a region nearer to the circumference of the opening portion 15 where the mask material layer 82 has a smaller thickness. In the above manner, the electron-emitting electrode 16E having a conical form is formed.

Figure 37A:
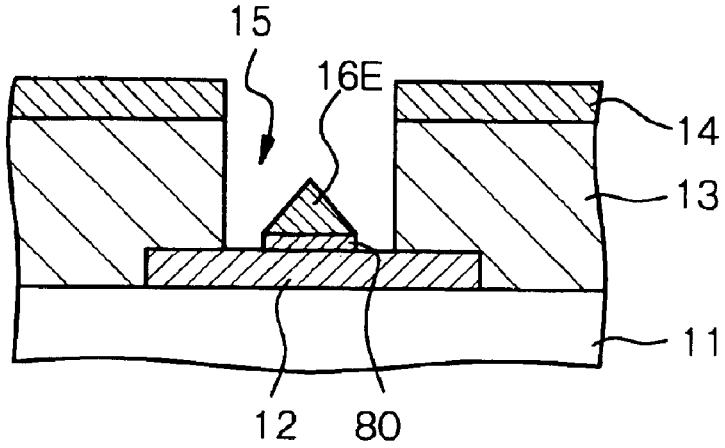
FIGS. 37A to 37C are schematic drawings for showing a relationship between a selectivity-to-resist ratio and a height and form of an electron emitting portion.
Figure 37B:
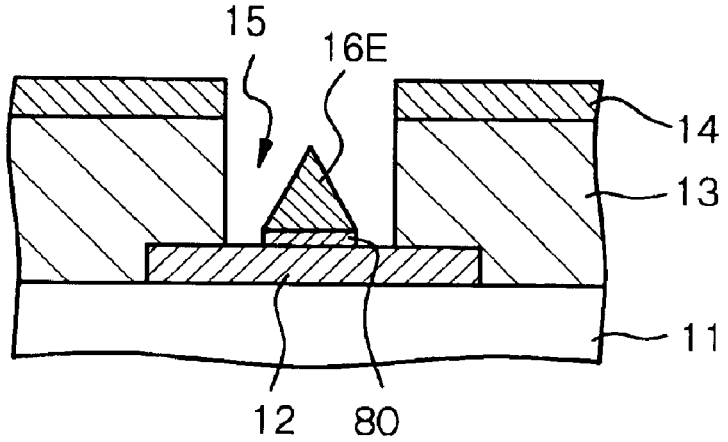
Figure 37C:
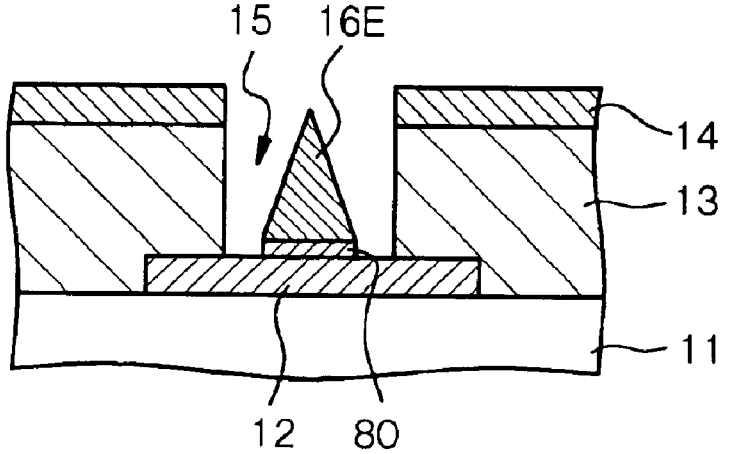

The ratio of the etching rate of the electrically conductive material layer 81 to the etching rate of the mask material layer 82 composed of a resist material will be referred to as "selective ratio to a resist". The selective ratio to a resist is an important factor for determining the height and the form of the electron-emitting electrode 16E. This point will be explained with reference to FIGS. 37A, 37B and 37C. FIG. 37A shows a form of the electron-emitting electrode 16E when the selective ratio to a resist is relatively small. FIG. 37C shows a form of the electron-emitting electrode 16E when the selective ratio to a resist is relatively large. FIG. 37B shows a form of the electron-emitting electrode 16E when the selective ratio to a resist is intermediate. It is seen that with an increase in the selective ratio to a resist, the film decrease of the electrically conductive material layer 81 is sharp as compared with the film decrease of the mask material layer 82, so that the electron-emitting electrode 16E has a larger height and a sharper form. The selective ratio to a resist decreases with an increase in the $O_2$ flow rate relative to the $SF_6$ flow rate. When an etching apparatus which makes it possible to change the incidence energy of ion by co-using substrate bias is used, the selective ratio to a resist can be decreased by increasing the RF bias power or decreasing the frequency of AC current for bias application. When the selective ratio to a resist is selected, it is at least 1.5, preferably at least 2, more preferably at least 3.

In the above etching, naturally, it is required to secure a high selective etching ratio to the gate electrode 14 and the cathode electrode 12. Under the condition shown in Table 2, no problems occur. The reason therefore is explained below. The material constituting the gate electrode 14 or the cathode electrode 12 is hardly etched with fluorine-containing etching species. Under the above condition, a selective etching ratio of approximately 10 or more can be obtained.

[Spindt-Type Field Emission Device: Variant-2 of Production Method]

Variant-2 of production method of Spindt-type field emission device is a variant of the Variant-1 of production method of Spindt-type field emission device. In the variant-2 of production method, the region of the electrically conductive material layer which region is covered with the mask material layer can be narrowed as compared with the Variant-2 of production method. In the Variant-2 of production method, a nearly funnel-like recess having a columnar portion and a widened portion communicating with the upper end of the columnar portion is formed in a surface of the electrically conductive material layer by utilizing a step between the upper end surface and the surface of bottom portion of the opening portion, and in the step (f), the mask material layer is formed on the entire surface of the electrically conductive material layer. Then, the mask material layer and the electrically conductive material layer are removed in a plane in parallel with the surface of the first supporting substrate, whereby the mask material layer is retained in the columnar portion.

Variant-2 of production method of Spindt-type field emission device will be explained hereinafter with reference to FIGS. 38A, 38B, 39A, 39B, 40A and 40B showing schematic partial end views of a first supporting substrate, etc.

[Step-1400]

First, the cathode electrode 12 is formed on the first supporting substrate 11. That is, an electrically conductive material layer for a cathode electrode is formed by stacking a TiN layer (thickness 0.1 $\mu$m), a Ti layer (thickness 5 nm), an Al—Cu layer (thickness 0.4 $\mu$m), a Ti layer (thickness 5 nm), a TiN layer (thickness 0.02 $\mu$m) and a Ti layer (thickness 0.02 $\mu$m) in this order, for example, by a DC sputtering method to form a stacked layer and patterning the stacked layer in the form of a stripe. Figures show the cathode electrode 12 as a single layer. Then, a 0.7 $\mu$m thick insulating layer 13 is formed on the entire surface, specifically, on the first supporting substrate 11 and the cathode electrode 12 by a plasma CVD method using TEOS (tetraethoxysilane) as a source gas. Then, a gate-electrode 14 in the form of a stripe is formed on the insulating layer 13.

Figure 38A:
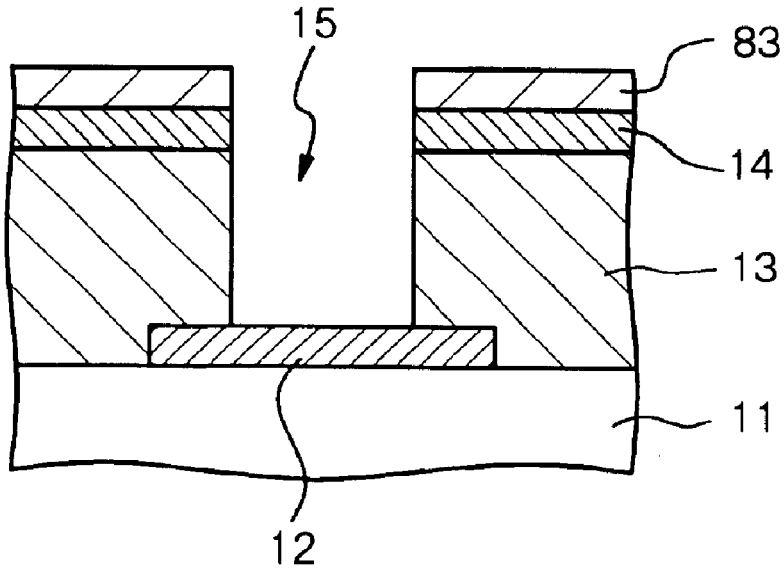
FIGS. 38A and 38B are schematic partial end views of a first support member, etc., for explaining [Spindt-type field emission device: Variant-2 of production method].

Further, a 0.2 $\mu$m thick etching-stop layer 83 composed of $SiO_2$ is formed on the entire surface. The etching-stop layer 83 is not essential for the function of the field emission device but works to protect the gate electrode 14 when the electrically conductive material layer 81 is etched in a step to come later. When the gate electrode 14 has sufficiently high etching durability against an etching condition for the electrically conductive material layer 81, the etching stop layer 83 may be omitted. Then, an opening portion 15 is formed through the etching stop layer 83, the gate electrode 14 and the insulating layer 13 by an RIE method. The cathode electrode 12 is exposed in a bottom portion of the opening portion 15. In this manner, a state shown in FIG. 38A is obtained.

[Step-1410]

Figure 38B:
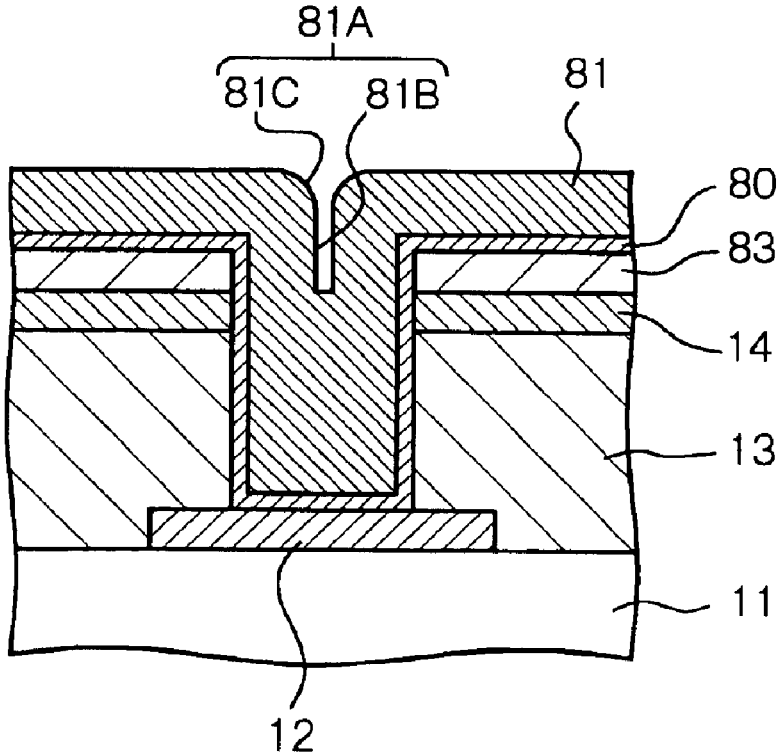

Then, a 0.03 $\mu$m thick adhesion layer 80 composed, for example, of tungsten is formed on the entire surface including the inside of the opening portion 15 (see FIG. 38B). Then, an electrically conductive material layer 81 for an electron-emitting portion is formed on the entire surface including the inside of the opening portion 15. In Variant-2 of production method, the thickness of the electrically conductive material layer 81 is determined such that a recess 81A having a larger depth than the recess 81A in Variant-1 of production method is formed in the surface. That is, the thickness of the electrically conductive material layer 81 is properly determined, whereby there can be formed a nearly funnel-like recess 81A having a columnar portion 81B and a widened portion 81C communicating with the upper end of the columnar portion 81B in the surface of the conductive material layer 81 by utilizing a step between the upper end surface and the surface of bottom portion of the opening portion 15.

[Step-1420]

Figure 39A:
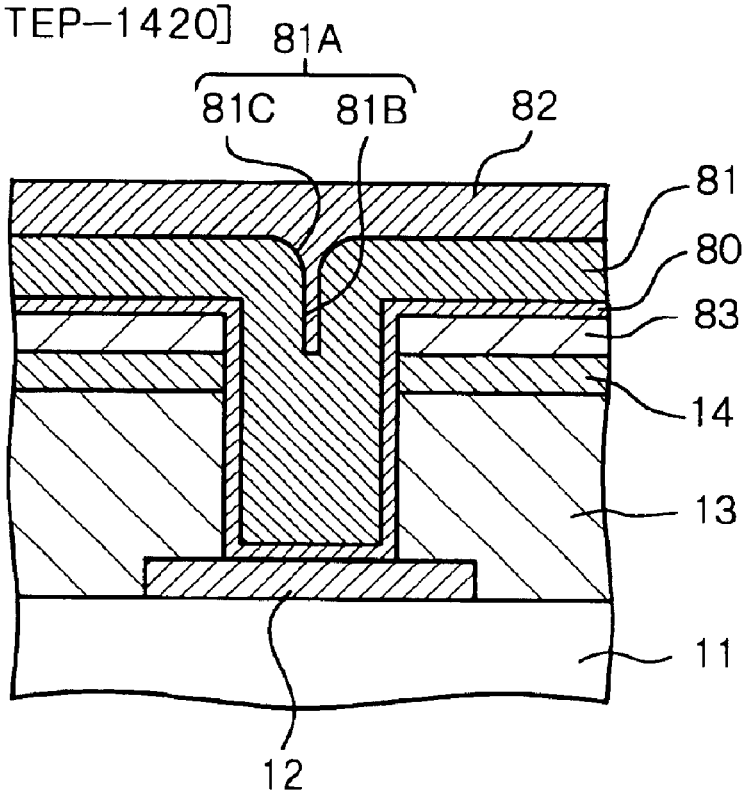
FIGS. 39A and 39B, following

Then, an approximately 0.5 $\mu$m thick mask material layer 82 composed of copper (Cu) is formed on the entire surface of the electrically conductive material layer 81 by an electroless plating method (see FIG. 39A). Table 3 shows a condition of the electroless plating.

TABLE 3

| | | |
|---|---|---|
| Plating solution | Copper sulfate ($CuSO_4.5H_2O$) | 7 g/liter |
| | Formalin (37% HCHO) | 20 ml/liter |
| | Sodium hydroxide (NaOH) | 10 g/liter |
| | Potassium sodium tartarate | 20 g/liter |
| Plating bath temperature | 50° C. | |

[Step-1430]

Figure 39B:
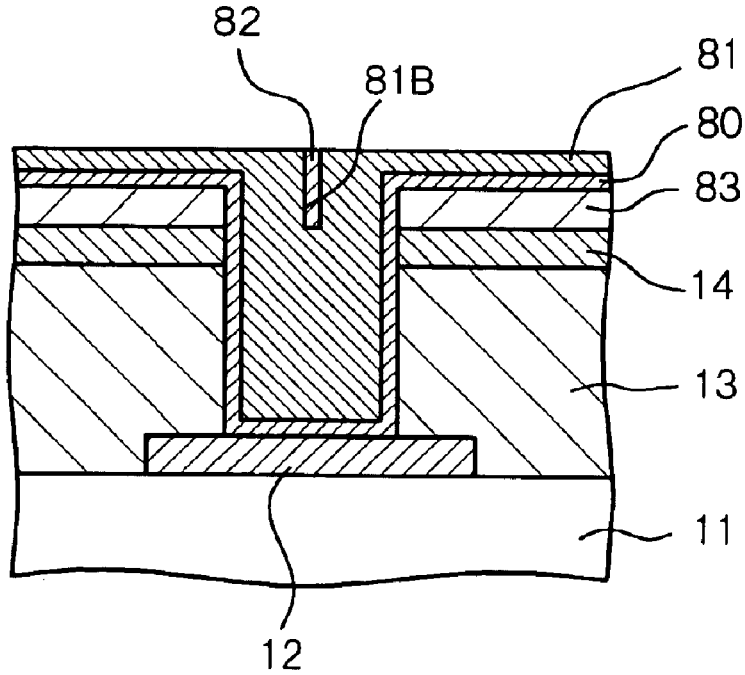

Then, the mask material layer 82 and the electrically conductive material layer 81 are removed in a plane in parallel with the surface of the first supporting substrate 11, to retain the mask material layer 82 in the columnar portion 81B (see FIG. 39B). The above removal can be carried out, for example, by a chemical/mechanical polishing (CMP) method.

[Step-1440]

Then, the electrically conductive material layer 81, the mask material layer 82 and the adhesion layer 80 are etched under an anisotropic etching condition where etching rates of the electrically conductive material layer 81 and the adhesion layer 80 are higher than an etching rate of the mask material layer 82. As a result, an electron-emitting electrode 16E having a conical form is formed in the opening portion 15 (see FIG. 40A). When the top end portion of the electron-emitting electrode 16E has a residual mask material layer 82, the residual mask material layer 82 can be removed by a wet etching method using a diluted hydrofluoric acid aqueous solution.

[Step-1450]

Figure 40A:
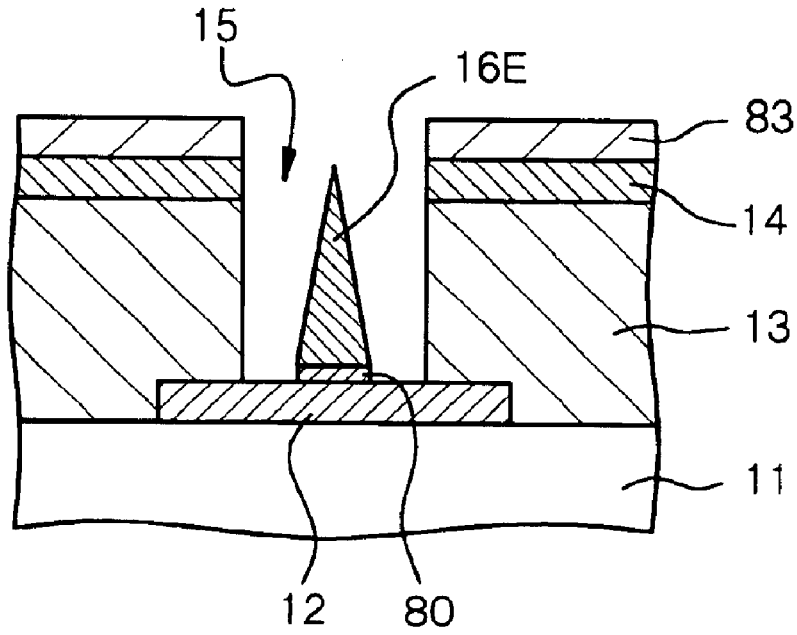
FIGS. 40A and 40B, following
Figure 40B:
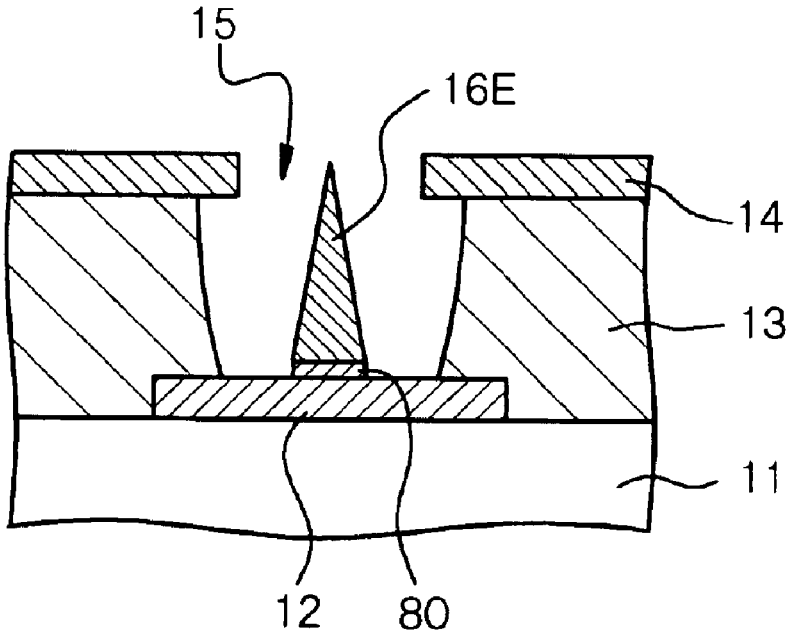

Inside the opening portion 15 formed in the insulating layer 13, the side wall surface of the opening portion 15 is receded under an isotropic etching condition, whereby an field emission device shown in FIG. 40B is completed. At this time, the etching-stop layer 83 is removed. For the isotropic etching, there can be employed those explained in Variant-1 of production method.

Figure 41A:
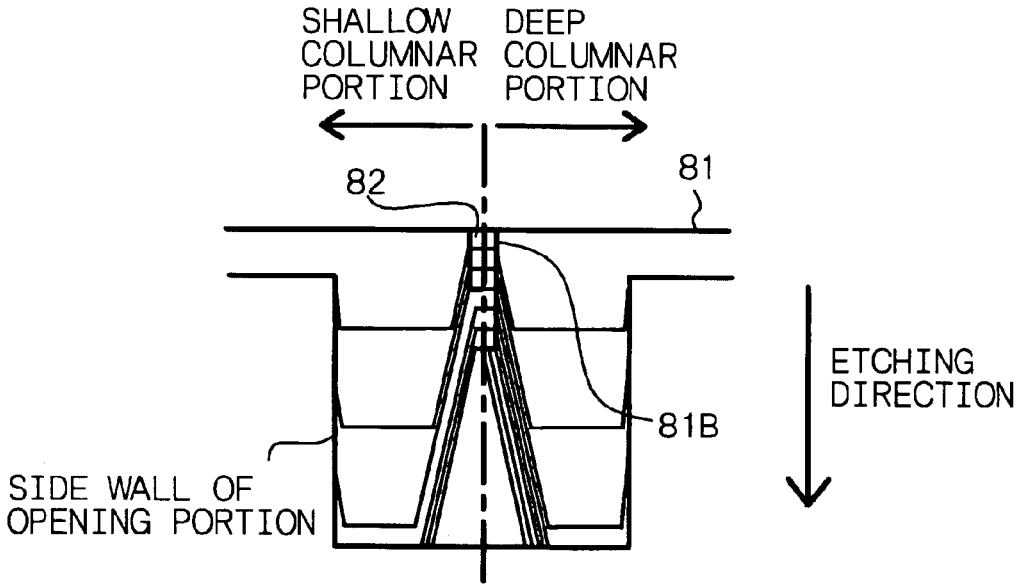
FIGS. 41A and 41B are drawings showing how the surface profile of a material etched changes at predetermined time intervals.
Figure 41B:
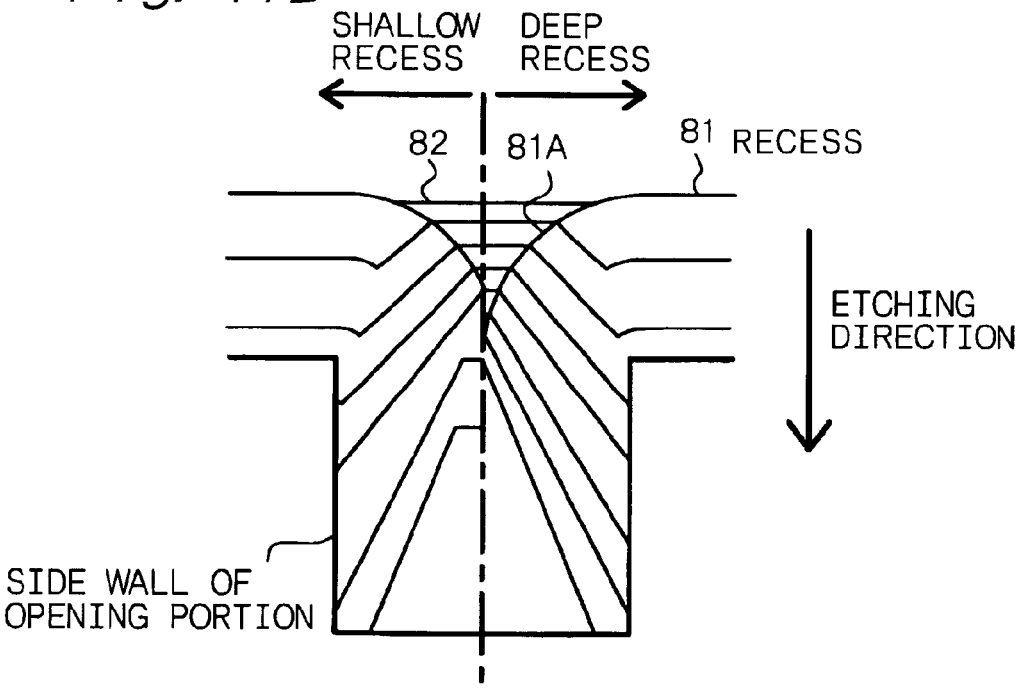

Meanwhile, in the electron-emitting electrode 16E formed in Variant-2 of production method, a sharper conical form is formed than the counterpart in the electron emitting electrode 16E formed in Variant-1 of production method. This difference is caused by differences in form of the mask material layers 82 and the ratio of the etching rate of electrically conductive material layer 81 to the etching rate of the mask material layer 82. The above differences will be explained with reference to FIGS. 41A and 41B. FIGS. 41A and 41B show how the surface profile of a material being etched changes at constant intervals of time. FIG. 41A shows a case using a mask material layer 82 composed of copper, and FIG. 41B shows a case using a mask material layer 82 composed of a resist material. For simplification, it is assumed that the etching rate of the electrically conductive material layer 81 and the etching rate of the adhesion layer 80 are the same, and showing of the adhesion layer 80 is omitted in FIGS. 41A and 41B.

When the mask material layer 82 composed of copper is used (see FIG. 41A), the mask material layer 82 will not disappear during etching since the etching rate of the mask material layer 82 is sufficiently low as compared with the etching rate of the electrically conductive material layer 81, so that an electron-emitting electrode 16E having a sharp top end portion can be formed. In contrast, when a mask material layer 82 composed of a resist material is used (see FIG. 41B), the mask material layer 82 is liable to disappear during the etching since the etching rate of the mask material layer 82 is not as high as the etching rate of the electrically conductive material layer 81. After the mask material layer disappears, therefore, the conical form of the electron-emitting electrode 16E tends to become obtuse.

Further, the mask material layer 82 remaining in the columnar portion 81B has a merit that the form of the electron-emitting electrode 16E does not much change even if the depth of the columnar portion 81B changes to some extent. That is, the depth of the columnar portion 81B can vary depending upon the thickness of the electrically conductive material layer 81 and the fluctuation of the step coverage. Since, however, the width of the columnar portion 81B is nearly constant regardless of the depth, the width of the mask material layer 82 comes to be nearly constant, so that there is not much difference in the form of the electron-emitting electrode 16E finally formed. In contrast, in the mask material layer 82 retained in the recess 81A, the width of the mask material layer changes depending upon whether the recess 81A has a large depth or a small depth, so that the conical form of the electron-emitting electrode 16E begins to become obtuse earlier when the recess 81A is shallower and when the mask material layer 82 has a smaller thickness. The electron emission efficiency of the field emission device changes depending upon a potential difference between the gate electrode and the cathode electrode, a distance between the gate electrode and the cathode electrode and a work function of a material constituting the electron-emitting portion, and it also changes depending upon the form of top end portion of the electron emitting portion. It is therefore preferred to make the above selection of the form and the etching rate of the mask material layer as required.

[Spindt-Type Field Emission Device: Variant-3 of Production Method]

Variant-3 of production method is a variant of Variant-2 of production method. In the Variant-3 of production method, a nearly funnel-like recess having a columnar portion and a widened portion communicating with the upper end portion of the columnar portion is formed in a surface of the electrically conductive material layer in step (e), the columnar portion reflecting a step between the upper end surface and the surface of bottom portion of the opening portion, and in step (f), the mask material layer is formed on the entire surface of the electrically conductive material layer, and the mask material layer on the electrically conductive material layer and inside the widened portion is removed, whereby the mask material layer is retained in the columnar portion. Variant-3 of production method of Spindt-type field emission device will be explained hereinafter with reference to FIGS. 42A, 42B and 43 showing schematic partial end views of the first supporting substrate, etc.

[Step-1500]

Figure 42A:
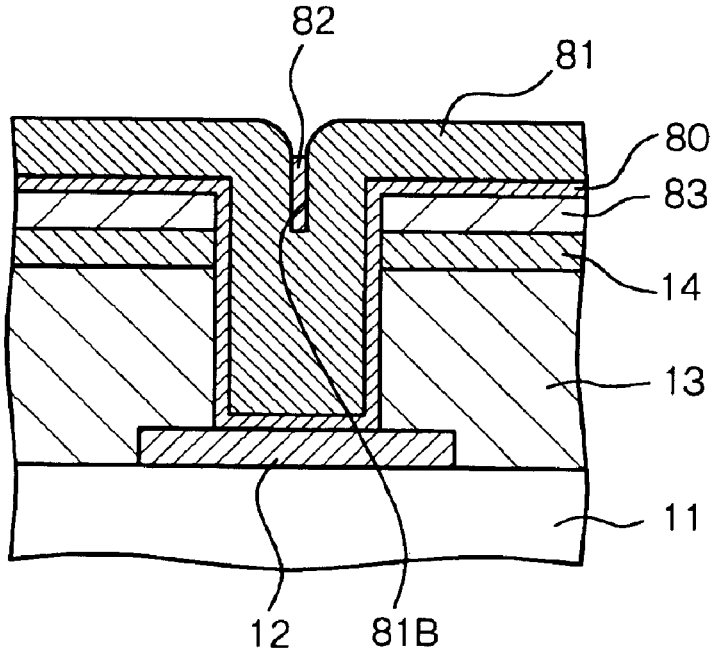
FIGS. 42A and 42B are schematic partial end views of a first support member, etc., for explaining [Spindt-type field emission device: Variant-3 of production method].
Figure 42B:
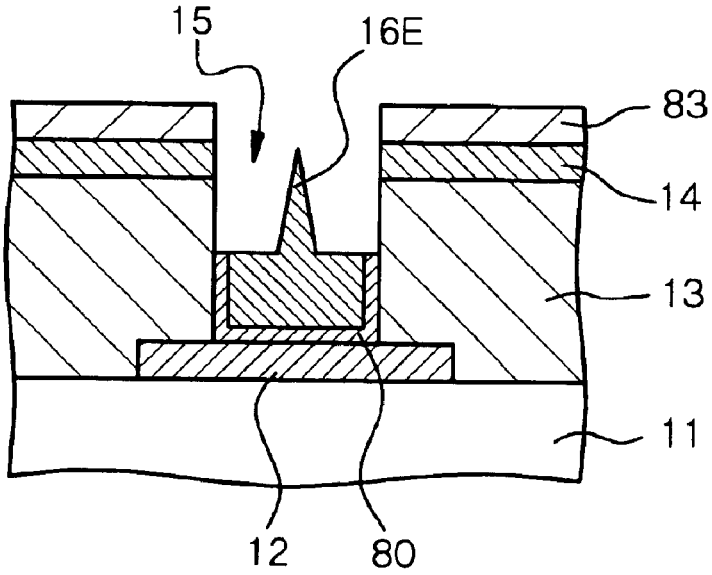
Figure 43:
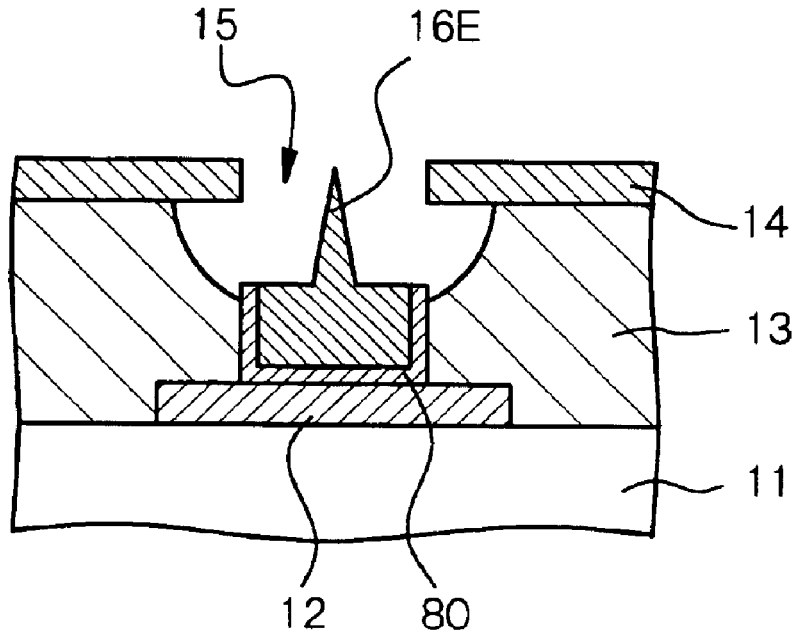
FIG. 43, following

Procedures up to the formation of the mask material layer 82 shown in FIG. 39A are carried out in the same manner as in [Step-1400] to [Step-1420] in Variant-2 of production method, and then the mask material layer 82 only on the electrically conductive material layer 81 and inside the widened portion 81C is removed, to retain the mask material layer 82 in the columnar portion 81B (see FIG. 42A). In this case, wet etching is carried out, for example, with a diluted hydrofluoric acid aqueous solution, whereby only the mask material layer 82 composed of copper can be selectively removed without removing the electrically conductive material layer 81 composed of tungsten. The height of the mask material layer 82 remaining in the columnar portion 81B differs depending upon the etching time period. However, the etching time period is not so strict so long as the mask material layer 82 filled in the widened portion 81C is fully removed. The reason therefore is as follows. A discussion on the height of the mask material layer 82 is substantially the same as the above discussion made on the depth of the columnar portion 81B with reference to FIG. 41A, and the height of the mask material layer 82 has no major effect on the form of the electron-emitting electrode 16E to be finally formed.

[Step-1510]

Then, the electrically conductive material layer 81, the mask material layer 82 and the adhesion layer 80 are etched in the same manner as in Variant-2 of production method, to form the electron-emitting electrode 16E shown in FIG. 42B. While the electron-emitting electrode 16E may naturally have a conical form as a whole as shown in FIG. 40A, FIG. 42B shows a variant in which a top portion alone has a conical form. Such a form is produced when the height of the mask material layer 82 filled in the columnar portion 81B is small or when the etching rate of the mask material layer 82 is relatively high. Such a form does not at all affect the function of the electron-emitting electrode 16E.

[Step-1520]

In the opening portion 15 formed in the insulating layer 13, the side wall surface of the opening portion 15 is receded under an isotropic etching condition, whereby the field emission device shown in FIG. 43 is completed. The isotropic etching can be carried out in the same manner as in the production method explained in Variant-2 of production method.

[Spindt-Type Field Emission Device: Variant-4 of Production Method]

Figure 44:
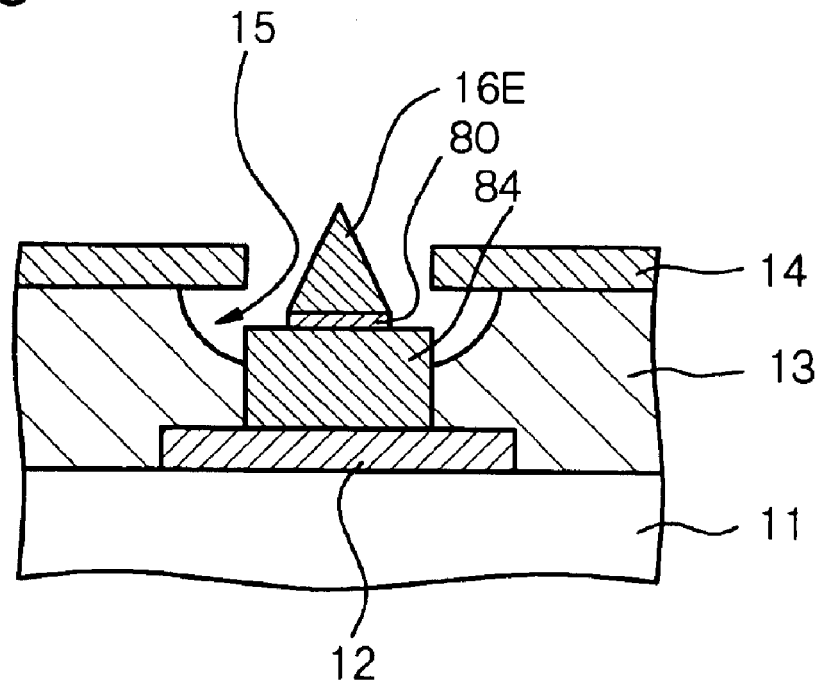
FIG. 44 is a schematic partial end view of a Spindt-type field emission device produced in [Spindt-type field emission device: Variant-4 of production method].
Figure 45A:
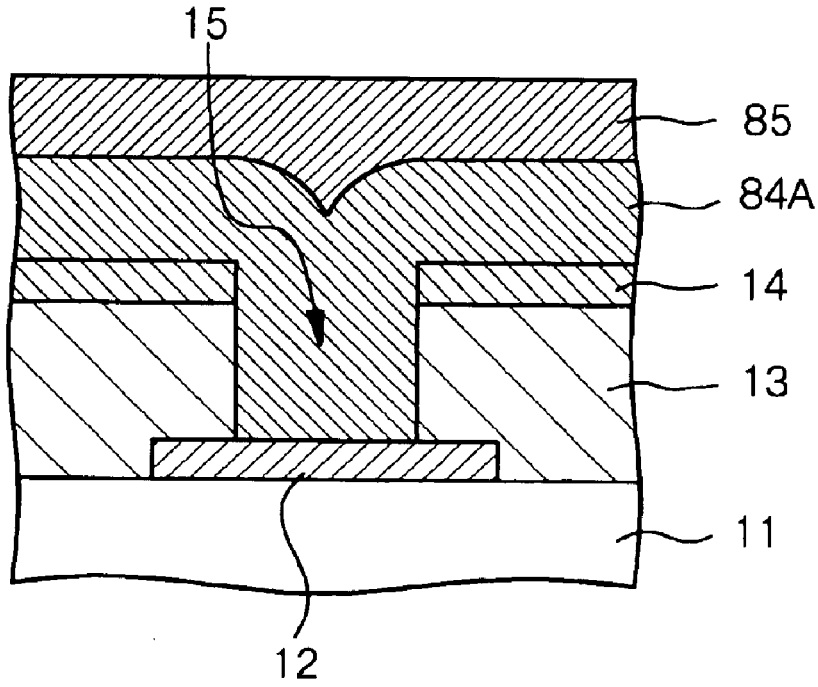
FIGS. 45A and 45B are schematic partial end views of a first support member, etc., for explaining [Spindt-type field emission device: Variant-4 of production method].
Figure 45B:
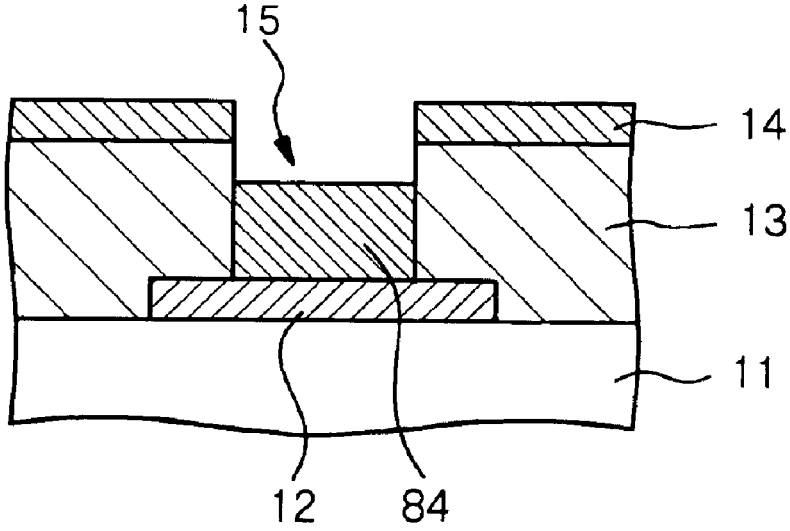

Variant-4 of production method is a variant of the Variant-1 of production method. FIG. 44 shows a schematic partial end view of Spindt-type field emission device produced by using Variant-4 of production method. Variant-4 of production method differs from Variant-1 of production method in that the electron-emitting portion has a base 84 and a conical electron-emitting electrode 16E stacked on the base 84. The base 84 is composed of one material, and the electron-emitting electrode 16E is composed of another material. Specifically, the base 84 is a member for adjusting a distance between the electron-emitting electrode 16E and the opening end portion of the gate electrode 14, has a function as a resistance layer and is constituted of a polysilicon layer containing an impurity. The electron-emitting electrode 16E is composed of tungsten, and has a conical form, more specifically, the form of a circular cone. An adhesion layer 80 composed of TiN is formed between the base 84 and the electron-emitting electrode 16E. The adhesion layer 80 is not a component essential for the function of the electron-emitting portion but is provided for a production-related reason. The insulating layer 13 is scraped from immediately below the gate electrode 14 toward the upper end portion of the base 84, to form an opening portion 15.

Variant-4 of production method will be explained hereinafter with reference to FIGS. 45A, 45B, 46A, 46B, 47A and 47B showing schematic partial end views of the first supporting substrate, etc.

[Step-1600]

First, procedures up. to the formation of the opening portion 15 are carried out in the same manner as in [Step-1300] in Variant-1 of production method. Then, an electrically conductive material layer 84A for forming the base is formed on the entire surface including the inside of the opening portion 15. The electrically conductive material layer 84A also works as a resistance layer, is constituted of a polysilicon layer and can be formed by a plasma CVD method. Then, a flattening layer 85 constituted of a resist layer is formed on the entire surface by a spin coating method so as to form a nearly flat surface (see FIG. 45A). Then, the flattening layer 85 and the electrically conductive material layer 84A are etched under a condition where etching rates of these layers are nearly the same, to fill bottom portion of the opening portion 15 with the base portion 84 having a flat upper surface (see FIG. 45B). The etching can be carried out by an RIE method using an etching gas containing a chlorine-containing gas and an oxygen-containing gas. Since the etching is carried out after the surface of the electrically conductive material layer 84A is flattened with the flattening layer 85, the base 84 comes to have a flat upper surface.

[Step-1610]

Figure 46A:
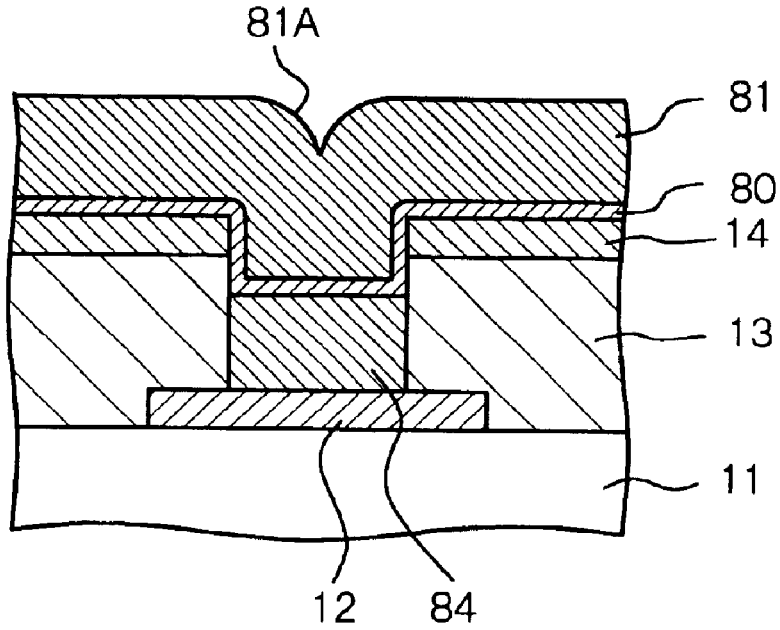
FIGS. 46A and 46B, following

Then, an adhesion layer 80 is formed on the entire surface including the inside of rest of the opening portion 15, and an electrically conductive material layer 81 for an electron-emitting portion is formed on the entire surface including the inside of the rest of the opening portion 15, to fill the rest of the opening portion 15 with the electrically conductive material layer 81 (see FIG. 46A). The adhesion layer 80 is a 0.07 $\mu$m thick TiN layer formed by a sputtering method, and the electrically conductive material layer 81 is a 0.6 $\mu$m thick tungsten layer formed by a reduced pressure CVD method. A recess 81A reflecting a step between the upper end surface and the surface of bottom portion of the opening portion 15 is formed in the surface of the electrically conductive material layer 81.

[Step-1620]

Figure 46B:
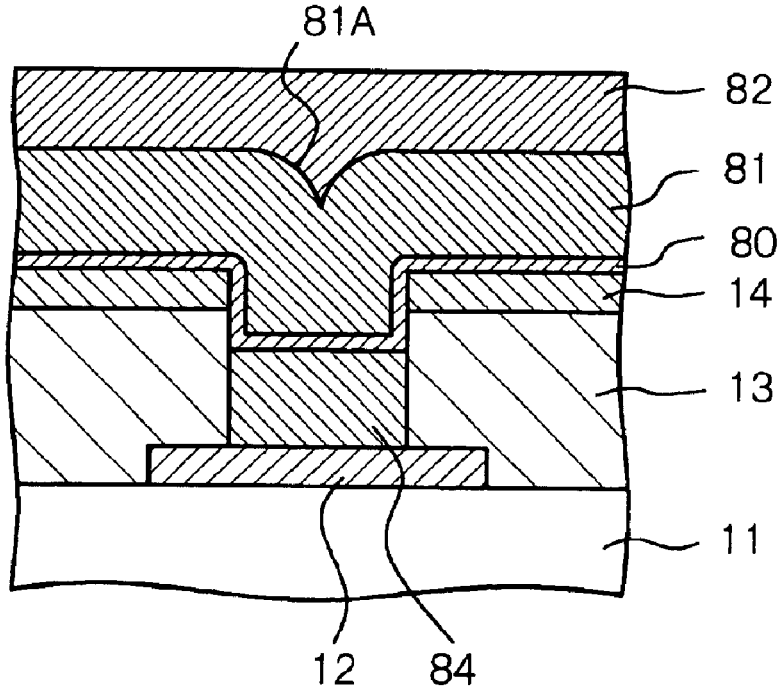

Then, a mask material layer 82 constituted of a resist layer is formed on the entire surface of the electrically conductive material layer 81 by a spin coating method to form a nearly flat surface (FIG. 46B). The mask material layer 82 absorbs the recess 81A in the surface of the electrically conductive material layer 81 and forms a nearly flat surface. Then, the mask material layer 82 is etched by an RIE method using an oxygen gas (see FIG. 47A). The etching is terminated when a flat surface of the electrically conductive material layer 81 is exposed. In this manner, the mask material layer 82 is retained in the recess 81A of the electrically conductive material 81 to form a flat surface, and the mask material layer 82 is formed so as to cover a region of the electrically conductive material layer 81 which region is positioned in the center of the opening portion 15.

[Step-1630]

Figure 47A:
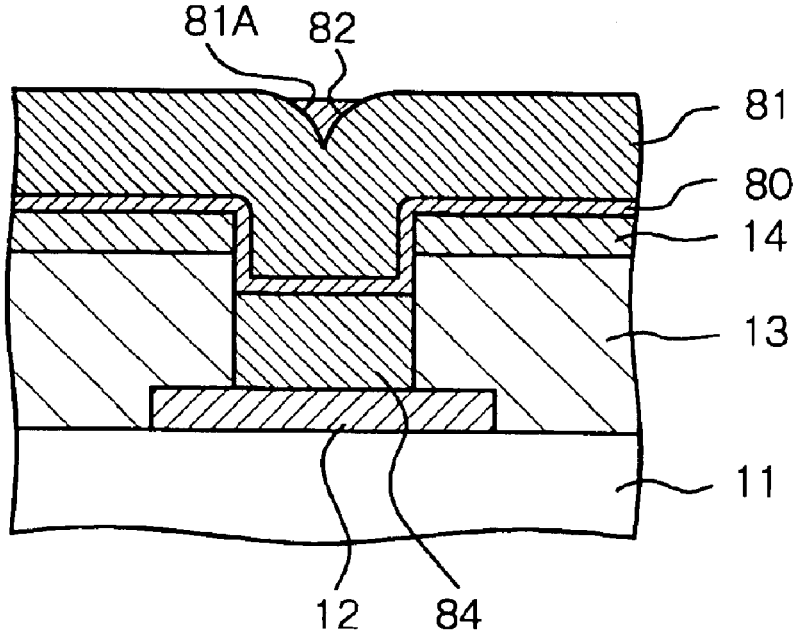
FIGS. 47A and 47B, following
Figure 47B:
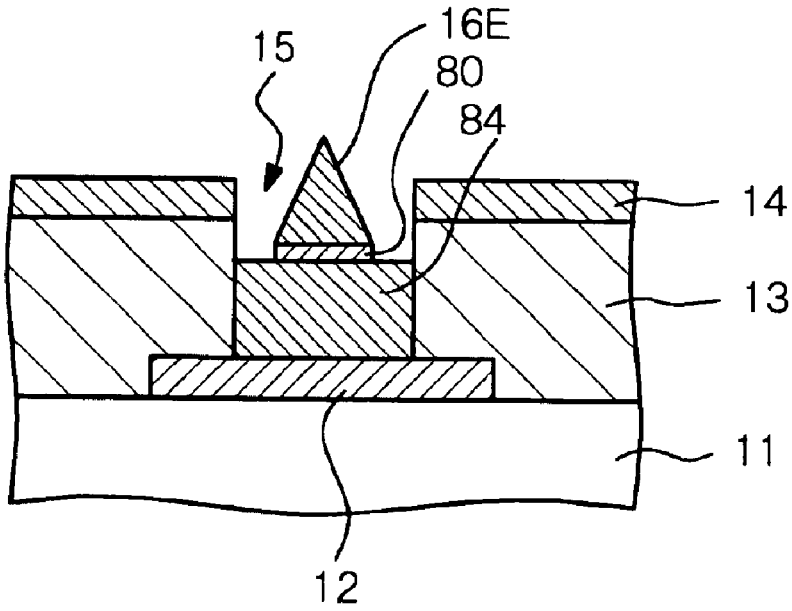

Then, the electrically conductive material layer 81, the mask material layer 82 and the adhesion layer 80 are etched together in the same manner as in [Step-1340] in Variant-2 of production method, whereby the electron-emitting electrode 16E having a conical form depending upon the selective ratio to a resist based on the above-described mechanism and the adhesion layer 80 are formed, and the electron-emitting portion is completed (see FIG. 47B). Then, inside the opening portion 15 formed in the insulating layer 13, the side wall surface of the opening portion 15 is receded, whereby an field emission device shown in FIG. 44 can be obtained.

[Spindt-Type Field Emission Device: Variant-5 of Production Method]

Figure 49A:
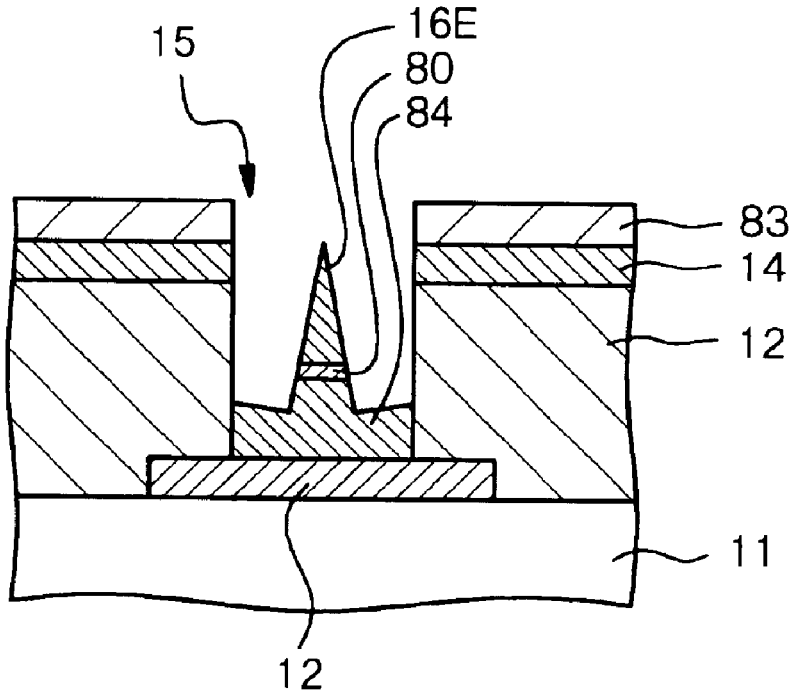
FIGS. 49A and 49B, following
Figure 49B:
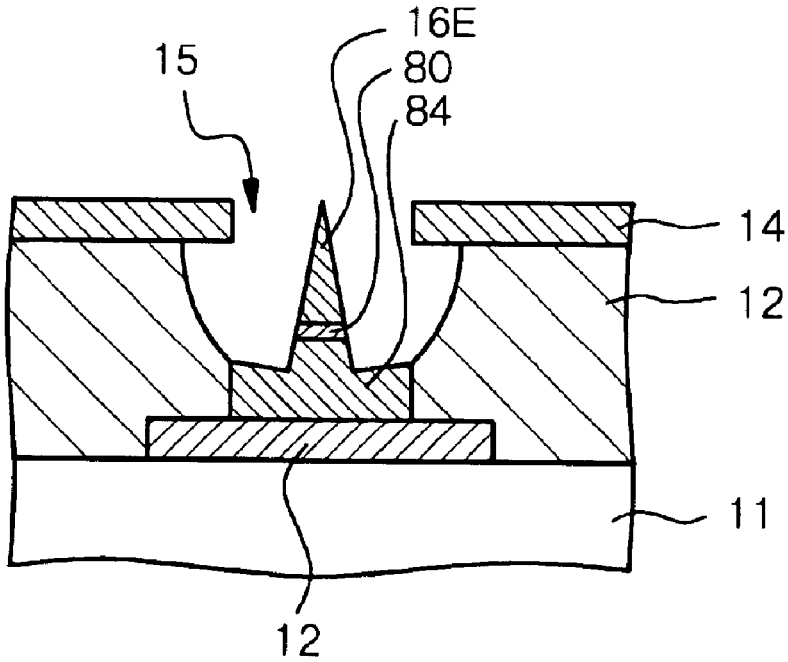

Variant-5 of production method is a variant of the Variant-2 of production method. FIG. 49B shows a schematic partial end view of Spindt-type field emission device produced by using Variant-5 of production method. Variant-5 of production method differs from Variant-2 of production method in that the electron-emitting portion has a base 84 and a conical electron-emitting electrode 16E stacked on the base 84 like the electron-emitting portion in Variant-4 of production method. The base 84 is composed of one material, and the electron-emitting electrode 16E is composed of another material. Specifically, the base 84 is a member for adjusting a distance between the electron-emitting electrode 16E and the opening end portion of the gate electrode 14, has a function as a resistance layer and is constituted of a polysilicon layer containing an impurity. The electron-emitting electrode 16E is composed of tungsten, and has a conical form, more specifically, the form of a circular cone. An adhesion layer 80 composed of TiN is formed between the base 84 and the electron-emitting electrode 16E. The adhesion layer 80 is not a component essential for the function of the electron-emitting portion but is provided for a production-related reason. The insulating layer 13 is scraped from immediately below the gate electrode 14 toward the upper end portion of the base 84, to form an opening portion 15.

Variant-5 of production method will be explained hereinafter with reference to FIGS. 48A, 48B, 49A and 49B showing schematic partial end views of a first supporting substrate, etc.

[Step-1700]

Figure 48A:
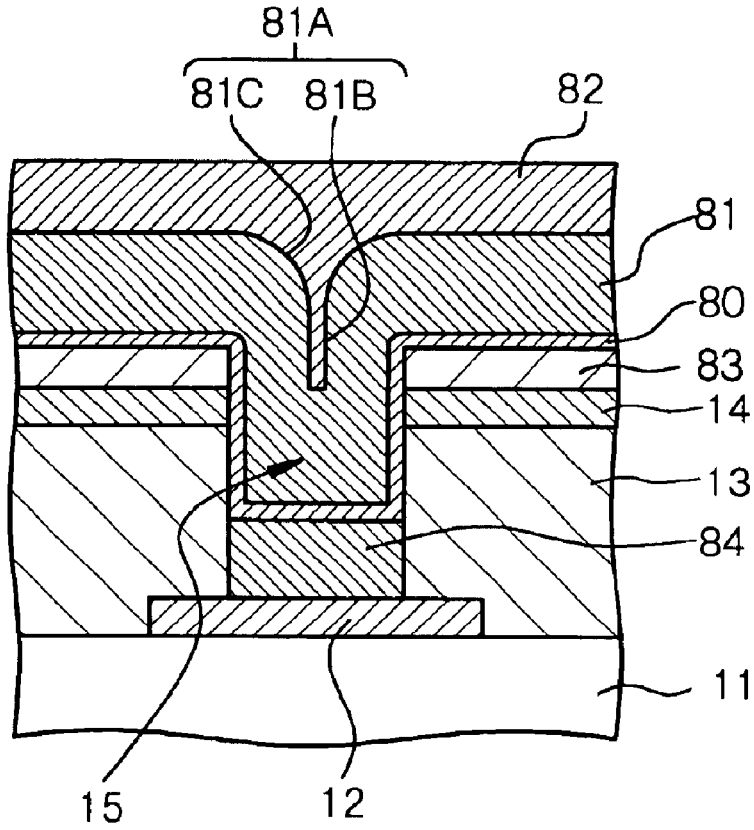
FIGS. 48A and 48B are schematic partial end views of a first support member, etc., for explaining [Spindt-type field emission device: Variant-5 of production method].

First, procedures up to the formation of the opening portion 15 are carried out in the same manner as in [Step-1300] in Variant-1 of production method. Then, an electrically conductive material layer for forming the base is formed on the entire surface including the inside of the opening portion 15, and the electrically conductive material layer is etched, whereby the base 84 filling bottom portion of the opening portion 15 can be formed. While the base 84 shown in Figures has a flat surface, the surface may be dented. The base 84 having a flat surface can be formed in the same manner as in [Step-1600] in Variant-4 of production method. Further, the adhesion layer 80 and the electrically conductive material layer 81 for an electron-emitting portion are consecutively formed on the entire surface including the inside of the rest of the opening portion 15. In this case, the thickness of the electrically conductive material layer 81 is determined such that a nearly funnel-like recess 81A having a columnar portion 81B and a widened portion 81C communicating with the upper end portion of the columnar portion 81B is formed in a surface of the electrically conductive material layer 81, the columnar portion 81B reflecting a step between the upper end surface of the rest of the opening portion 15 and the surface of the bottom portion thereof. Then, the mask material layer 82 is formed on the electrically conductive material layer 81. The mask material layer 82 is composed, for example, of copper. FIG. 48A shows the thus-completed state.

[Step-1710]

Figure 48B:
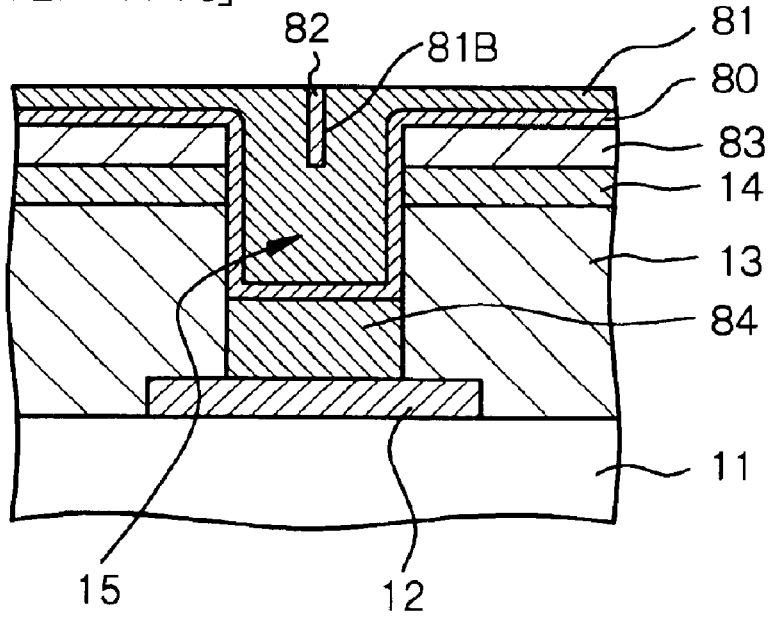

The mask material layer 82 and the electrically conductive material layer 81 are removed in a plane in parallel with the surface of the first supporting substrate 11, to retain the mask material layer 82 in the columnar portion 81B (see FIG. 48B). The above removal can be carried out by a chemical mechanical/polishing method (CMP method) in the same manner as in [Step-1430] in Variant-2 of production method.

[Step-1720]

Then, the electrically conductive material layer 81, the mask material layer 82 and the adhesion layer 80 are etched, to form an electron-emitting electrode 16E having a conical form depending upon the selective ratio to a resist based on the above-described mechanism. These layers can be etched in the same manner as in [Step-1440] in Variant-2 of production method. The electron-emitting portion comprises the electron-emitting electrode 16E, the base 84 and the adhesion layer 80 remaining between the electron-emitting electrode 16E and the base 84. While the electron-emitting portion may naturally have a conical form as a whole, FIG. 49A shows a state where a part of the base 84 is filled in bottom portion of the opening portion 15. Such a form is produced when the mask material layer 82 filled in the columnar portion 81 has a small height or when the etching rate of the mask material layer 82 is relatively high. The above form does not at all affect the function of the electron-emitting portion.

[Step-1730]

Then, inside the opening portion 15, the side wall surface of the insulating layer 13 is receded under an isotropic etching condition, whereby a field emission device shown in FIG. 49B is completed. The isotropic etching condition can be the same as those explained in Variant-1 of production method.

[Spindt-Type Field Emission Device: Variant-6 of Production Method]

Figure 50:
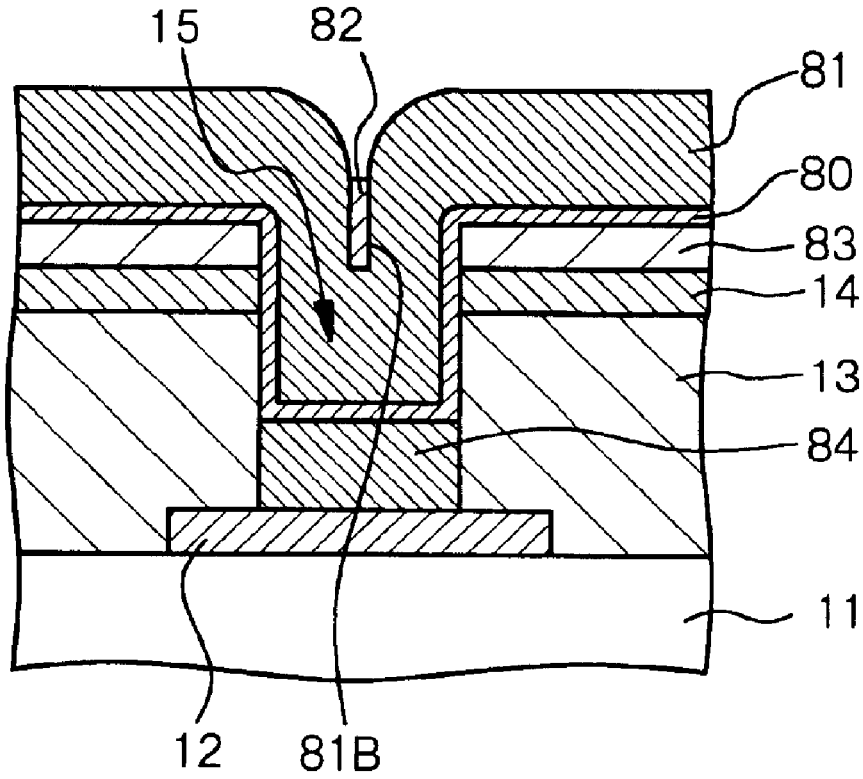
FIG. 50 is a schematic partial end view of a first support member, etc., for explaining [Spindt-type field emission device: Variant-6 of production method].

Variant-6 of production method is a variant of the Variant-3 of production method. Variant-6 of production method differs from Variant-3 of production method in that the electron-emitting portion has a base 84 and a conical electron-emitting electrode 16E stacked on the base 84 like Variant-4 of production method. Variant-6 of production method will be explained hereinafter with reference to FIG. 50 showing a schematic partial end view of a first supporting substrate, etc.

[Step-1800]

Procedures up to the formation of the mask material layer 82 are carried out in the same manner as in [Step-1700] in Variant-5 of production method. Then, only the mask material layer 82 on the electrically conductive material layer 81 and in the widened portion 81C is removed, thereby to retain the mask material layer 82 in the columnar portion 81B (see FIG. 50). The mask material layer 82. composed of copper can be selectively removed without removing the electrically conductive material layer 81 composed of tungsten, for example, by wet etching with a diluted hydrofluoric acid aqueous solution. Thereafter, all the steps of etching the electrically conductive material layer 81 and the mask material layer 82, isotropically etching the insulating layer 13, etc., can be carried out in the same manner as in Variant-5 of production method.

[Flat-Type Field Emission Device (No. 3)]

Figure 51:
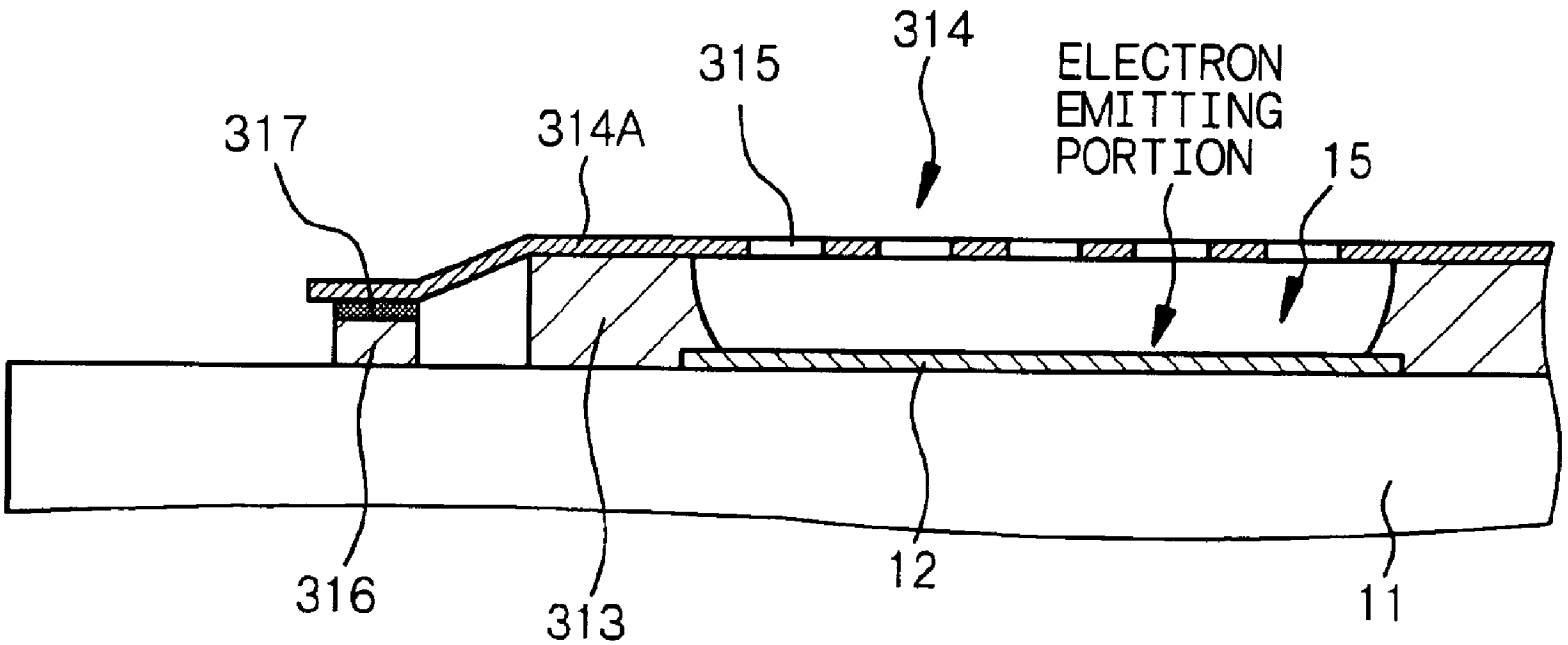
FIG. 51 is a schematic partial end view of a [flat-type field emission device (No. 3)].

The flat-type field emission device (No. 3) is a variant of the flat-type field emission device (No. 1) that has been already explained. The flat-type field emission device (No. 3) differs from the flat-type field emission device (No. 1) in that it has the fourth structure. That is, the flat-type field emission device (No. 3) comprises;

(A) a gate electrode support 313 made of an insulating material in the form of a stripe and formed on a first support member 11, (B) a gate electrode 314 made of a stripe-shaped material layer 314A having a plurality of opening portions 315 formed through the material layer 314A, and (C) an electron emitting portion, wherein the stripe-shaped material layer 314A is arranged such that the material layer 314A is in contact with a top surface of the gate electrode support 313 and that the opening portion 315 is positioned above the electron emitting portion. The stripe-shaped material layer 314A is bonded to the top surface of the gate electrode support 313 with a heat-curable adhesive (for example, an epoxy-containing adhesive). Otherwise, there may be employed a structure in which both end portions of the stripe-shaped material layer 314A are fixed to circumferential regions of the first support member 11, as shown in FIG. 51 which shows a schematic partial cross-sectional view of vicinity of the circumferential region of the first support member 11. More specifically, for example, projections 316 are formed on the circumferential regions of the first support member 11 in advance, and a thin film 317 made of the same material as the material for constituting the stripe-shaped material layer 314A is pre-formed on a top surface of the projection 316. And, while the stripe-shaped material layer 314A is arranged, the stripe-shaped material layer 314A is welded to the thin film 317, for example, with a laser. The projection 316 can be formed, for example, simultaneously with the formation of the gate electrode support 313.

One example of the production method of the flat-type field emission device (No. 3) will be explained below.

[Step-1900]

First, a cathode electrode 12 (made of Cr) constituted of a stripe-shaped electrically conductive material for a cathode electrode, extending in the first direction, is formed on the first support member 11 in the same manner as in [Step-600] of the flat-type field emission device (No. 1).

[Step-1910]

Then, an insulating layer 13 is formed on the entire surface in the same manner as in [Step-610] of the flat-type field emission device (No. 1). Then, opening portions 15 are formed through the insulating layer 13 by lithography and an etching technique. Alternatively, for example, the opening portions 15 may be formed together with the formation of the insulating layer 13 by a screen printing method. In this manner, that surface of the cathode electrode 12 which corresponds to the electron emitting portion can be exposed in a bottom portion of the opening portions 15. The above insulating layer 13 corresponds to the gate electrode support 313.

[Step-1920]

Then, the stripe-shaped material layer 314A having a plurality of opening portions 315 are arranged such that the opening portions 315 are positioned above the electron emitting portions and that the stripe-shaped material layer 314A is in a state where it is supported on the gate electrode supports 313 made of the insulating layer 13, and further, the stripe-shaped material layer 314A is arranged in the second direction different from the first direction, whereby the gate electrode 314 that is formed of the stripe-shaped material layer 314A and has a plurality of the opening portions 315 is positioned above the electron emitting portion.

The above method of forming the gate electrode can be applied to the production of the above various field emission devices.

[Flat-Type Field Emission Device (No. 4)]

Figure 52A:
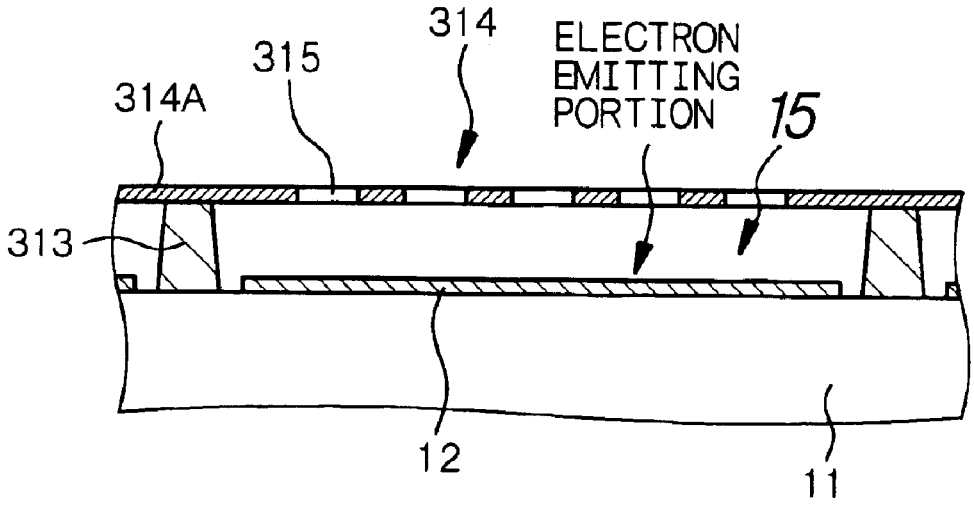
FIGS. 52A and 52B are a schematic partial cross-sectional view and a schematic plan view of a [flat-type field emission device (No. 4)].
Figure 52B:
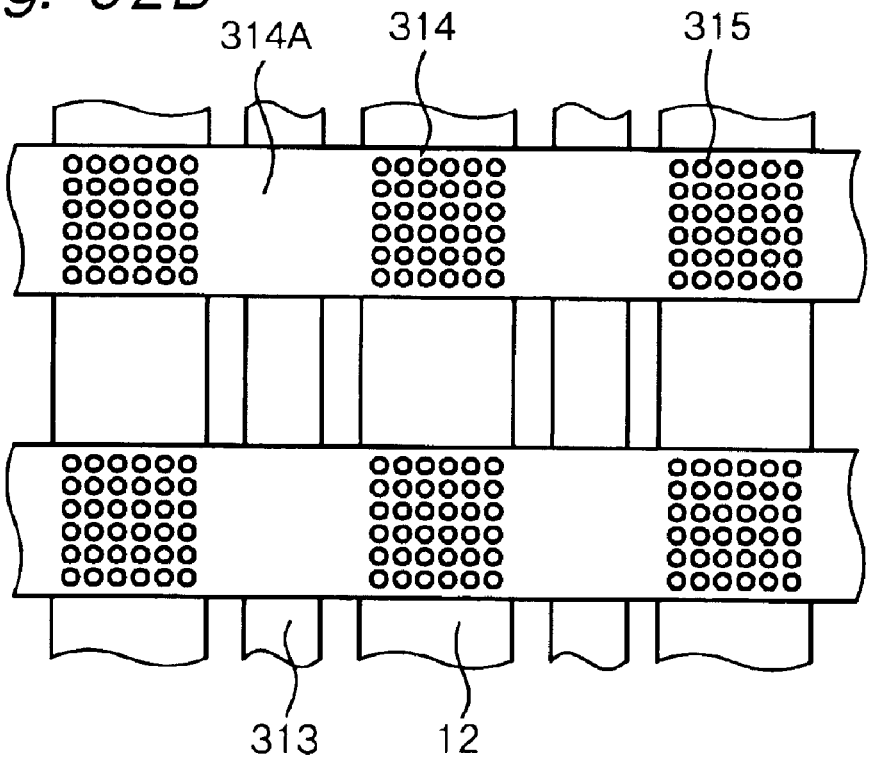
Figure 53A:
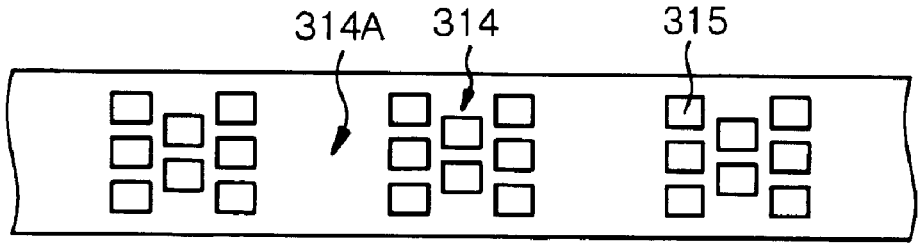
FIGS. 53A to 53D are schematic plan views of a plurality of opening portions provided in gate electrodes.
Figure 53B:
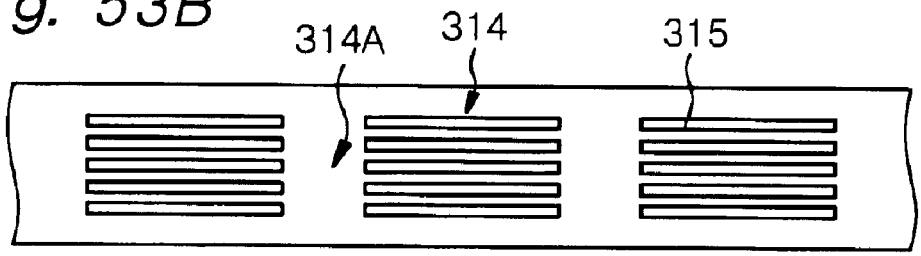
Figure 53C:
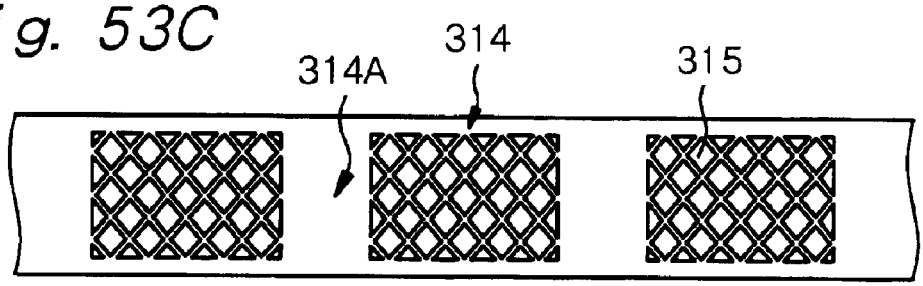
Figure 53D:
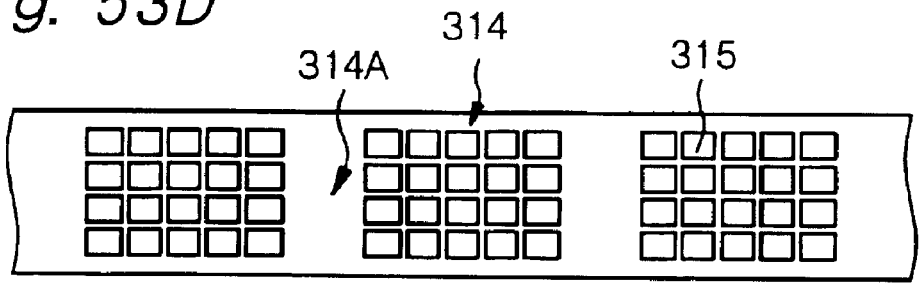

The flat-type field emission device (No. 4) is a variant of the flat-type display device (No. 3). In the flat-type field emission device (No. 4), unlike the flat-type field emission device (No. 3), the gate electrode support 313 in the form of a rib is formed between the cathode electrodes 12 as shown in FIG. 52A showing a schematic partial cross-sectional view thereof. FIG. 52B shows a schematic layout of cathode electrodes 12, stripe-shaped material layers 314A, gate electrodes 314 and gate electrode supports 313.

The stripe-shaped material layer 314A is bonded to a top surface of the gate electrode support 313 with a heat-curable adhesive (for example, an epoxy-containing adhesive). Otherwise, as shown in FIG. 51 showing a schematic partial cross-sectional view, there may be employed a structure in which both end portions of the stripe-shaped material layer 314A are fixed to circumferential regions of the first support member 11. More specifically, for example, projections 316 are formed on the circumferential regions of the first support member 11, and a thin film 317 made of the same material as the material for constituting the stripe-shaped material layer 314A is pre-formed on a top surface of the projection 316 in advance. And, while the stripe-shaped material layer 314A is arranged, the stripe-shaped material layer 314A is welded to the above thin films 317, for example, with a laser.

The flat-type field emission device (No. 4) an be produced, for example, by a production method to be explained below.

[Step-2000]

First, the gate electrode support 313 is formed on the first support member 11, for example, by a sand blasting method.

[Step-2010]

Then, the electron emitting portion is formed on the first support member 11. Specifically, a mask layer made of a resist material is formed on the entire surface by a spin coating method, and the mask layer in a region where the cathode electrode is to be formed, between the gate electrode supports 313 and 313, is removed. Then, an electrically conductive material layer for a cathode electrode made of chromium (Cr) is formed on the entire surface in the same manner as in [Step-600] of the flat-type field emission device (No. 1), and then, the mask layer is removed. By the above procedures, the electrically conductive material layer for the cathode electrode, formed on the mask layer, is removed, and the cathode electrode 12 that is to work as an electron emitting. portion remains between the gate electrode supports 313 and 313.

[Step-2020]

Then, the stripe-shaped material layer 314A having a plurality of opening portions 315 is arranged such that a plurality of the opening portions 315 are positioned above the electron emitting portion and that the stripe-shaped material layer 314A is in a state where the stripe-shaped material layer 314A is supported on the gate electrode supports 313, whereby the gate electrode 314 formed of the stripe-shaped material layer 314A having a plurality of the opening portions 315 is positioned above the electron emitting portion. The method of arranging the stripe-shaped material layer 314A can be as described above.

The above method of forming the gate electrode can be applied to the production of the above various field emission devices.

In the flat-type field emission device (No. 3) or the flat-type field emission device (No. 4), the plan form of the opening portion shall not be limited to a circular form. FIGS. 53A, 53B, 53C and 53D show variant examples of the opening portion 315 made through the stripe-shaped material layer 314A.

[Field Emission Device Having Focus Electrode]

Figure 54:
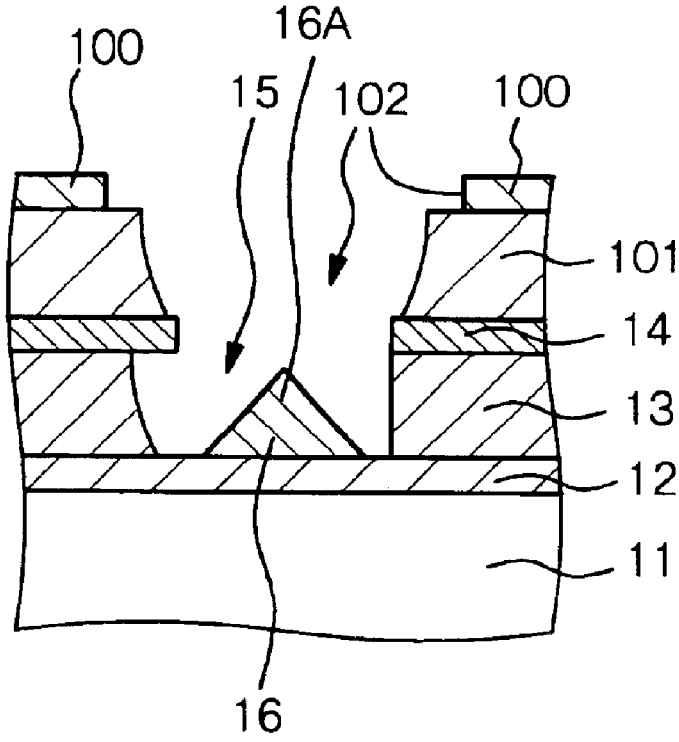
FIG. 54 is a schematic partial end view of an electron emitting portion and a focus electrode.

FIG. 54 shows a schematic partial end view of an electron emitting portion 16 and a focus electrode 100. In an example shown in FIG. 54, a second insulating layer 101 is formed on a gate electrode 14 and an insulating layer 13, and the focus electrode 100 is formed on the second insulating layer 101. An opening portion 102 communicating with an opening portion 15 is formed through the focus electrode 100 and the second insulating layer 101. While a Spindt-type field emission device is shown as an example, the field emission device shall not be limited thereto, and any one of the above various field emission devices can be used.

A field emission device combined with the above focus electrode 100 can be produced by substantially incorporating, into the steps of the production method of the above various field emission devices, the steps of forming the second insulating layer 101 on the gate electrode 14 and the insulating layer 13, forming the focus electrode 100 on the second insulating layer 101 and then forming the opening portion 102 through the focus electrode 100 and the second insulating layer 101. A detailed explanation thereof is therefore omitted. Depending upon patterning of the focus electrode, the focus electrode may be a focus electrode having a form in which focus electrode units, each of which corresponds to one or a plurality of electron emitting portions or one or a plurality of pixels, are gathered or may be a focus electrode having a form in which the effective field is covered with a sheet of an electrically conductive material.

Not only the focus electrode is formed by the above method, but also the focus electrode can be formed by forming an insulating film made, for example, of $SiO_2$ on each surface of a metal sheet made, for example, of 42% Ni—Fe alloy having a thickness of several tens micrometers and then forming the opening portions 102 in regions corresponding to pixels by punching or etching. And, the cathode panel, the metal sheet and the anode panel are stacked, a frame is arranged in circumferential portions of the two panels, and heat treatment is carried out to bond the insulating film formed on one surface of the metal sheet and the insulating layer 13 and to bond the insulating film formed on the other surface of the metal sheet and the anode panel, whereby these members are integrated, followed by vacuuming and sealing. In this manner, the display can be also completed. Alternatively, the cathode panel and the metal sheet are stacked, heat treatment is carried out to bond these members, and then the cathode panel and the anode panel are assembled, whereby the display can be also completed.

When the above focus electrode is provided, the display comes to have the above constitution, (2) a constitution in which the cathode electrode, the gate electrode and the focus electrode provided in the cathode panel of the cold cathode field emission display correspond to the first electrode provided in the first substrate, and the anode electrode provided in the anode panel of the cold cathode field emission display corresponds to the second electrode, or (4) a constitution in which the anode electrode provided in the anode panel of the cold cathode field emission display corresponds to the first electrode provided in the first substrate and the cathode electrode, the gate electrode and the focus electrode provided in the cathode panel of the cold cathode field emission display correspond to the second electrode provided in the second substrate.

For these constitutions, the knocking treatment method in Examples 1, 2, 4 or 5 can be carried out.

Alternatively, the display comes to have the above constitution, (6) a constitution in which the cathode electrode, the gate electrode and the focus electrode provided in the cathode panel of the cold cathode field emission display correspond to electrodes provided in the substrate. For such a constitution, the substrate knocking treatment method in Examples 3, 6 or 7 can be carried out.

The present invention has been explained on the basis of Examples hereinabove, while the present invention shall not be limited thereto. Various conditions of the knocking treatment method and the substrate knocking treatment method explained in the Examples and the structures and constitutions of the cold cathode field emission display and the field emission devices are given as examples and can be changed and altered as required. Further, the production methods of the cold cathode field emission displays and the field emission devices are also given as examples and can be changed and altered as required.

Further, various materials used in the productions of the field emission devices are also given as examples and can be changed and altered as required. With regard to the field emission devices, while there have been explained embodiments in which one electron emitting portion (electron emission electrode) corresponds to one opening portion in most cases, there may be employed an embodiment in which a plurality of electron emitting portions (electron emission electrodes) correspond to one opening portion or an embodiment in which one electron emitting portion (electron emission electrode) corresponds to a plurality of opening portions, which depends upon structures of the field emission devices. Alternatively, there may be also employed an embodiment in which a plurality of opening portions are formed through the gate electrode, one opening portion communicating with a plurality of the opening portions is formed through the insulating layer, and one or a plurality of electron emitting portions are formed.

The gate electrode can be formed so as to have a form in which the effective field is covered with one sheet of an electrically conductive material (having an opening portion). In this case, a positive voltage (for example, 160 volts) is applied to the gate electrode. And, a switching element constituted, for example, of TFT is provided between the cathode electrode constituting a pixel and the cathode-electrode driving circuit, and the voltage application state to the cathode electrode constituting the pixel is controlled by the operation of the above switching element, to control the light emission state of the pixel. Alternatively, the cathode electrode can be formed so as to have a form in which the effective field is covered with one sheet of an electrically conductive material layer. In this case, for example, 0 volt is applied to the cathode electrode. And, a switching element constituted, for example, of TFT is provided between the gate electrode constituting a pixel and the gate-electrode driving circuit, and the voltage application state to the gate electrode constituting the pixel is controlled by the operation of the switching element, to control the light emission state of the pixel.

The voltage $V_1$ higher than the voltage applied to the cathode electrode may be stepwise or pulsewise applied to the gate electrode to field-evaporate projections present in the gate electrode. In this case, after the pulse-voltage-applying step of applying the pulse voltage $V_1$ to the gate electrode higher than the voltage applied to the cathode electrode, there may be carried out the current-detection step of applying the voltage $V_2$ to the cathode electrode higher than the voltage applied to the gate electrode to detect a current flowing between the gate electrode and the cathode electrode. When the current flowing between the gate electrode and the cathode electrode comes to be a predetermined value or less, there may be repeated the pulse-voltage-applying step and the current-detection step in which a voltage higher than the voltage $V_1$ is set as a new voltage $V_1$ and a voltage higher than the voltage $V_2$ is set at a new voltage $V_2$. Further, when the voltage $V_2$ comes to be equal to the actual operation voltage $V_{op}$ of the flat-type display device, there may be repeated the pulse-voltage-applying step and the current-detection step in which a voltage higher than the voltage $V_1$ is set at a new voltage $V_1$ and the voltage $V_2$ is set at a value equal to the actual operation voltage $V_{op}$, until the current flowing between the gate electrode and the cathode electrode comes to be a predetermined value or less. The operation in the above cases can be carried out in substantially the same manner as in the operation of the knocking treatment method explained, for example, in Example 4 or 5.

The electron-emitting portion can be also constituted of devices generally called surface conduction type field emission devices. The surface conduction type field emission device comprises a first support member made of glass and pairs of electrodes formed on the first support member in the form of a matrix, the electrodes being made of an electrically conductive material such as tin oxide ($SnO_2$), gold (Au), indium oxide ($In_2O_3$)/tin oxide ($SnO_2$), carbon or palladium oxide (PdO) and having a fine area and a pair of the electrodes being arranged at constant intervals (gaps). A carbon thin film is formed on each electrode. A row-direction wiring is connected to one electrode of a pair of the electrodes, and a column-direction wiring is connected to the other electrode of the pair of the electrodes. When a voltage is applied to a pair of the electrodes, an electric field is applied to the carbon thin films opposed to each other through the gap, and electrons are emitted from the carbon thin film. Such electrons are allowed to collide with a phosphor layer on an anode panel to excite the phosphor layer to emit light, whereby a desired image can be obtained.

In the present invention, the projections present in the electrodes can be reliably removed by field evaporation. Therefore, a discharge between the electrodes of the flat-type display device can be suppressed, a stable operation can be realized, and there can be obtained a flat-type display device having high display qualities and a long lifetime. Further, during the production of the flat-type display device, controlling of particles and controlling of production steps can be moderated. When the knocking treatment method or the substrate knocking treatment method according to the second aspect of the present invention is employed, the knocking treatment can be speedily completed and TAT can be decreased.

What is claimed is:

1. A knocking treatment method in a flat-type display device in which a first substrate provided with a first electrode and a second substrate provided with a second electrode are disposed with a vacuum space interposed between the first and second substrates and the first substrate and the second substrate are bonded to each other in their circumferential portions, said method comprising stepwise applying, a voltage V1 to the first electrode higher than a voltage applied to the second electrode to remove a projection present in the first electrode by field evaporation; wherein after the first voltage-application step of applying the voltage V1 to the first electrode higher than the voltage applied to the second electrode, a second voltage-application step of applying a voltage V2 to the second electrode higher than the voltage applied to the first electrode is carried out to field-evaporate the projections present in the second electrode, and then, a voltage higher than the voltage V1 is set as a new voltage V1, a voltage higher than the voltage V2 is set as a new voltage V2 and the first voltage-application step and the second voltage-application step are repeated.

2. The knocking treatment method in a flat-type display device according to claim 1, in which the value of the voltage V1 and the value of the voltage V2 are equal to each other.

3. The knocking treatment method in a flat-type display device according to claim 1, in which the flat-type display device is a cold cathode field emission display;

a cathode electrode and a gate electrode provided in a cathode panel of the cold cathode field emission display correspond to the first electrode provided in the first substrate; and an anode electrode provided in an anode panel of the cold cathode field emission display corresponds to the second electrode provided in the second substrate.

4. The knocking treatment method in a flat-type display device according to claim 1, in which the flat-type display device is a cold cathode field emission display;

a cathode electrode, a gate electrode and a focus electrode provided in a cathode panel of the cold cathode field emission display correspond to the first electrode provided in the first substrate; and an anode electrode provided in an anode panel of the cold cathode field emission display corresponds to the second electrode provided in the second substrate.

5. A knocking treatment method in a flat-type display device in which a first substrate provided with a first electrode and a second substrate provided with a second electrode are disposed with a vacuum space interposed between the first and second substrates and the first substrate and the second substrate are bonded to each other in their circumferential portions, said method comprising pulsewise applying a voltage V1 to the first electrode higher than a voltage applied to the second electrode to remove a projection present in the first electrode by field evaporation; wherein after the pulse-voltage-applying step of pulsewise applying the voltage V1 to the first electrode higher than the voltage applied to the second electrode, a current-detection step of applying a voltage V2 to the second electrode higher than the voltage applied to the first electrode is carried out to detect a current flowing between, the first electrode and the second electrode.

6. The knocking treatment method in a flat-type display device according to claim 5, in which, when the current flowing between the first electrode and the second electrode reaches a predetermined value or lower, a voltage higher than the voltage V1 is set as a new voltage V1, a voltage higher than the voltage V2 is set as a new voltage V2, and the pulse-voltage-applying step and the current-detection step are repeated.

7. The knocking treatment method in a flat-type display device according to claim 6, in which, when the voltage V2 comes to be equal to an actual operation voltage VOP of the flat-type display device, a voltage higher than the voltage V1 is set as a new voltage V1, the voltage V2 is set at a value equal to the actual operation voltage VOP, and the pulse-voltage-applying step and the current-detection step are repeated until the current flowing between the first electrode and the second electrode comes to be a predetermined value or smaller.

8. The knocking treatment method in a flat-type display device according to claim 5, in which the flat-type display device is a cold cathode field emission display;

a cathode electrode and a gate electrode provided in a cathode panel of the cold cathode field emission display correspond to the first electrode provided in the first substrate; and an anode electrode provided in an anode panel of the cold cathode field emission display corresponds to the second electrode provided in the second substrate.

9. The knocking treatment method in a flat-type display device according to claim 5, in which the flat-type display device is a cold cathode field emission display;

a cathode electrode, a gate electrode and a focus electrode provided in a cathode panel of the cold cathode field emission display correspond to the first electrode provided in the first substrate; and an anode electrode provided in an anode panel of the cold cathode field emission display corresponds to the second electrode provided in the second substrate.

10. A knocking treatment method in a substrate for a flat-type display device comprising disposing the substrate for a flat-type display device having an electrode and a substrate for knocking having an electrode for knocking with a vacuum space interposed between the substrates, and then, stepwise applying a voltage V1 to the electrode higher than a voltage applied to the electrode for knocking to remove a projection present in the electrode by field evaporation; wherein the substrate for a flat-type display device is a substrate for a cold cathode field emission display; and an anode electrode provided in an anode panel of the cold cathode field emission display corresponds to the electrode provided in the substrate for a flat-type display device.

11. A knocking treatment method in a substrate for a flat-type display device comprising disposing the substrate for a flat-type display device having an electrode and a substrate for knocking having an electrode for knocking with a vacuum space interposed between the substrates, and then, pulsewise applying a voltage V1 to the electrode higher than a voltage applied to the electrode for knocking to remove a projection present in the electrode by field evaporation; wherein after the pulse-voltage-applying step of pulsewise applying the voltage V1 to the electrode higher than the voltage applied to the electrode for knocking, a current-detection step of applying a voltage V2 to the electrode for knocking higher than the voltage applied to the electrode is carried out to detect a current flowing between the electrode and the electrode for knocking.

12. The knocking treatment method in a substrate for a flat-type display device according to claim 11, in which the substrate for a flat-type display device is a substrate for a cold cathode field emission display; and an anode electrode provided in an anode panel of the cold cathode field emission display corresponds to the electrode provided in the substrate for a flat-type display device.

13. The knocking treatment method in a substrate for a flat-type display device according to claim 11, in which, when the current flowing between the electrode and the electrode for knocking comes to be a predetermined value or smaller, a voltage higher than the voltage V1 is set as a new voltage V1, a voltage higher than the voltage V2 is set as a new voltage V2, and the pulse-voltage-applying step and the current-detection step are repeated.

14. The knocking treatment method in a substrate for a flat-type display device according to claim 13, in which, when the voltage V2 comes to be equal to an actual operation voltage VOP of the flat-type display device, a voltage higher than the voltage V1 is set at a new voltage V1, the voltage V2 is set at a value equal to the actual operation voltage VOP, and the pulse-voltage-applying step and the current-detection step are repeated until the current flowing between the electrode and the electrode for knocking comes to be a predetermined value or smaller.

* * * * *

UNITED STATES PATENT AND TRADEMARK OFFICE

CERTIFICATE OF CORRECTION

PATENT NO. : 6,945,838 B2
DATED : September 20, 2005
INVENTOR(S) : Morikazu Konishi It is certified that error appears in the above-identified patent and that said Letters Patent is hereby corrected as shown below:

Title page,
Item [54], Title, should read -- KNOCKING TREATMENT METHOD IN FLAT-TYPE DISPLAY DEVICE AND KNOCKING TREATMENT METHOD IN SUBSTRATE FOR A FLAT-TYPE DISPLAY DEVICE --.

Signed and Sealed this

Twenty-eighth Day of March, 2006

JON W. DUDAS
*Director of the United States Patent and Trademark Office*